US010863806B2

(12) United States Patent
Shaffett et al.

(10) Patent No.: US 10,863,806 B2
(45) Date of Patent: Dec. 15, 2020

(54) COLLAPSIBLY ERECTABLE BAG

(71) Applicant: The Better Shopping Bag Co. Inc., Sarasota, FL (US)

(72) Inventors: Richard Shaffett, Sarasota, FL (US); Arturo Aviles, Venice, FL (US)

(73) Assignee: THE BETTER SHOPPING BAG CO. INC., Sarasota, FL (US)

( * ) Notice: Subject to any disclaimer, the term of this patent is extended or adjusted under 35 U.S.C. 154(b) by 0 days.

(21) Appl. No.: 16/854,629

(22) Filed: Apr. 21, 2020

(65) Prior Publication Data

US 2020/0337425 A1 Oct. 29, 2020

Related U.S. Application Data

(60) Provisional application No. 62/837,406, filed on Apr. 23, 2019.

(51) Int. Cl.

| | |
|---|---|
| ***A45C 7/00*** | (2006.01) |
| ***B65D 33/02*** | (2006.01) |
| ***B65D 33/24*** | (2006.01) |
| ***A45C 13/02*** | (2006.01) |
| ***A45C 13/30*** | (2006.01) |
| *A45C 3/04* | (2006.01) |
| *B65B 67/12* | (2006.01) |

(Continued)

(52) U.S. Cl.

CPC ..... *A45C 7/0077* (2013.01); *A45C 7/0063* (2013.01); *A45C 13/02* (2013.01); *A45C 13/30* (2013.01); *B65D 33/02* (2013.01); *B65D 33/24* (2013.01); *A45C 3/04* (2013.01); *A45C 2013/026* (2013.01); *B65B 67/1238* (2013.01); *B65D 33/007* (2013.01); *D06F 95/004* (2013.01)

(58) Field of Classification Search

CPC ..... A45C 7/0077; A45C 7/0063; A45C 13/02; A45C 13/30; A45C 2013/026; A45C 3/04; B65D 33/02; B65D 33/24; B65D 33/007; D06F 95/004; E04H 15/34; Y10T 16/53888; Y10T 16/5389; B65F 1/1415; B65B 67/1238

USPC ..... 135/126, 128; 220/4.29, 9.1, 9.2, 9.3, 220/666, 668; 267/154; 16/75, 76, 225, 16/304, 307, 308, 381; 190/107; 383/33, 383/34, 119

See application file for complete search history.

(56) References Cited

U.S. PATENT DOCUMENTS 371,308 A * 10/1887 Dumas ..... E05F 1/1215 16/304
1,672,322 A * 6/1928 Keiser ..... A45C 7/0063 383/119

(Continued)

*Primary Examiner* — Gideon R Weinerth

(57) ABSTRACT

Disclosed herein is a collapsibly erectable bag. Further, the collapsibly erectable bag may include at least one panel and an elastic component pair. Further, the at least one panel may be configured for forming an interior space and an opening leading into interior space. Further, the at least one panel may include a plurality of side panel pairs and a bottom panel. Further, a side panel pair of the plurality of side panel pairs may include oppositely facing panels. Further, the elastic component pair may be coupled to a primary side panel pair of the plurality of side panel pairs. Further, applying of a force on an elastic component of the elastic component pair may be configured for moving the elastic component from an initial position to a final position collapsing a first primary side panel of the primary side panel pair.

14 Claims, 70 Drawing Sheets

(51) Int. Cl.
*B65D 33/00* (2006.01)
*D06F 95/00* (2006.01)

(56) References Cited

U.S. PATENT DOCUMENTS 2,509,462 A * 5/1950 Rudolf ..... E05F 1/1215 220/830
2,564,570 A * 8/1951 Hatfield ..... A45C 1/06 267/154
2,718,943 A * 9/1955 Braverman ..... A45C 7/0036 190/107
2,795,259 A * 6/1957 Nash ..... A45C 1/02 150/152
3,174,493 A * 3/1965 Gruenberg ..... E04H 15/003 135/143
3,388,420 A * 6/1968 Ballantyne ..... E05D 1/02 16/225
4,180,111 A * 12/1979 Davis ..... A45C 7/0063 383/10
4,180,112 A * 12/1979 Bovet ..... A45C 3/10 383/4
4,375,828 A * 3/1983 Biddison ..... A45C 11/20 206/523
4,985,721 A * 1/1991 Moon ..... G03D 17/00 190/107
4,993,846 A * 2/1991 Diamond ..... A45C 13/004 190/106
5,024,344 A * 6/1991 Paula ..... A45C 3/04 220/9.3
5,044,699 A * 9/1991 Duty ..... A45C 3/04 190/108
5,213,418 A * 5/1993 Dancy ..... A45C 3/04 383/104
5,259,674 A * 11/1993 Hedaya ..... B65D 33/007 383/127
5,350,241 A * 9/1994 Zoland ..... A45C 13/004 383/127
5,542,767 A * 8/1996 Hedaya ..... A45C 13/004 383/127
5,620,069 A * 4/1997 Hurwitz ..... A45C 3/00 190/107
5,964,533 A * 10/1999 Ziglar ..... D06F 95/002 220/9.2
6,494,335 B1 * 12/2002 Kellogg ..... D06F 95/004 135/126
6,550,967 B2 * 4/2003 Hedaya ..... A45C 13/004 383/127
8,628,242 B2 * 1/2014 Buller ..... A45C 7/0077 383/2
8,985,432 B2 * 3/2015 Cullen ..... B65D 11/1853 206/170
10,046,908 B2 * 8/2018 Schneider ..... B65D 11/186
2003/0136702 A1 * 7/2003 Redzisz ..... A45C 7/0077 206/545
2003/0174908 A1 * 9/2003 Hedaya ..... A45C 13/004 383/127
2005/0230390 A1 * 10/2005 Glenn ..... D06F 95/002 220/6
2006/0191930 A1 * 8/2006 Godano ..... B65D 37/00 220/9.2
2008/0053995 A1 * 3/2008 Wang ..... B65D 33/007 220/9.2
2008/0137999 A1 * 6/2008 Chi ..... A45C 7/0077 383/127
2008/0302789 A1 * 12/2008 Stevenson ..... B65D 7/30 220/4.33
2008/0307824 A1 * 12/2008 Botich ..... F25D 3/08 62/457.2
2009/0001089 A1 * 1/2009 Britt ..... B65D 88/1631 220/666
2009/0223954 A1 * 9/2009 Kellogg ..... D06F 95/002 220/6
2010/0014785 A1 * 1/2010 Deck ..... A45C 3/04 383/12
2010/0158414 A1 * 6/2010 Michailidis ..... B60R 7/02 383/12
2011/0085750 A1 * 4/2011 Wang ..... A45C 7/0036 383/119
2011/0168598 A1 * 7/2011 Rees ..... B65D 11/186 206/505
2012/0267365 A1 * 10/2012 Sabounjian ..... A45C 13/02 220/6
2013/0092686 A1 * 4/2013 Sabounjian ..... D06F 95/002 220/9.2
2013/0284734 A1 * 10/2013 Huang ..... B65D 11/28 220/9.4
2014/0093188 A1 * 4/2014 Bush ..... A45C 7/0077 383/6
2014/0177981 A1 * 6/2014 Rumbough ..... A45C 3/001 383/10
2014/0254959 A1 * 9/2014 Peck ..... A45C 7/0077 383/107
2017/0127777 A1 * 5/2017 Cohen ..... A45C 13/1076
2018/0266046 A1 * 9/2018 Barre ..... A45C 9/00
2020/0063332 A1 * 2/2020 Holderness ..... A45C 7/0063
2020/0157733 A1 * 5/2020 Holderness ..... B65D 25/28

* cited by examiner

COLLAPSIBLY ERECTABLE BAG

The current application claims a priority to the U.S. Provisional Patent application Ser. No. 62/837,406 filed on Apr. 23, 2019.

FIELD OF THE INVENTION

Generally, the present disclosure relates to the field of flexible bags. More specifically, the present disclosure relates to a collapsibly erectable bag.

BACKGROUND OF THE INVENTION

Carrying devices such as bags are a vital accessory item that provides a user with enhanced convenience and capability of carrying a large number of items. While carrying devices such as bags have existed for a certain period of time, additional components have yet to be implemented into existing bags to provide the user even further capability.

Existing bags are deficient with regard to several aspects. For instance, the bag does not allow for easy collapsing of the bag. Furthermore, the bag does not allow for easy erecting of the bag.

Therefore, there is a need for an improved collapsibly erectable bag that may overcome one or more of the above-mentioned problems and/or limitations.

SUMMARY OF THE INVENTION

This summary is provided to introduce a selection of concepts in a simplified form, that are further described below in the Detailed Description. This summary is not intended to identify key features or essential features of the claimed subject matter. Nor is this summary intended to be used to limit the claimed subject matter's scope.

Disclosed herein is a collapsibly erectable bag, in accordance with some embodiments. Further, the collapsibly erectable bag may include at least one panel and an elastic component pair. Further, the at least one panel may be configured for forming an interior space and an opening leading into the interior space. Further, the at least one panel may include a plurality of side panel pairs and a bottom panel. Further, a side panel pair of the plurality of side panel pairs may include oppositely facing panels. Further, the elastic component pair may be coupled to a primary side panel pair of the plurality of side panel pairs. Further, applying of a force on an elastic component of the elastic component pair may be configured for moving the elastic component from an initial position to a final position collapsing a first primary side panel of the primary side panel pair. Further, the moving stores potential energy in the elastic component by deforming the elastic component. Further, withdrawing of the force converts the potential energy into kinetic energy by recovering the elastic member. Further, the recovering may be configured for moving the elastic component from the final position to the initial position erecting the first primary side panel.

Further disclosed herein is a collapsibly erectable bag, in accordance with some embodiments. Further, the collapsibly erectable bag may include at least one panel and an elastic component pair. Further, the at least one panel may be configured for forming an interior space and an opening leading into interior space. Further, the at least one panel may include a plurality of side panel pairs and a bottom panel. Further, a side panel pair of the plurality of side panel pairs may include oppositely facing panels. Further, the elastic component pair may be coupled to a primary side panel pair of the plurality of side panel pairs. Further, applying of a force on an elastic component of the elastic component pair may be configured for moving the elastic component from an initial position to a final position collapsing a first primary side panel of the primary side panel pair. Further, the moving stores potential energy in the elastic component by deforming the elastic component. Further, withdrawing of the force converts the potential energy into kinetic energy by recovering the elastic member. Further, the recovering may be configured for moving the elastic component from the final position to the initial position erecting the first primary side panel. Further, the elastic component may include a support member pair and an elastic member. Further, the support member pair may include a first support member and a second support member. Further, the elastic member may include a top elastic end and a bottom elastic end and each of the first support member and the second support member may include a top support end and a bottom support end. Further, a top support end of the first support member and a top support end of the second support member are rigidly coupled to the top elastic end and the bottom elastic end respectively. Further, the applying of the force on the first support member and the second support member may be configured for rotating the first support member and the second support around a longitudinal axis of the elastic member from the initial position to the final position collapsing the first primary side panel. Further, the rotation stores the potential energy in the elastic member by deforming the elastic member. Further, the withdrawing of the force converts the potential energy into the kinetic energy by recovering the elastic member. Further, the recovering may be configured for rotating the first support member and the second support around the longitudinal axis from the final position to the initial position erecting the first primary side panel.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and sub-combinations described in the detailed description.

BRIEF DESCRIPTION OF DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the applicants. The applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

DETAILED DESCRIPTION

Figure 1:
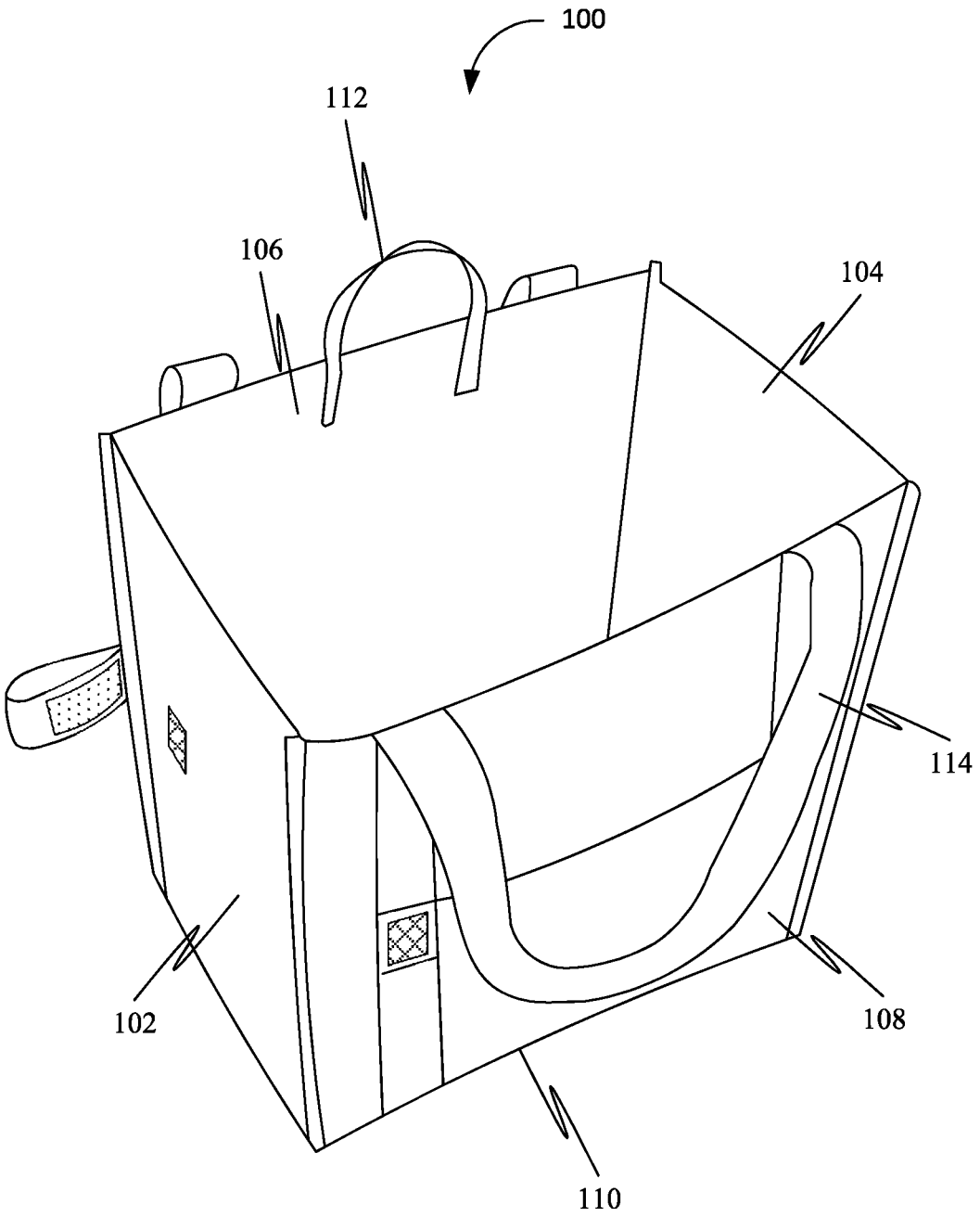
FIG. 1 is a front top left side perspective view of a collapsibly erectable bag, in accordance with some embodiments.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim limitation found herein and/or issuing here from that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the claims found herein and/or issuing here from. The present disclosure contains headers. It should be understood that these headers are used as references and are not to be construed as limiting upon the subjected matter disclosed under the header.

The present disclosure includes many aspects and features. Moreover, while many aspects and features relate to, and are described in the context of a collapsibly erectable bag, embodiments of the present disclosure are not limited to use only in this context.

Overview:

The present disclosure describes a collapsibly erectable bag. Further, the present disclosure may be a bag apparatus consisting of different compartments, sizes, and proportions that pops open and stays open. Further, in some embodiments, the bag apparatus may be referred to hereinafter as "The Pop Open Shopping Bag".

Further, the present disclosure may be a bag consisting of different compartments, sizes, proportions and compartments to provide the user enhanced convenience and flexibility. Further, the present disclosure may be an improved version of existing fabric and plastic bags of varying sizes and proportions. Further, the disclosed bag may be intended to be used as a consumer item to make it easier to put items into the bag when shopping, as well as having better stability when full and being transported home in a car. Further, the bag may be much better than existing shopping bags because it stays open when it should and closes down when a user wants. Further, the bag may be much more stable in the car when carrying groceries home. Further, double-wall design may allow for heavier loads to be carried.

Further, in some embodiments, the disclosed bag may consist of a double-walled rectangular fabric, plastic, or other man-made or natural material bag with attached carrying handles as well as a small hanger loop for wall storage, and possibly a small pocket on one side to carry a pad and pen. Further, each end of the bag may include a spring using a proprietary design, or a sheet of thin, springy plastic or other similar flexible, springy material. At each side of the bag may be sheets of springy plastic or non-springy plastic, cardboard, or other natural or man-made material. Further, the sheets may be then sandwiched between an outer bag and an inner lining of a natural or man-made material. Further, seams are sewn dosed, thereby trapping the spring or sheets in place.

Halfway up the outer edges of the front of the bag between the seam and the carrying handle strap on each side is mounted an element of Velcro, magnets or other fastening material, man-made or natural. At the same height on the outer edges of the back of the bag are mounted loops that have the fastening material attached.

To close the bag, the bag is laid down on the back with one hand on each small side of the bag. Thumbs press down on the middle point while fingers push the middle of small sides towards each other. As sides are held down, fingers bring loops over towards the center of the bag until fasteners on loops contact fasteners on the side of the bag. As hands release loops, fasteners keep the bag shut flat if using the spring, or nearly flat, but not completely, if using an alternate material.

To open the bag, one hand grabs each loop and pulls sharply away from each other. This releases the grip of the fasteners and allows the spring or springy plastic material component inside each end to flex out flat and spring the bag open.

The rigidity of the spring or plastic material and the cardboard insert components combine to give the bag an upright stance function.

Further, in some embodiments, the inner bag liner component can be made of a waterproof material.

Further, the present disclosure may use a proprietary torsion spring design, it is used to open the Pop Open Shopping Bag but can be applied to any use which requires a spring that will fold either partially or flat and then open.

The individual measurements can be adjusted to fit any application. Further, the spring may be of whatever dimensions, material type, and thickness necessary to give the required spring return strength and durability for the desired application.

The shape of the moving arms can be varied to fit the desired application shape and is not limited to a rectangular design.

The spring can be independently used inside a Pop Open Shopping Bag or other application, or it can have rigid materials attached to it to create an even straighter or flatter surface if required. While the spring may have one shape, the attached rigid materials can be of any shape desired.

Figure 2:
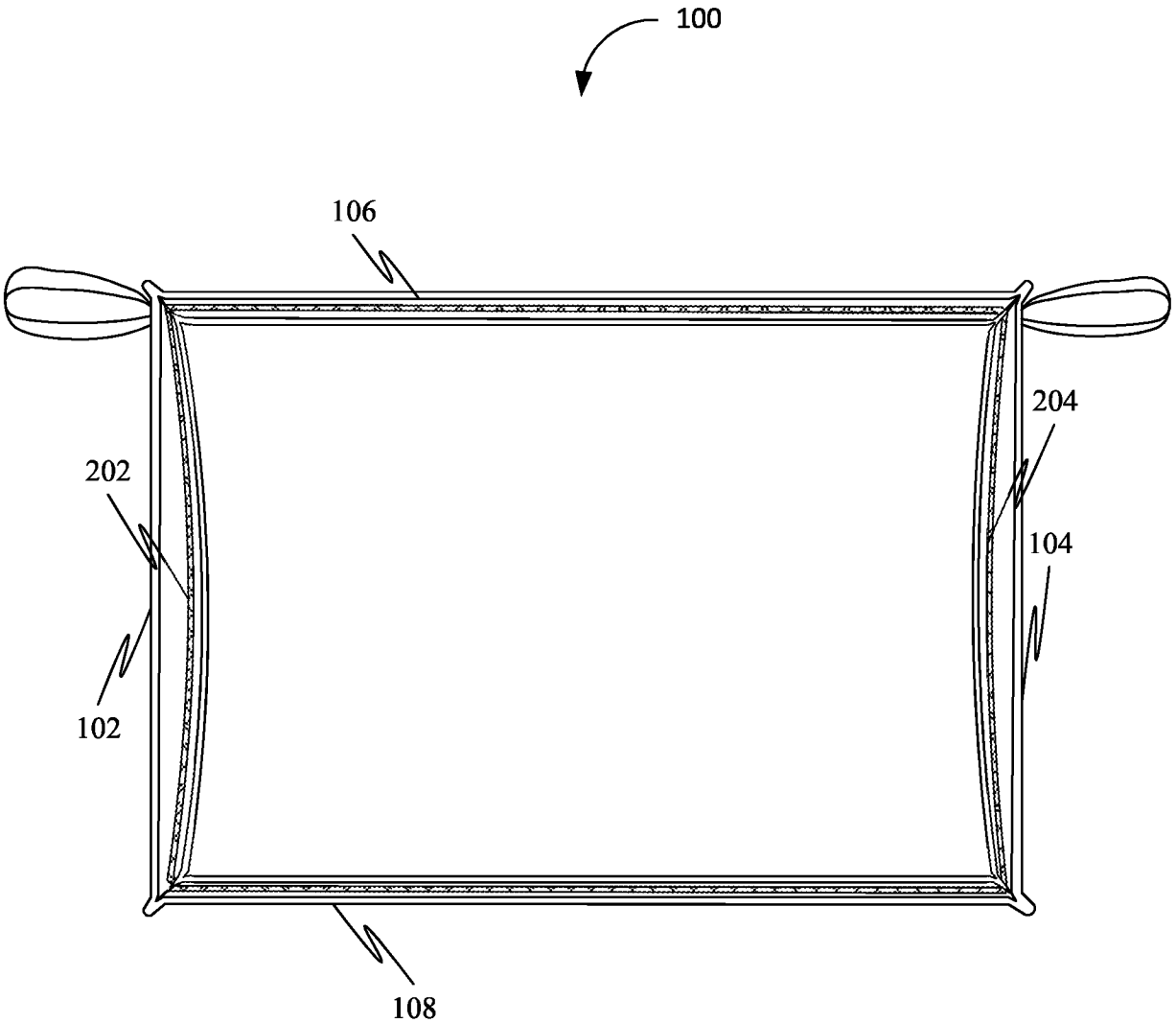
FIG. 2 is a top view of the collapsibly erectable bag showing an elastic component pair, in accordance with some embodiments.

FIG. 1 is a front top left side perspective view of a collapsibly erectable bag 100, in accordance with some embodiments. Accordingly, the collapsibly erectable bag 100 may include at least one panel and an elastic component pair 202-204, as shown in FIG. 2.

Further, the at least one panel may be configured for forming an interior space and an opening leading into the interior space. Further, the at least one panel may include a plurality of side panel pairs 102-108 and a bottom panel 110. Further, a side panel pair of the plurality of side panel pairs 102-108 may include oppositely facing panels.

Further, the elastic component pair 202-204, may be coupled to a primary side panel pair of the plurality of side panel pairs 102-108. Further, applying of a force on an elastic component of the elastic component pair 202-204 may be configured for moving the elastic component from an initial position to a final position collapsing a first primary side panel of the primary side panel pair. Further, the moving stores potential energy in the elastic component by deforming the elastic component. Further, withdrawing of the force converts the potential energy into kinetic energy by recovering the elastic member. Further, the recovering may be configured for moving the elastic component from the final position to the initial position erecting the first primary side panel.

Further, in some embodiments, at least one side panel pair of the plurality of side panel pairs 102-108 may be comprised in the elastic component pair 202-204.

Further, in some embodiments, the at least one panel may include at least one strap 112-114. Further, at least one strap may include a first strap end and a second strap end. Further, the first strap end and the second strap end are attached to the primary panel pair forming at least one strap loop.

Further, in some embodiments, the collapsibly erectable bag 100 may include a holding mechanism pair (not shown) disposed on a secondary side panel pair of the plurality of side panel pairs 102-108. Further, a holding mechanism of the holding mechanism pair may be configured for holding the first primary side panel in the final position post the collapsing of the first primary side panel.

Further, in some embodiments, the holding mechanism may include a first holding mechanism part and a second holding mechanism part. Further, the secondary side panel pair may be adjacent to the primary side panel pair. Further, the first holding mechanism part may be attached to a first secondary panel of the secondary panel pair and the second holding mechanism part may be attached to a second secondary panel of the secondary panel pair. Further, the first holding mechanism part may be detachably attachable to the second holding mechanism part facilitating the holding of the first primary side panel in the final position post the collapsing of the first primary side panel.

Figure 11:
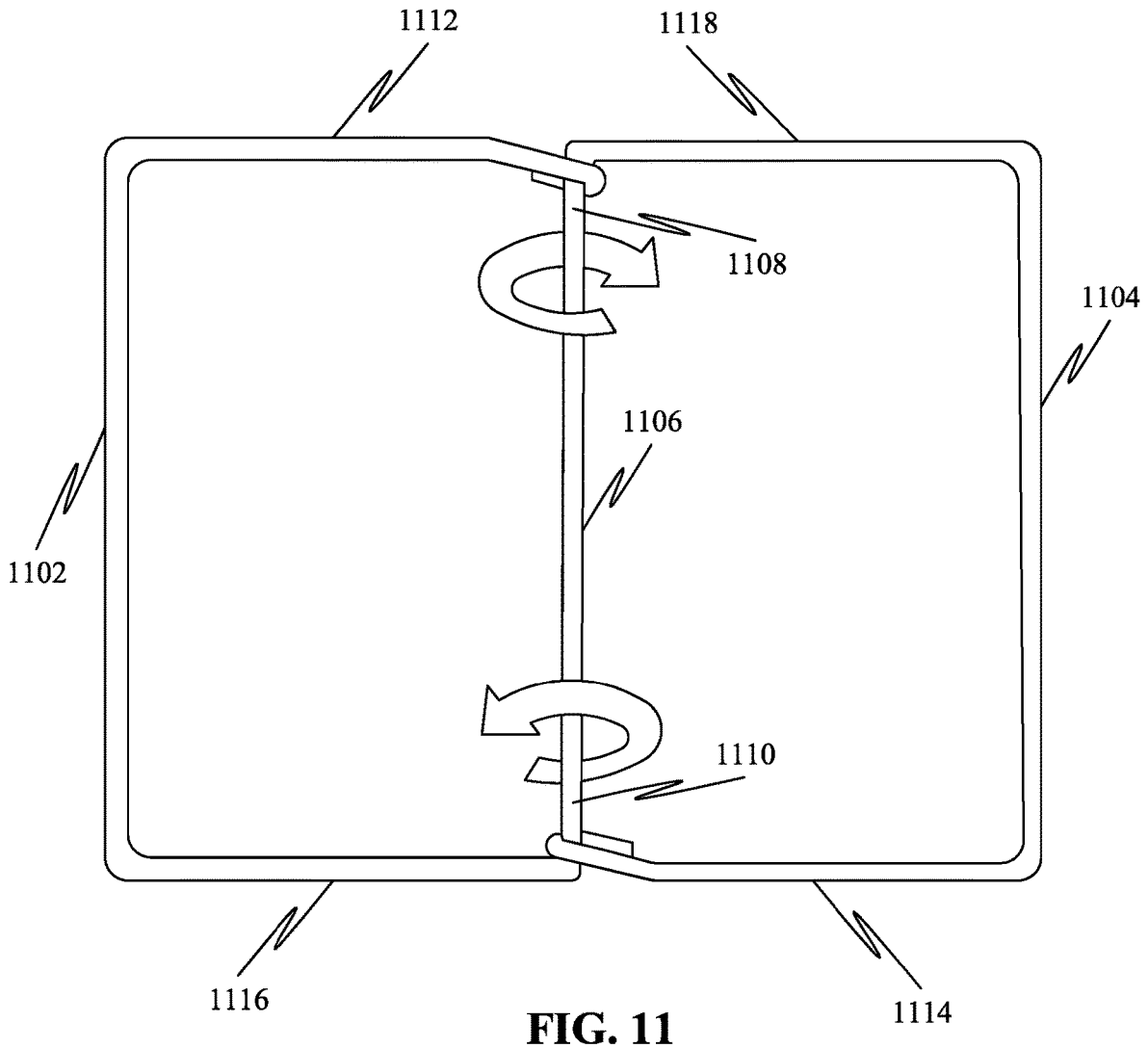
FIG. 11 is a front view of an elastic component in an open configuration, in accordance with some embodiments.

Further, in some embodiments, the elastic component may include a support member pair 1102-1104 and an elastic member 1106, as shown in FIG. 11. Further, the support member pair 1102-1104 may include a first support member and a second support member. Further, the elastic member 1106 may include a top elastic end 1108 and a bottom elastic end 1110 and each of the first support member and the second support member may include a top support end and a bottom support end. Further, a top support end 1112 of the first support member and a top support end 1114 of the second support member are rigidly coupled to the top elastic end 1108 and the bottom elastic end 1110 respectively. Further, the applying of the force on the first support member and the second support member may be configured for rotating the first support member and the second support around a longitudinal axis of the elastic member 1106 from the initial position to the final position collapsing the first primary side panel. Further, the rotation stores the potential energy in the elastic member 1106 by deforming the elastic member 1106. Further, the withdrawing of the force converts the potential energy into the kinetic energy by recovering the elastic member 1106. Further, the recovering may be configured for rotating the first support member and the second support member around the longitudinal axis from the final position to the initial position erecting the first primary side panel.

Further, in some embodiments, the first support member may be comprised in the top elastic end 1108 and the second support member may be comprised in the bottom elastic end 1110.

Further, in some embodiments, a bottom support end 1116 of the first support member and a bottom support end 1118 of the second support member are disposed off proximal to the bottom elastic end 1110 and the top elastic end 1108 respectively forming at least one member shape. Further, the at least one member shape may be configured for defining the interior space.

Further, in some embodiments, a bottom support end 1116 of the first support member and a bottom support end 1118 of the second support member may be rotatably coupled with the bottom elastic end 1110 and the top elastic end 1108 respectively using a rotatable coupling mechanism. Further, the rotatable coupling mechanism may be configured for facilitating the rotation of the first support member and the second support member in relation to the elastic member 1106.

Figure 16:
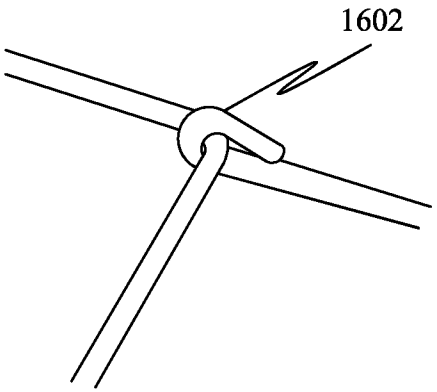
FIG. 16 is a perspective view of a teardrop loopover, in accordance with some embodiments.

Further, in some embodiments, the rotatable coupling mechanism may include a teardrop loop-over 1602, as shown in FIG. 16. Further, the teardrop loop-over 1602 may be comprised in the bottom support end of at least one of the first support member and the second support member. Further, the teardrop loop-over 1602 may include a loop-over interior space of a teardrop profile. Further, the loop-over interior space rotatably receives at least one of the bottom elastic end 1110 and the top elastic end 1108 for facilitating the rotation of the first support member and the second support member in relation to the elastic member 1106.

Figure 18:
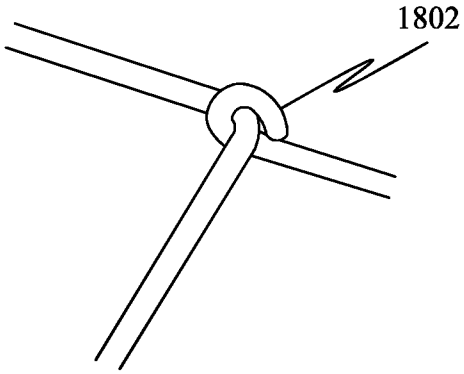
FIG. 18 is a perspective view of a circular loopover, in accordance with some embodiments.

Further, in some embodiments, the rotatable coupling mechanism may include a circular loop-over 1802, as shown in FIG. 18. Further, the circular loop-over 1802 may be comprised in the bottom support end of at least one of the first support member and the second support member. Further, the circular loop-over 1802 may include a loop-over interior space of a circular profile. Further, the loop-over interior space rotatably receives at least one of the bottom elastic end 1110 and the top elastic end 1108 for facilitating the rotation of the first support member and the second support member in relation to the elastic member 1106.

Figure 20:
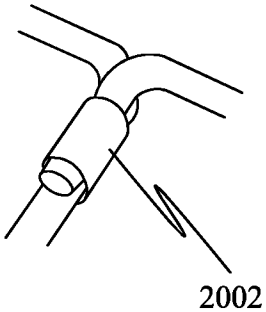
FIG. 20 is a perspective view of at least one clamp, in accordance with some embodiments.

Further, in some embodiments, the rotatable coupling mechanism may include at least one clamp 2002, as shown in FIG. 20, disposed on the elastic member 1106 proximal to at least one of the bottom elastic end 1110 and the top elastic end 1102. Further, a clamp of the at least one clamp 2002 may include a clamp interior space. Further, the clamp may be configured for rotatably receiving the bottom support end of at least one of the first support member and the second support member for facilitating the rotation of the first support member and the second support member in relation to the elastic member 1106.

Further, in some embodiments, at least one side panel pair of the plurality of side panel pairs 102-108 and the bottom panel 110 pair may include at least one rigid material. Further, the at least one rigid material may be configured for providing structural integrity to the collapsibly erectable bag 100.

Further, in some embodiments, the at least one panel may include a top panel (not shown). Further, the top panel may be detachably couplable with the opening. Further, the top panel may be associated with at least one open state and a closed state. Further, the top panel may provide access to the interior space in the at least one open state. Further, the top panel does not provide access to the interior space in the closed state.

Figure 9:
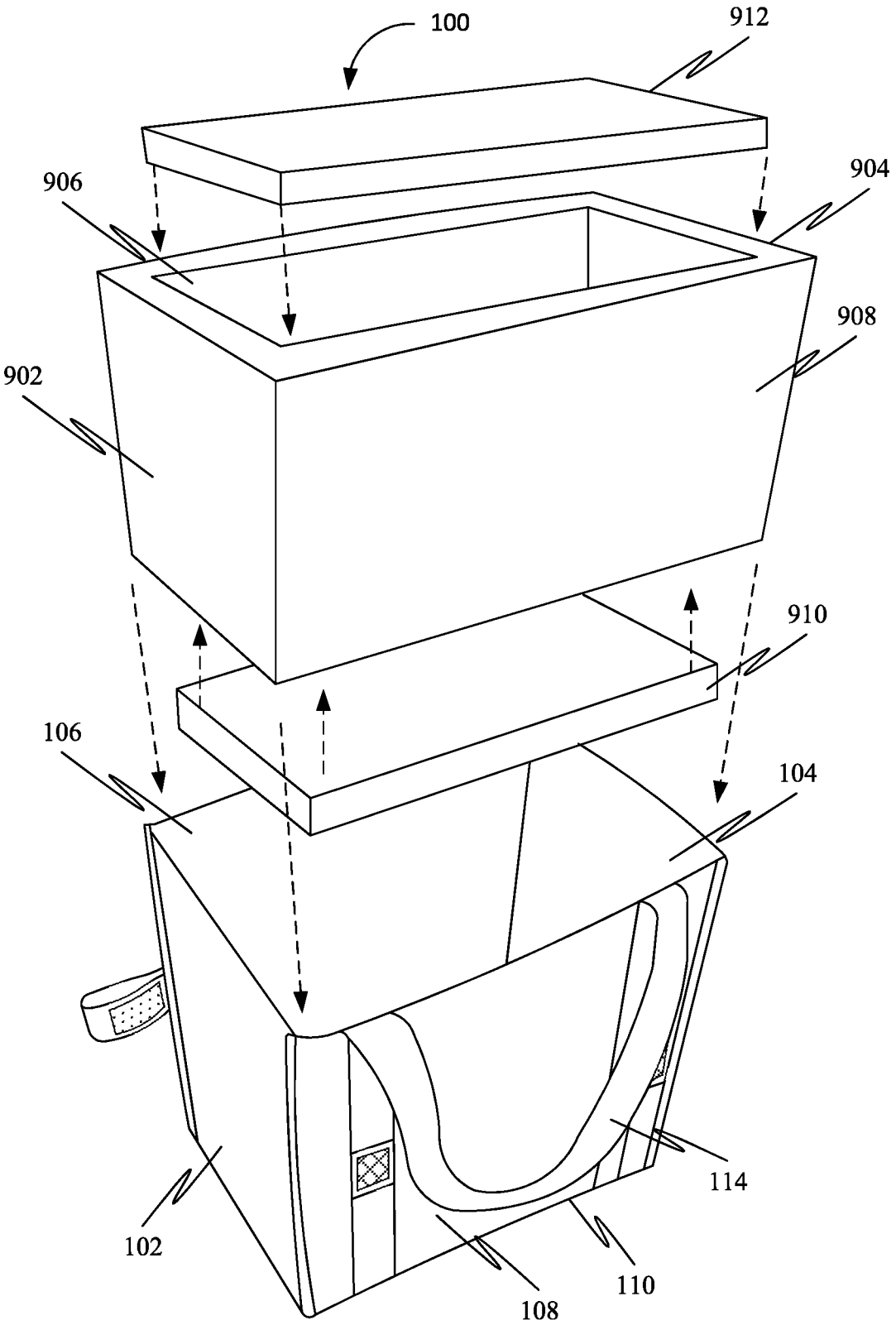
FIG. 9 is an exploded view of the collapsibly erectable bag, in accordance with some embodiments.

Further, in some embodiments, the collapsibly erectable bag 100 may include a plurality of side insulating panel pairs 902-908 corresponding to the plurality of side panel pairs 102-108, a bottom insulating panel 910 corresponding to the bottom panel 110, and a top insulating panel 912, as shown in FIG. 9. Further, the plurality of side insulating panel pairs 902-908 are disposed alongside the plurality of side panel pairs 102-108, the bottom insulating panel 910 may be disposed alongside the bottom panel 110 forming an insulated interior space. Further, the interior space may include the insulating interior space. Further, the top insulating panel 912 may be configured for covering the opening. Further, in some embodiments, the plurality of side insulating panel pairs 902-908 may be detachably coupled to the bottom insulating panel 910 and the top insulating panel 912.

Figure 10:
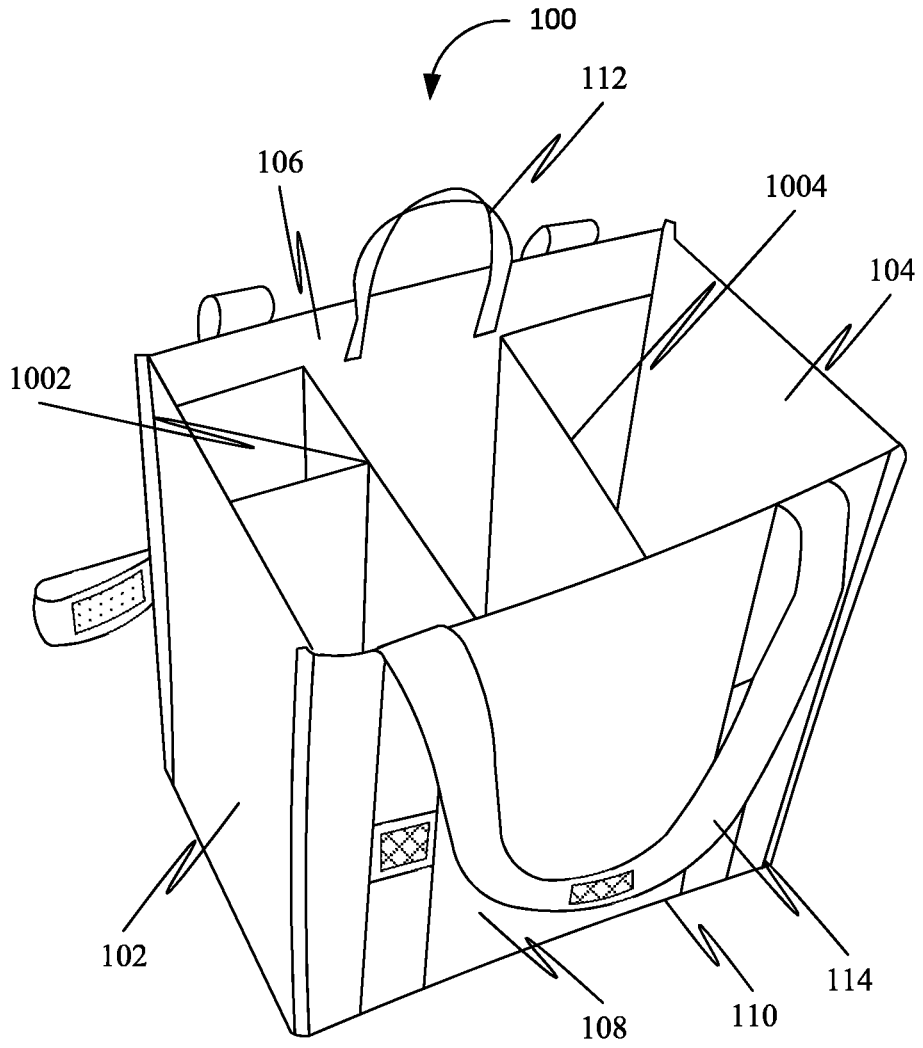
FIG. 10 is a top perspective view of the collapsibly erectable bag showing separate compartments, in accordance with some embodiments.

Further, in some embodiments, the at least one panel may include at least one compartment panel 1002-1004, as shown in FIG. 10, attached to at least one interior surface of at least one side panel pair of the plurality of side panel pairs 102-108 forming at least one compartment interior space and at least one compartment opening leading into the at least one compartment interior space. Further, the interior space may include the at least one compartment interior space.

Further, in some embodiments, the at least one panel may include at least one compartment panel 602 attached to at least one exterior surface of at least one side panel pair of the plurality of side panel pairs 102-108 forming at least one compartment exterior space and at least one compartment opening leading into the at least one compartment exterior space. Further, the interior space does not include the at least one compartment exterior space.

FIG. 2 is a top view of the collapsibly erectable bag 100 showing the elastic component pair 202-204, in accordance with some embodiments.

Figure 3:
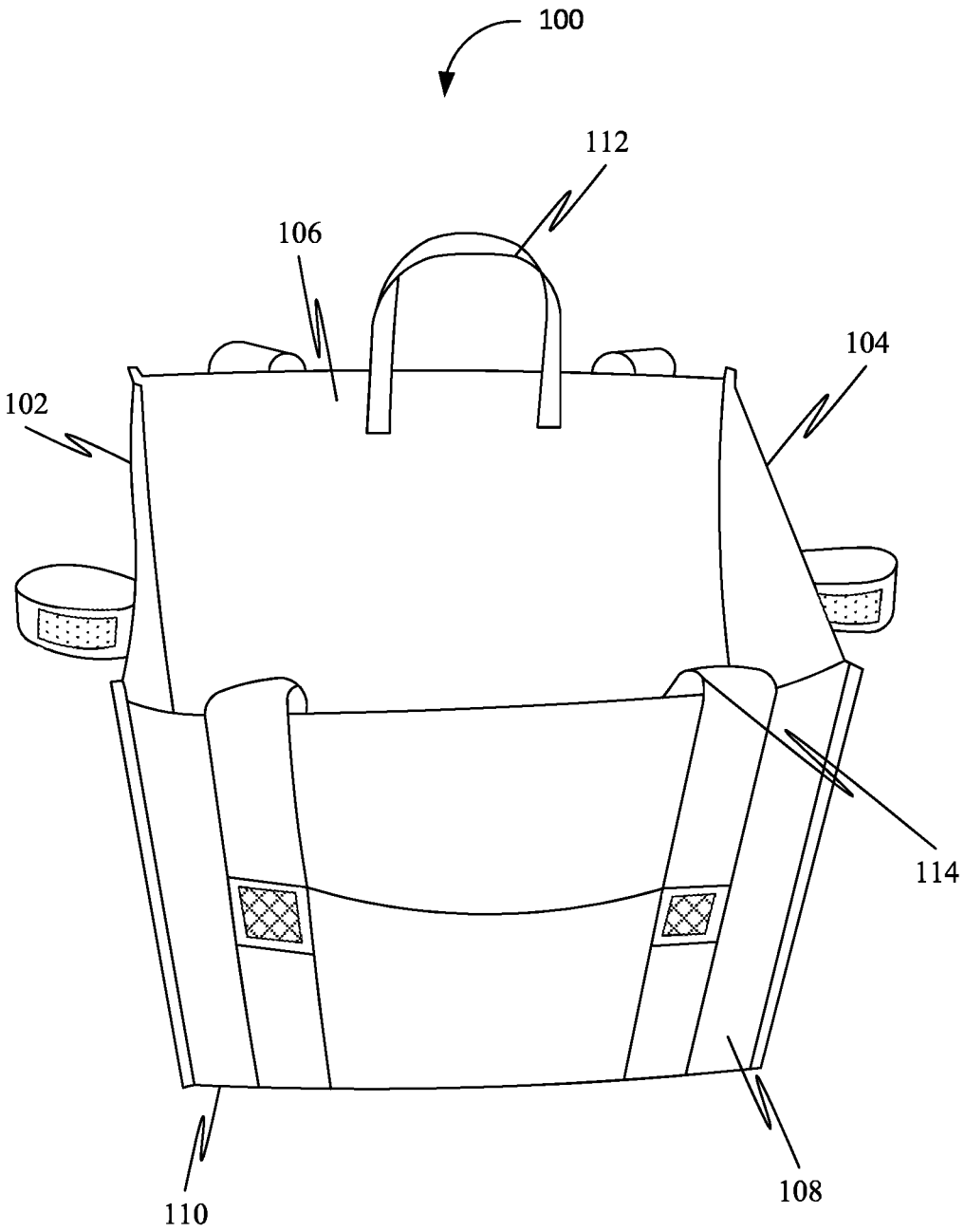
FIG. 3 is a front top perspective view of the collapsibly erectable bag, in accordance with some embodiments.

FIG. 3 is a front top perspective view of the collapsibly erectable bag 100, in accordance with some embodiments.

Figure 4:
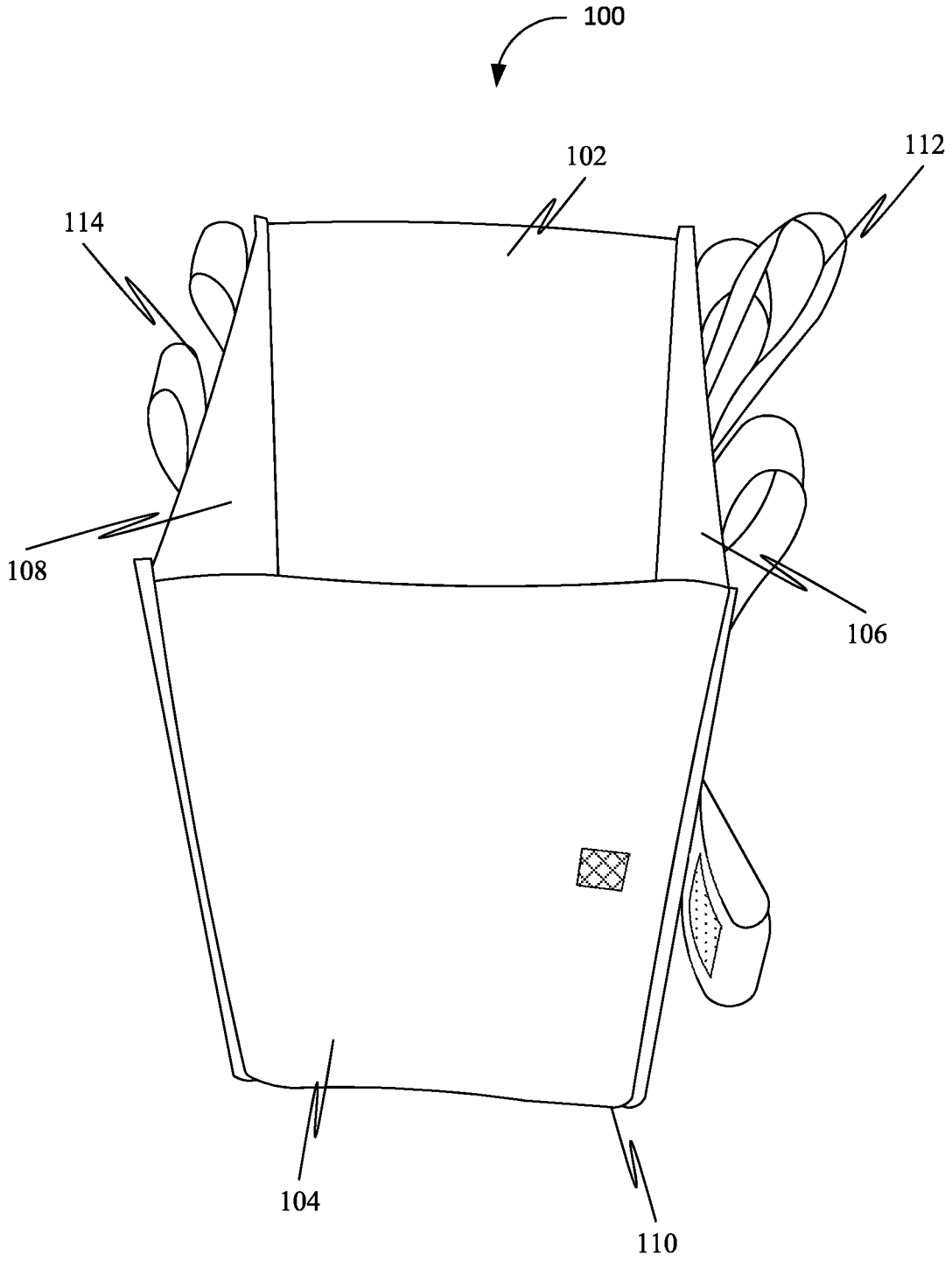
FIG. 4 is a right side perspective view of the collapsibly erectable bag, in accordance with some embodiments.

FIG. 4 is a right side perspective view of the collapsibly erectable bag 100, in accordance with some embodiments.

Figure 5:
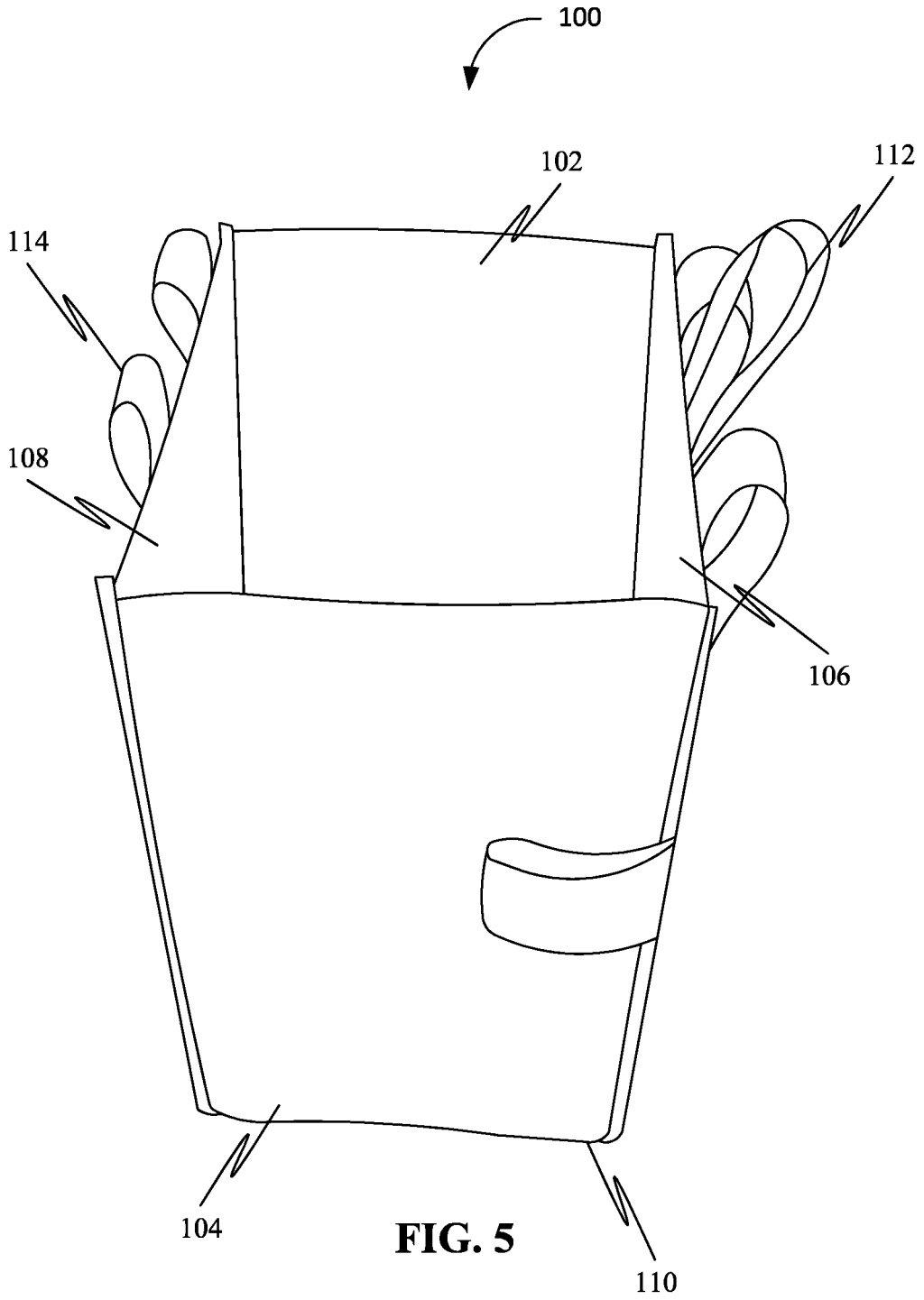
FIG. 5 is a right side perspective view of the collapsibly erectable bag, in accordance with some embodiments.

FIG. 5 is a right side perspective view of the collapsibly erectable bag 100, in accordance with some embodiments.

Figure 6:
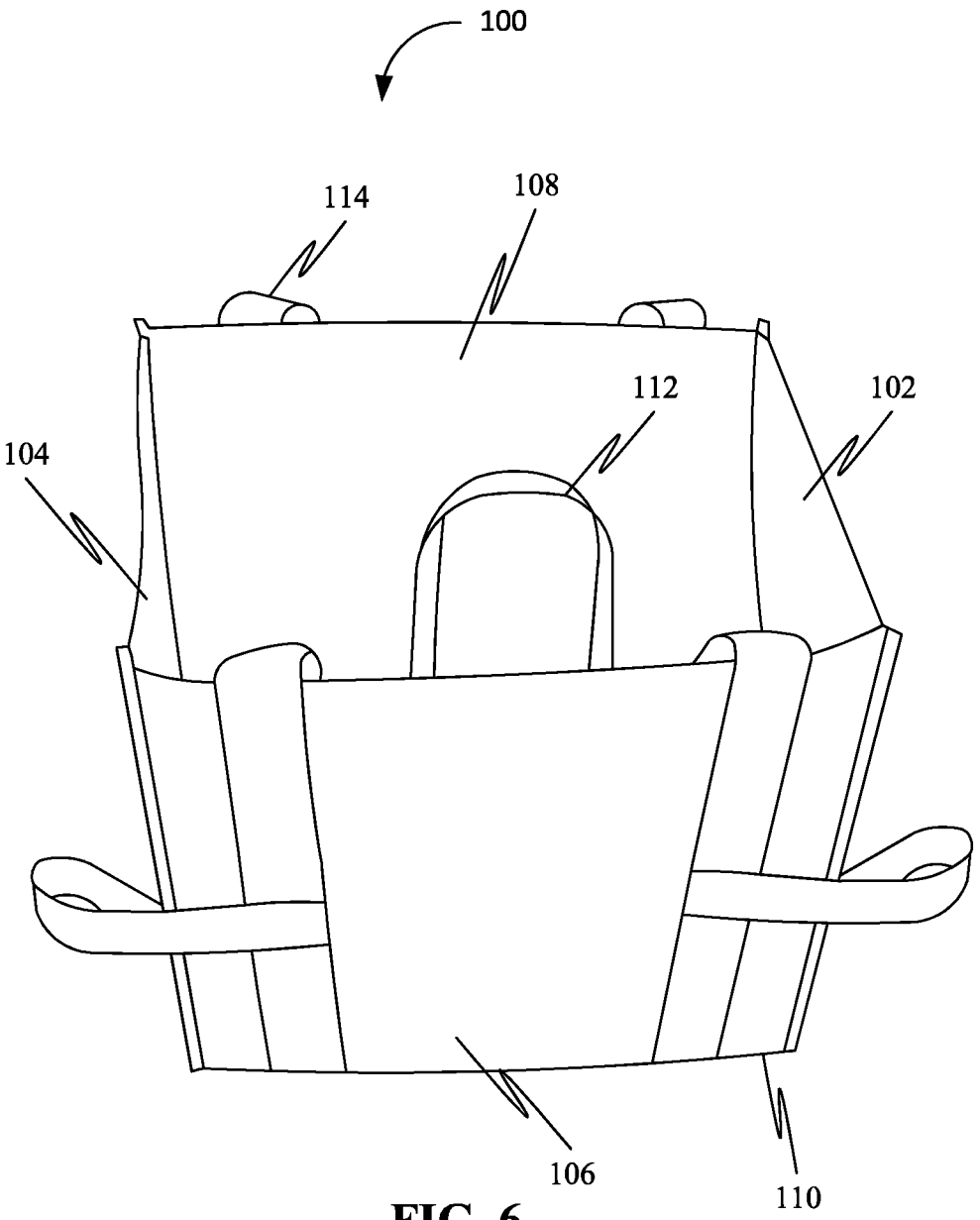
FIG. 6 is a rear top perspective view of the collapsibly erectable bag, in accordance with some embodiments.

FIG. 6 is a rear top perspective view of the collapsibly erectable bag 100, in accordance with some embodiments.

Figure 7:
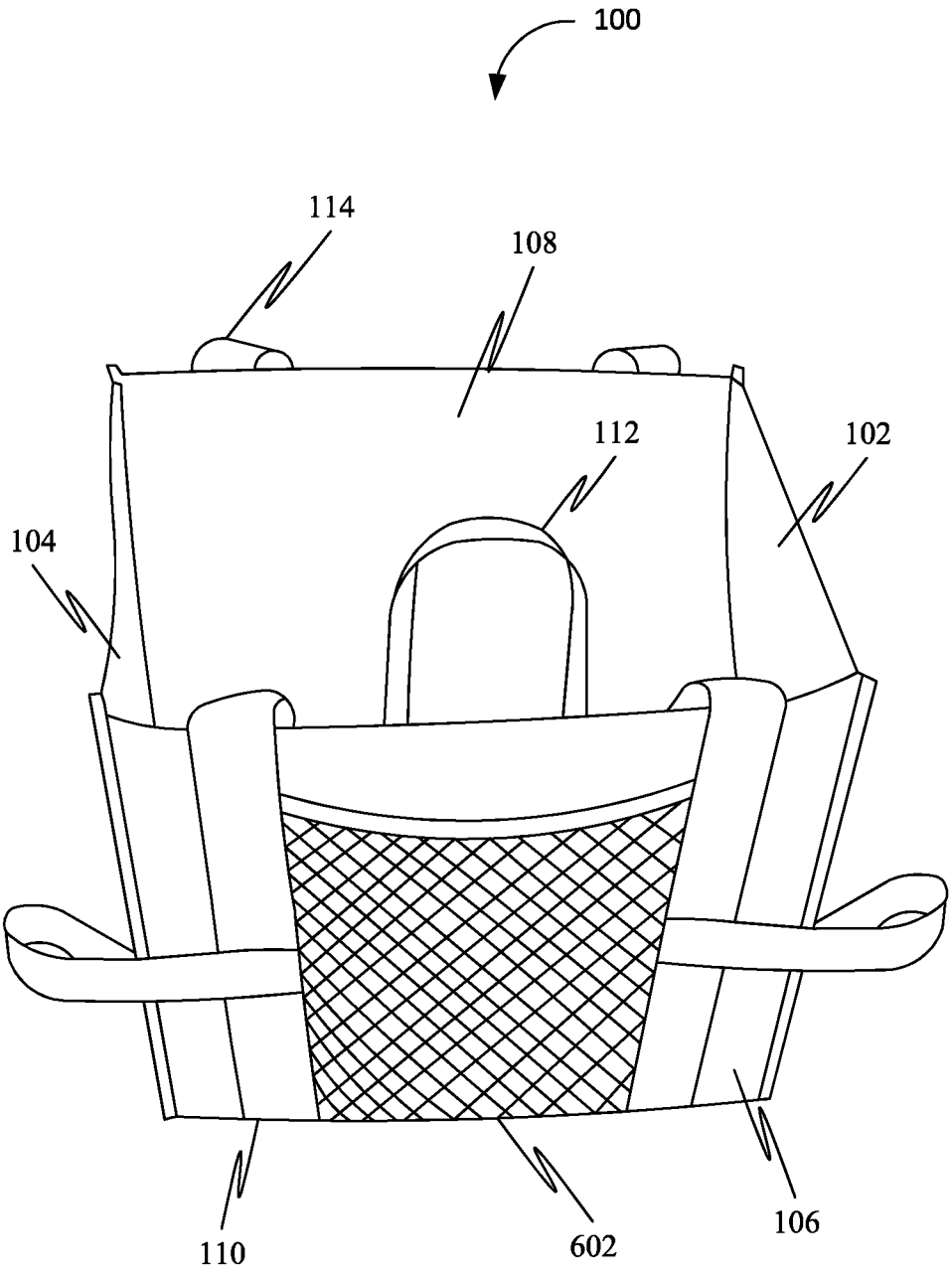
FIG. 7 is a rear top perspective view of the collapsibly erectable bag with an expandable mesh compartment, in accordance with some embodiments.

FIG. 7 is a rear top perspective view of the collapsibly erectable bag 100 with an expandable mesh compartment, in accordance with some embodiments.

Figure 8:
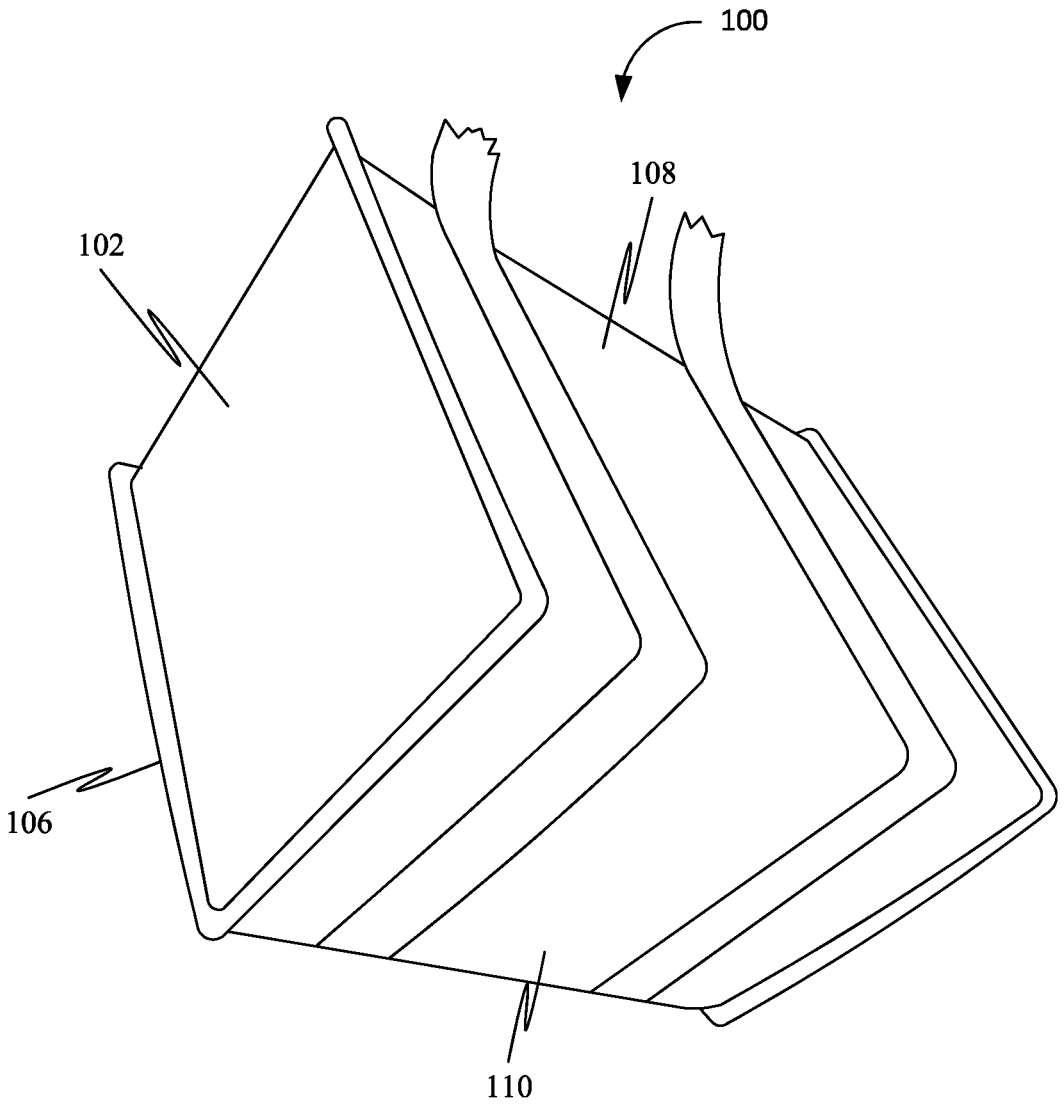
FIG. 8 is a bottom perspective view of the collapsibly erectable bag carrying straps, in accordance with some embodiments.

FIG. 8 is a bottom perspective view of the collapsibly erectable bag 100 carrying straps, in accordance with some embodiments.

FIG. 9 is an exploded view of the collapsibly erectable bag 100, in accordance with some embodiments.

FIG. 10 is a top perspective view of the collapsibly erectable bag 100 showing separate compartments, in accordance with some embodiments.

FIG. 11 is a front view of an elastic component in an open configuration, in accordance with some embodiments. Further, the applying of the force on the first support member and the second support member may be configured for rotating the first support member and the second support around a longitudinal axis of the elastic member 1106 from the initial position to the final position collapsing the first primary side panel. Further, the rotation stores the potential energy in the elastic member 1106 by deforming the elastic member 1106. Further, the withdrawing of the force converts the potential energy into the kinetic energy by recovering the elastic member 1106. Further, the recovering may be configured for rotating the first support member and the second support member around the longitudinal axis from the final position to the initial position erecting the first primary side panel.

Figure 12:
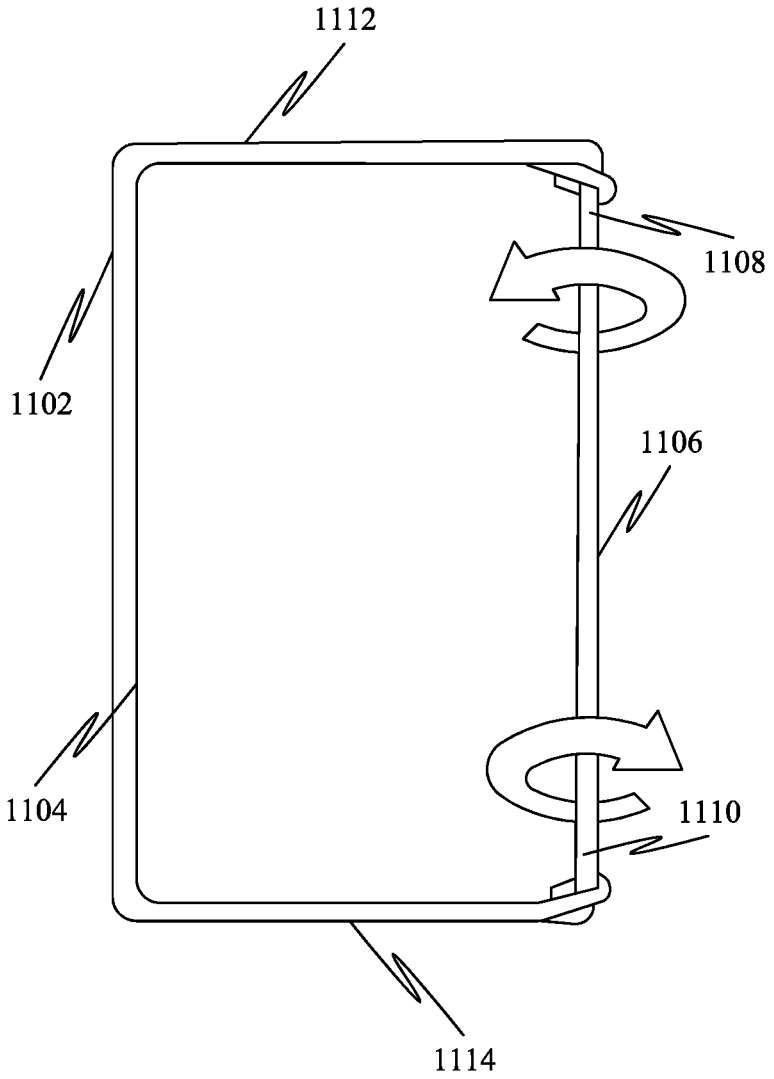
FIG. 12 is a front view of the elastic component in a closed configuration, in accordance with some embodiments.

FIG. 12 is a front view of the elastic component in a closed configuration, in accordance with some embodiments.

Figure 13:
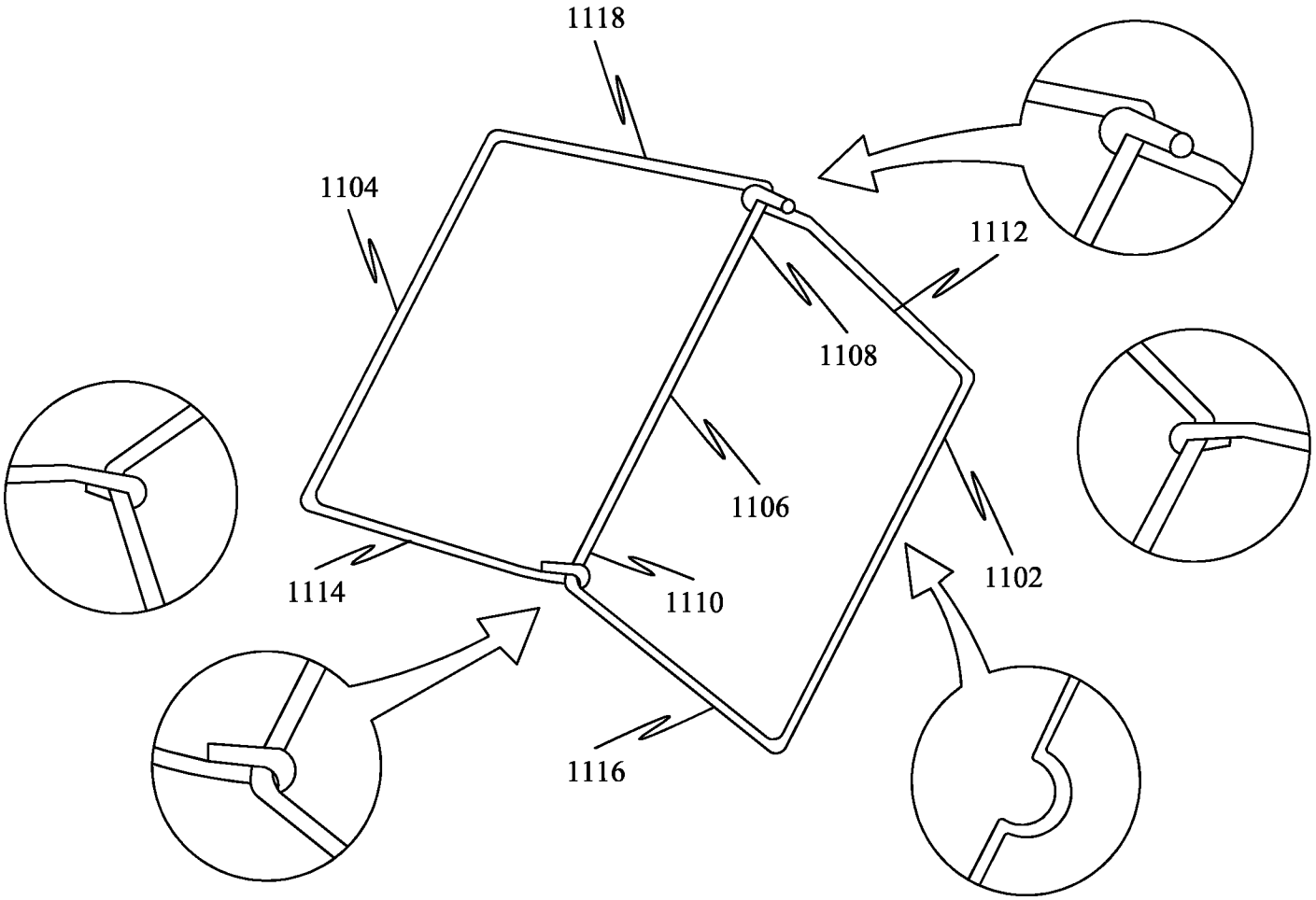
FIG. 13 is a perspective view of the elastic component in a partially open configuration, in accordance with some embodiments.

FIG. 13 is a perspective view of the elastic component in a partially open configuration, in accordance with some embodiments.

Figure 14:
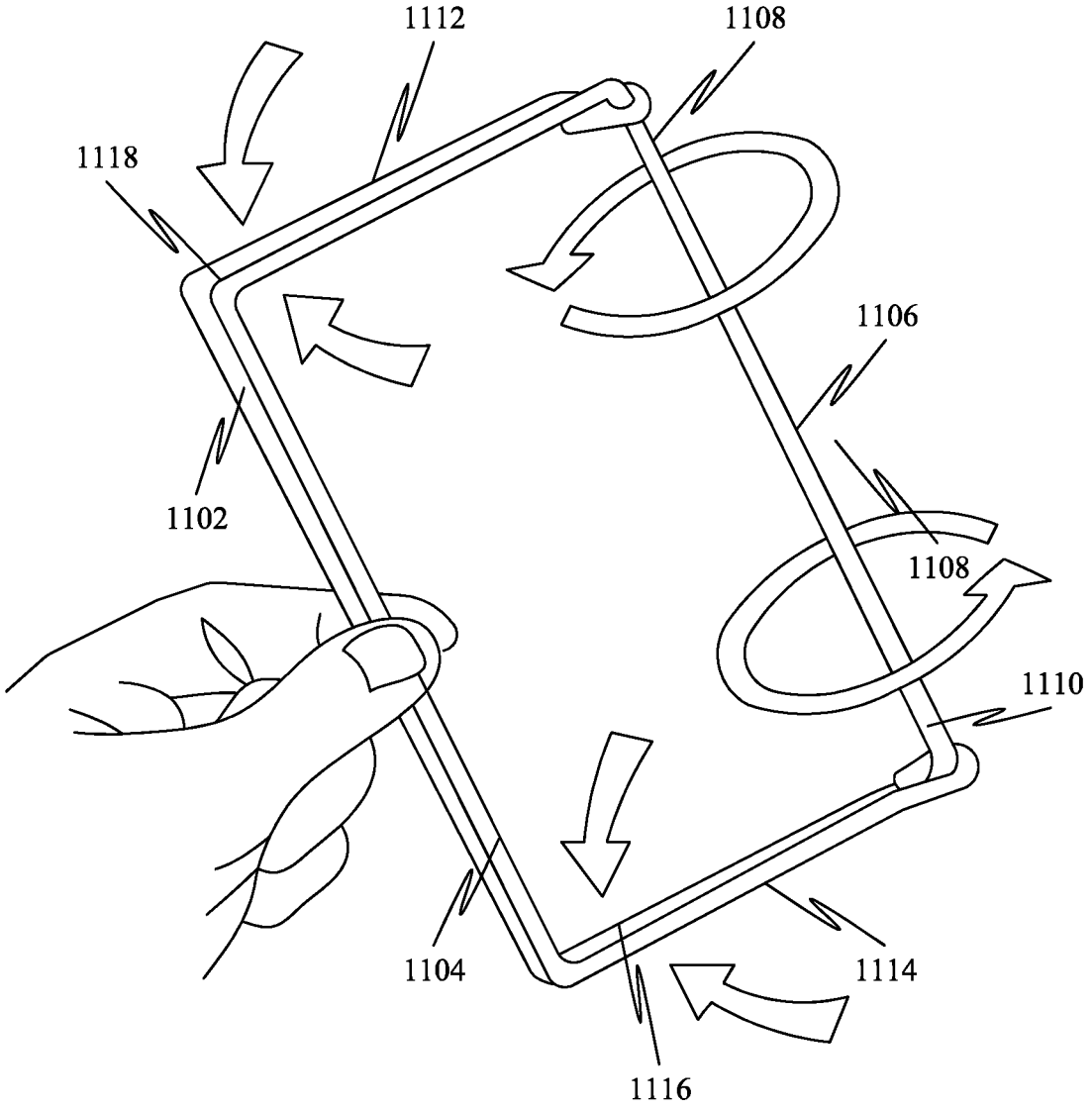
FIG. 14 is a perspective view of the elastic component in the closed configuration, in accordance with some embodiments.

FIG. 14 is a perspective view of the elastic component in the closed configuration, in accordance with some embodiments.

Figure 15:
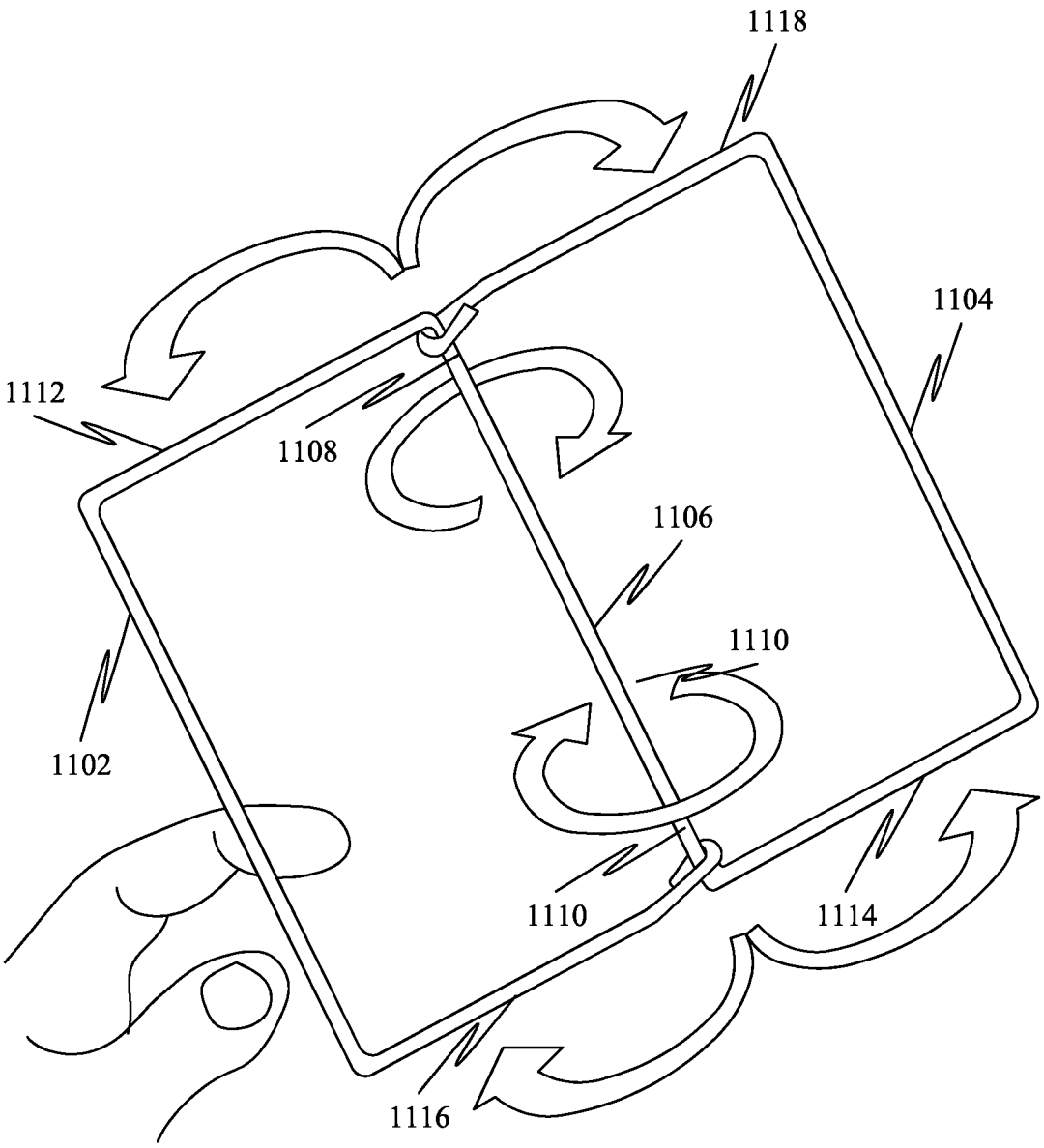
FIG. 15 is a front view of the elastic component in the open configuration, in accordance with some embodiments.

FIG. 15 is a front view of the elastic component in the open configuration, in accordance with some embodiments.

FIG. 16 is a perspective view of a teardrop loopover 1602, in accordance with some embodiments.

Figure 17:
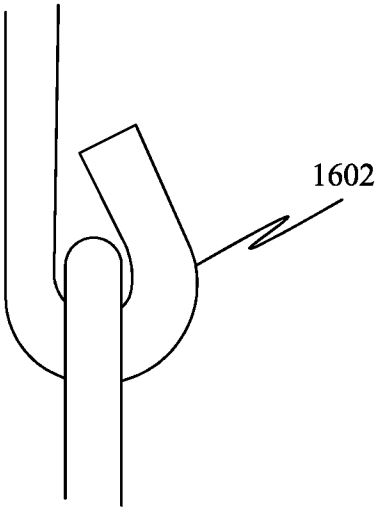
FIG. 17 is a side view of the teardrop loopover, in accordance with some embodiments.

FIG. 17 is a side view of the teardrop loopover 1602, in accordance with some embodiments.

FIG. 18 is a perspective view of a circular loopover 1802, in accordance with some embodiments.

Figure 19:
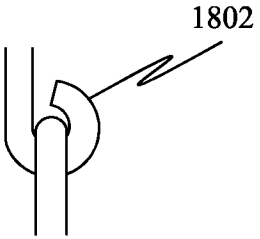
FIG. 19 is a perspective view of the circular loopover, in accordance with some embodiments.

FIG. 19 is a perspective view of the circular loopover 1802, in accordance with some embodiments.

FIG. 20 is a perspective view of at least one clamp 2002, in accordance with some embodiments.

Figure 21:
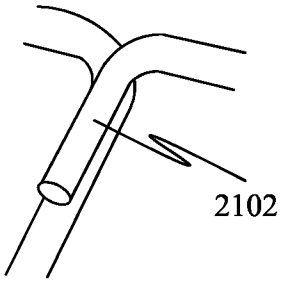
FIG. 21 is a schematic showing edge to edge attachment, in accordance with some embodiments.

FIG. 21 is a schematic showing edge to edge attachment 2102 of a support member pair, in accordance with some embodiments.

Figure 22:
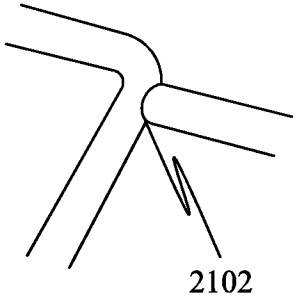
FIG. 22 is a schematic showing tip attachment of a support member pair, in accordance with some embodiments.

FIG. 22 is a schematic showing tip attachment 2202 of a support member pair, in accordance with some embodiments.

Figure 23:
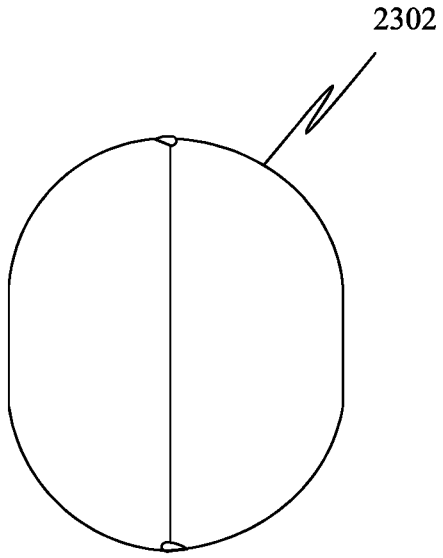
FIG. 23 is a schematic showing an elastic component, in accordance with some embodiments.

FIG. 23 is a schematic showing an elastic component 2302, in accordance with some embodiments.

Figure 24:
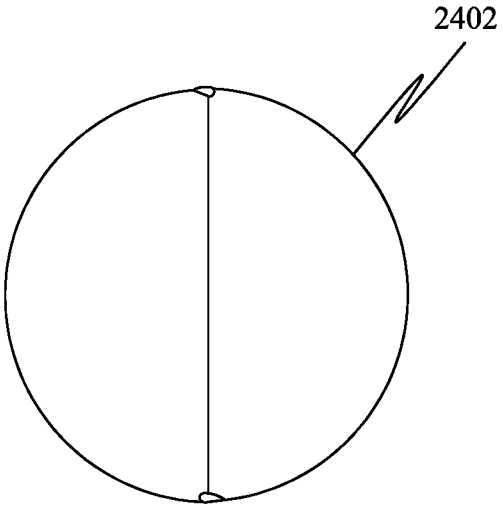
FIG. 24 is a schematic showing an elastic component, in accordance with some embodiments.

FIG. 24 is a schematic showing an elastic component 2402, in accordance with some embodiments.

Figure 25:
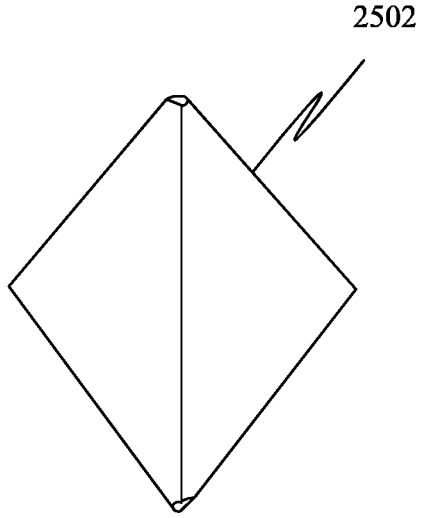
FIG. 25 is a schematic showing an elastic component, in accordance with some embodiments.

FIG. 25 is a schematic showing an elastic component 2502, in accordance with some embodiments.

Figure 26:
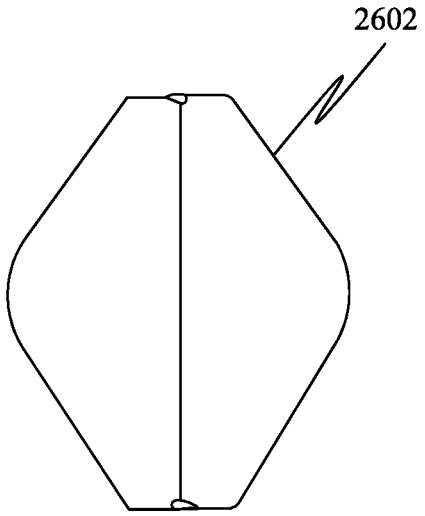
FIG. 26 is a schematic showing an elastic component, in accordance with some embodiments.

FIG. 26 is a schematic showing an elastic component 2602, in accordance with some embodiments.

Figure 27:
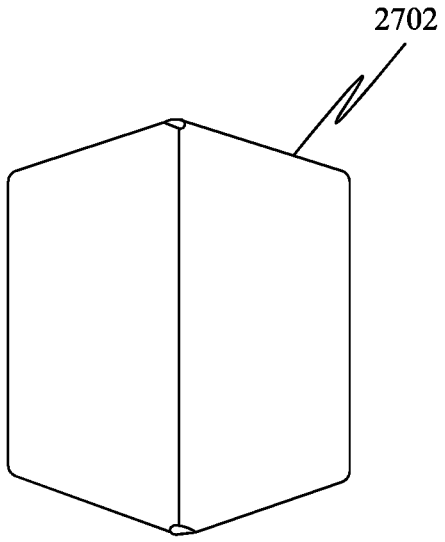
FIG. 27 is a schematic showing an elastic component, in accordance with some embodiments.

FIG. 27 is a schematic showing an elastic component 2702, in accordance with some embodiments.

Figure 28:
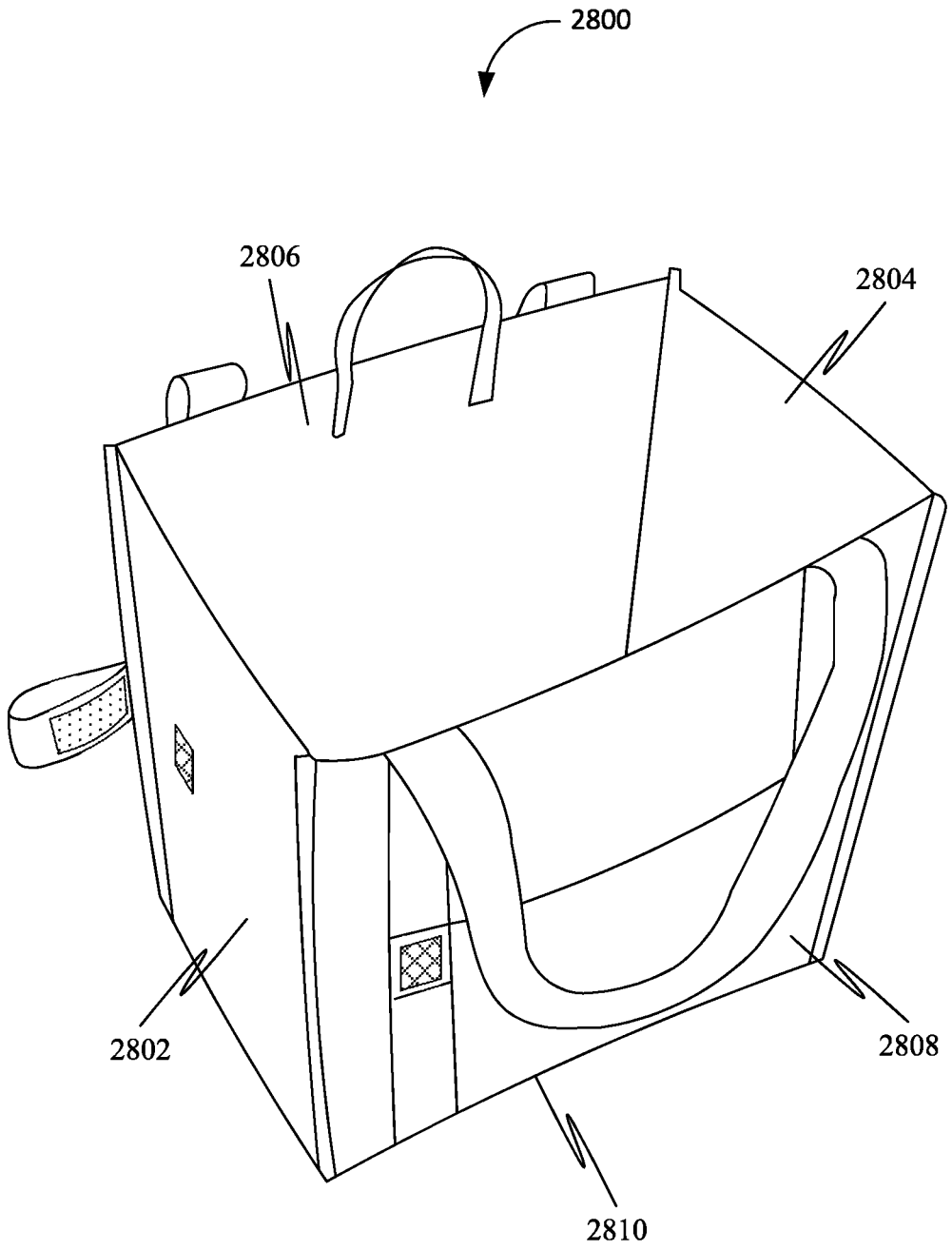
FIG. 28 is a front top left side perspective view of a collapsibly erectable bag, in accordance with some embodiments.
Figure 29:
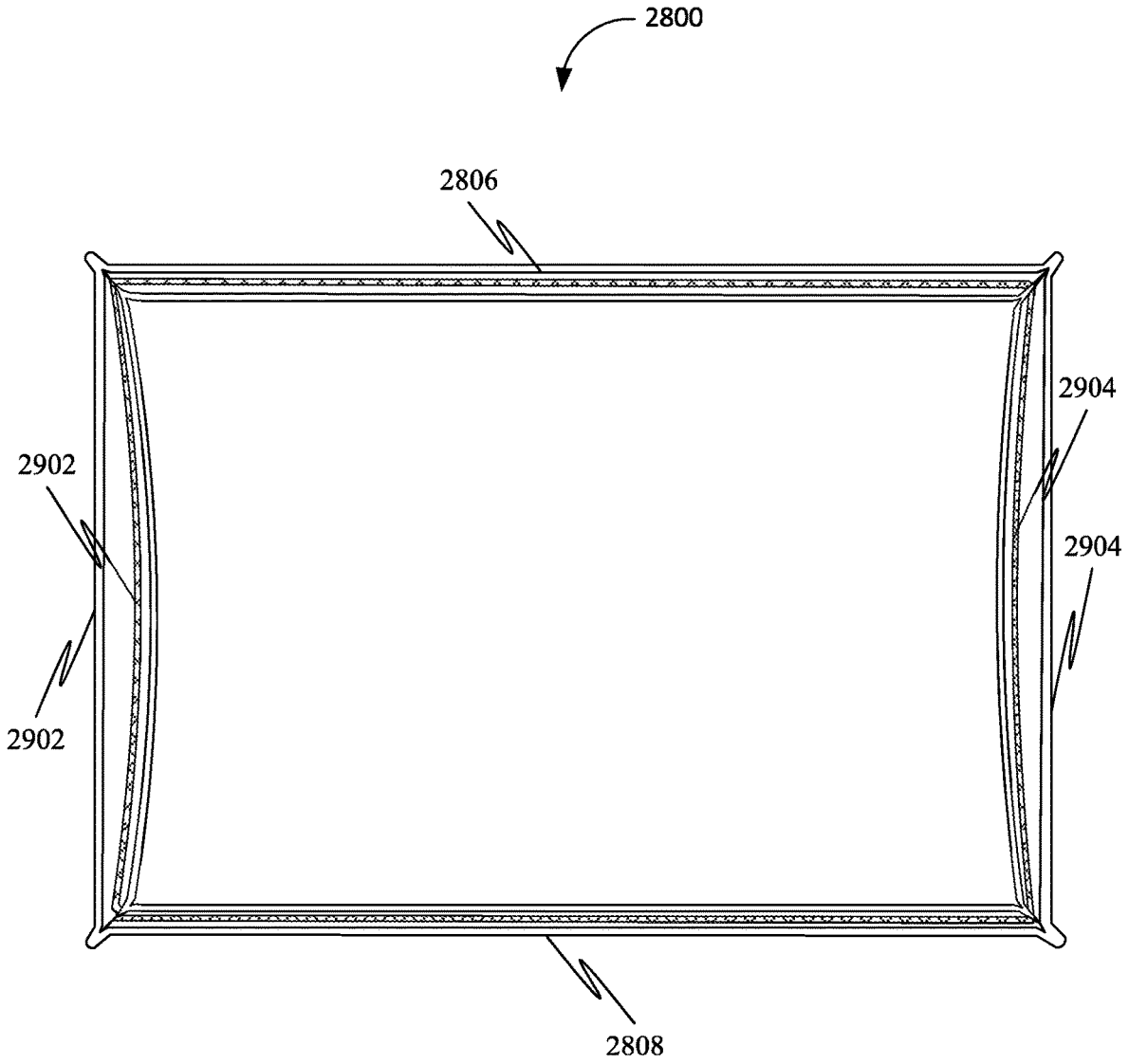
FIG. 29 is a top view of the collapsibly erectable bag showing an elastic component pair, in accordance with some embodiments.

FIG. 28 is a front top left side perspective view of a collapsibly erectable bag 2800, in accordance with some embodiments. Accordingly, the collapsibly erectable bag may include at least one panel and an elastic component pair 2902-2904, as shown in FIG. 29.

Further, the at least one panel may be configured for forming an interior space and an opening leading into interior space. Further, the at least one panel may include a plurality of side panel pairs 2802-2808 and a bottom panel 2810. Further, a side panel pair of the plurality of side panel pairs may include oppositely facing panels.

Further, the elastic component pair 2902-2904 may be coupled to a primary side panel pair of the plurality of side panel pairs. Further, applying of a force on an elastic component of the elastic component pair 2902-2904 may be configured for moving the elastic component from an initial position to a final position collapsing a first primary side panel of the primary side panel pair. Further, the moving stores potential energy in the elastic component by deforming the elastic component. Further, withdrawing of the force converts the potential energy into kinetic energy by recovering the elastic member. Further, the recovering may be configured for moving the elastic component from the final position to the initial position erecting the first primary side panel. Further, the elastic component may include a support member pair 3002-3004 and an elastic member 3006. Further, the support member pair 3002-3004 may include a first support member and a second support member. Further, the elastic member 3006 may include a top elastic end 3008 and a bottom elastic end 3010 and each of the first support member and the second support member may include a top support end and a bottom support end. Further, a top support end 3012 of the first support member and a top support end 3014 of the second support member is rigidly coupled to the top elastic end 3008 and the bottom elastic end 3010 respectively. Further, the applying of the force on the first support member and the second support member may be configured for rotating the first support member and the second support around a longitudinal axis of the elastic member 3006 from the initial position to the final position collapsing the first primary side panel. Further, the rotation stores the potential energy in the elastic member 3006 by deforming the elastic member 3006. Further, the withdrawing of the force converts the potential energy into the kinetic energy by recovering the elastic member 3006. Further, the recovering may be configured for rotating the first support member and the second support around the longitudinal axis from the final position to the initial position erecting the first primary side panel.

Further, in some embodiments, a bottom support end 3016 of the first support member and a bottom support end 3018 of the second support member are disposed off proximal to the bottom elastic end 3010 and the top elastic end 3008 respectively forming at least one member shape. Further, the at least one member shape may be configured for defining the interior space.

FIG. 29 is a top view of the collapsibly erectable bag 2800 showing an elastic component pair 2902-2904, in accordance with some embodiments.

Figure 30:
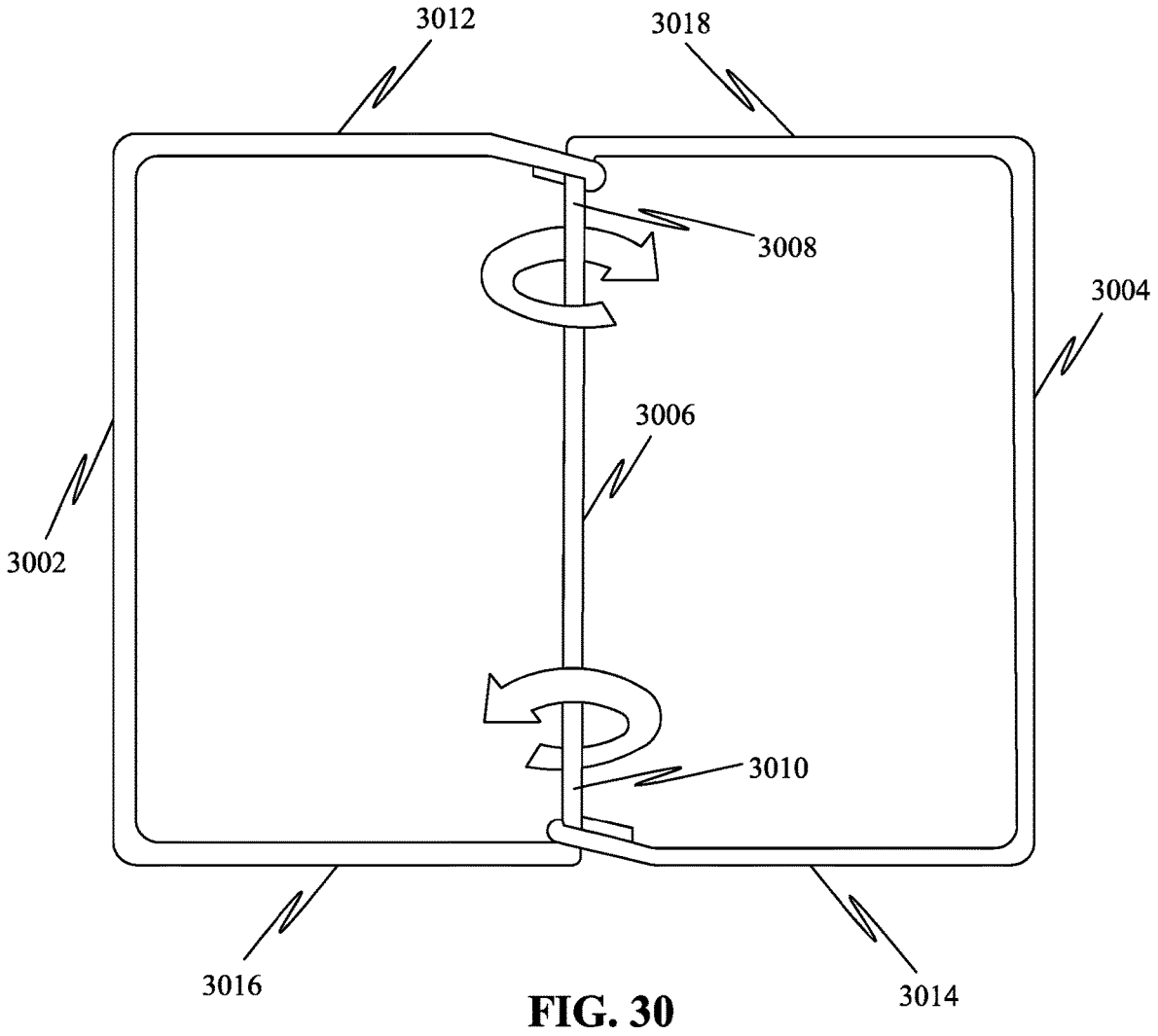
FIG. 30 is a front view of an elastic component in an open configuration, in accordance with some embodiments.

FIG. 30 is a front view of an elastic component in an open configuration, in accordance with some embodiments.

Figure 31:
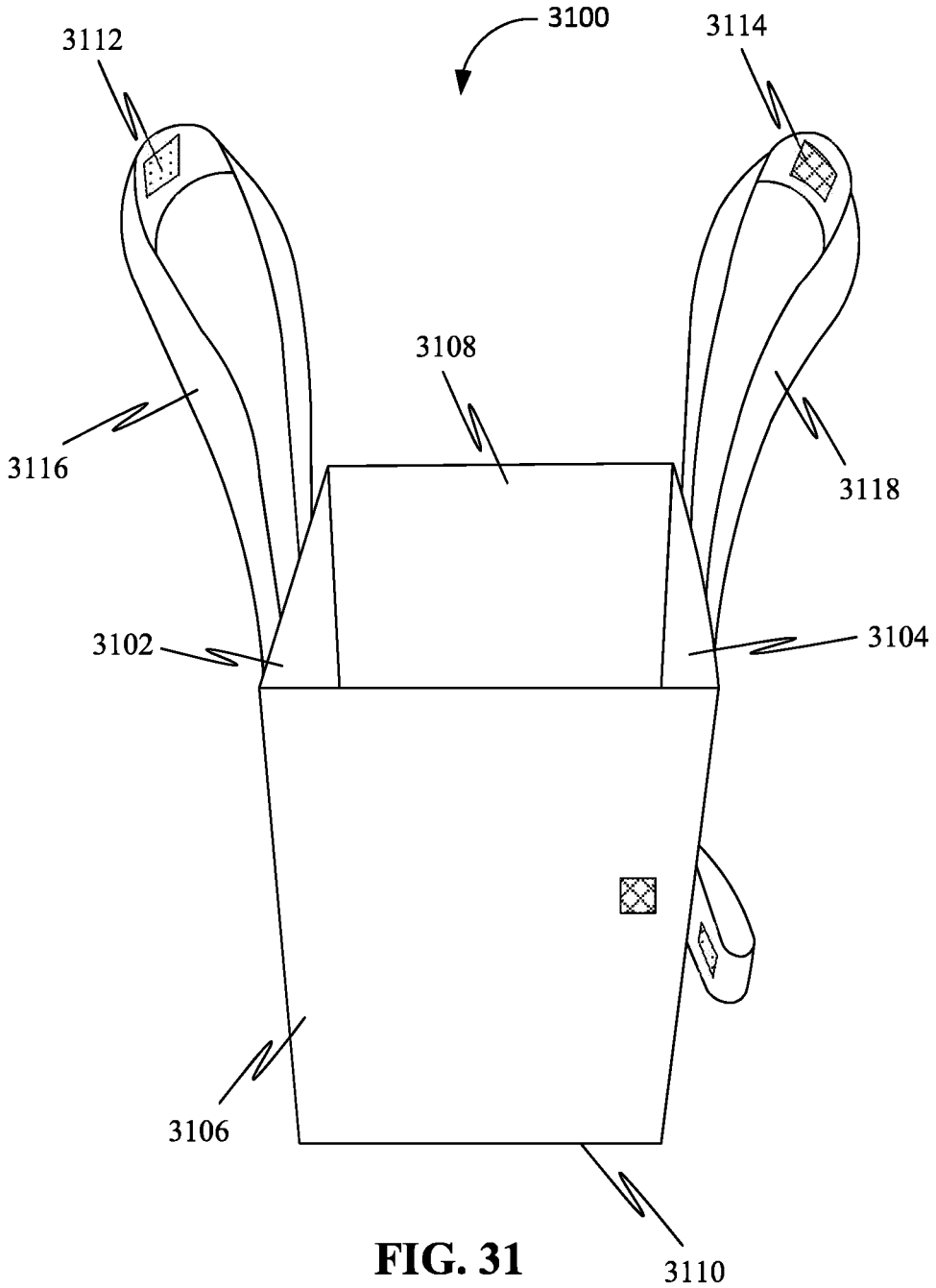
FIG. 31 is a side perspective view of a collapsibly erectable bag, in accordance with some embodiments.

FIG. 31 is a side perspective view of a collapsibly erectable bag 3100, in accordance with some embodiments. Further, the collapsibly erectable bag 3100 may include at least one panel and an elastic component pair. Further, the at least one panel may be configured for forming an interior space and an opening leading into the interior space. Further, the at least one panel may include a plurality of side panel pairs 3102-3108 and a bottom panel 3110. Further, a side panel pair of the plurality of side panel pairs 3102-3108 may include oppositely facing panels. Further, the elastic component pair may be coupled to a primary side panel pair of the plurality of side panel pairs 3102-3108. Further, applying of a force on an elastic component of the elastic component pair may be configured for moving the elastic component from an initial position to a final position collapsing a first primary side panel of the primary side panel pair. Further, the moving stores potential energy in the elastic component by deforming the elastic component. Further, withdrawing of the force converts the potential energy into kinetic energy by recovering the elastic member. Further, the recovering may be configured for moving the elastic component from the final position to the initial position erecting the first primary side panel. Further, the collapsibly erectable bag 3100 may include Velcro fasteners 3112-3114 disposed on at least one strap 3116-3118.

Figure 32:
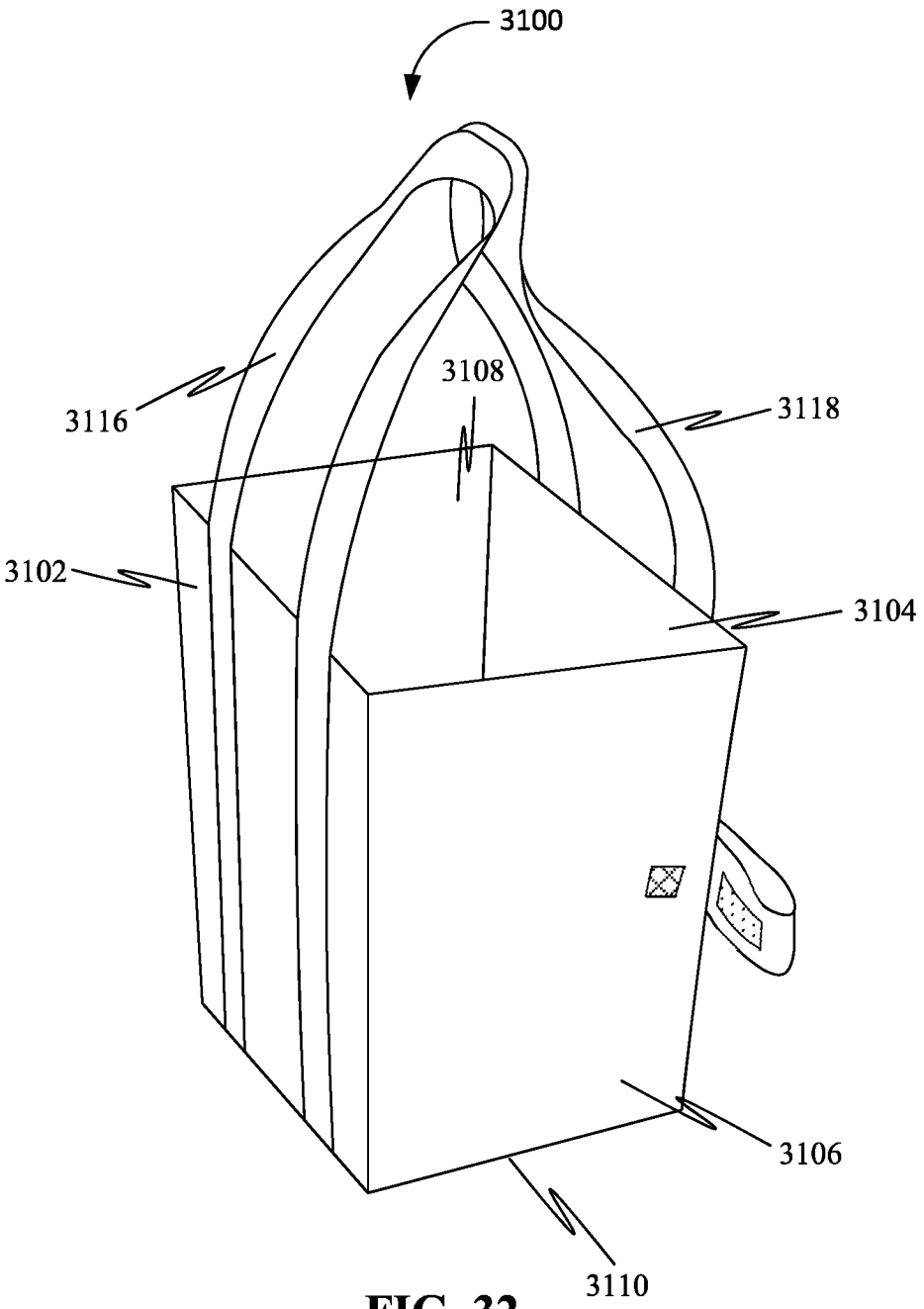
FIG. 32 is a side perspective view of the collapsibly erectable bag, in accordance with some embodiments.

FIG. 32 is a side perspective view of the collapsibly erectable bag 3100, in accordance with some embodiments.

Figure 33:
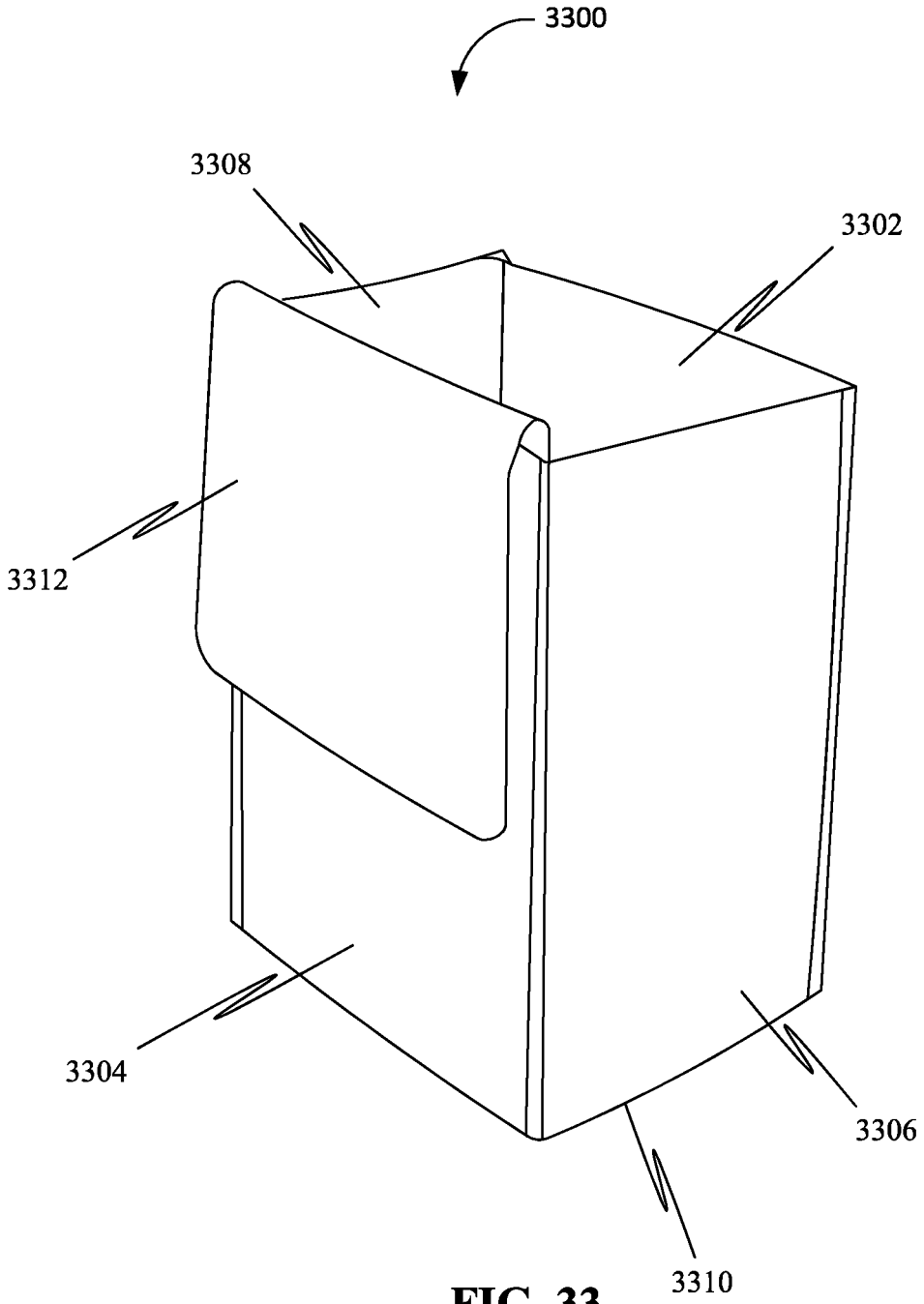
FIG. 33 is a perspective view of a thermal sports bag when opened with a top panel folded outside, in accordance with some embodiments.

FIG. 33 is a perspective view of a thermal sports bag 3300 when opened with a top panel 3312 folded outside, in accordance with some embodiments. Further, the thermal sports bag 3300 may include a collapsibly erectable bag. Further, the collapsibly erectable bag may include at least one panel and an elastic component pair. Further, the at least one panel may be configured for forming an interior space and an opening leading into the interior space. Further, the at least one panel may include a plurality of side panel pairs 3302-3308 and a bottom panel 3310. Further, a side panel pair of the plurality of side panel pairs 3302-3308 may include oppositely facing panels. Further, the at least one panel may include the top panel 3312. Further, the top panel 3312 may be detachably couplable with the opening. Further, the top panel may be associated with at least one open state and a closed state. Further, the top panel 3312 may provide access to the interior space in the at least one open state. Further, the top panel 3312 does not provide access to the interior space in the closed state. Further, the elastic component pair may be coupled to a primary side panel pair of the plurality of side panel pairs 3302-3308. Further, applying of a force on an elastic component of the elastic component pair may be configured for moving the elastic component from an initial position to a final position collapsing a first primary side panel of the primary side panel pair. Further, the moving stores potential energy in the elastic component by deforming the elastic component. Further, withdrawing of the force converts the potential energy into kinetic energy by recovering the elastic member. Further, the recovering may be configured for moving the elastic component from the final position to the initial position erecting the first primary side panel.

Figure 34:
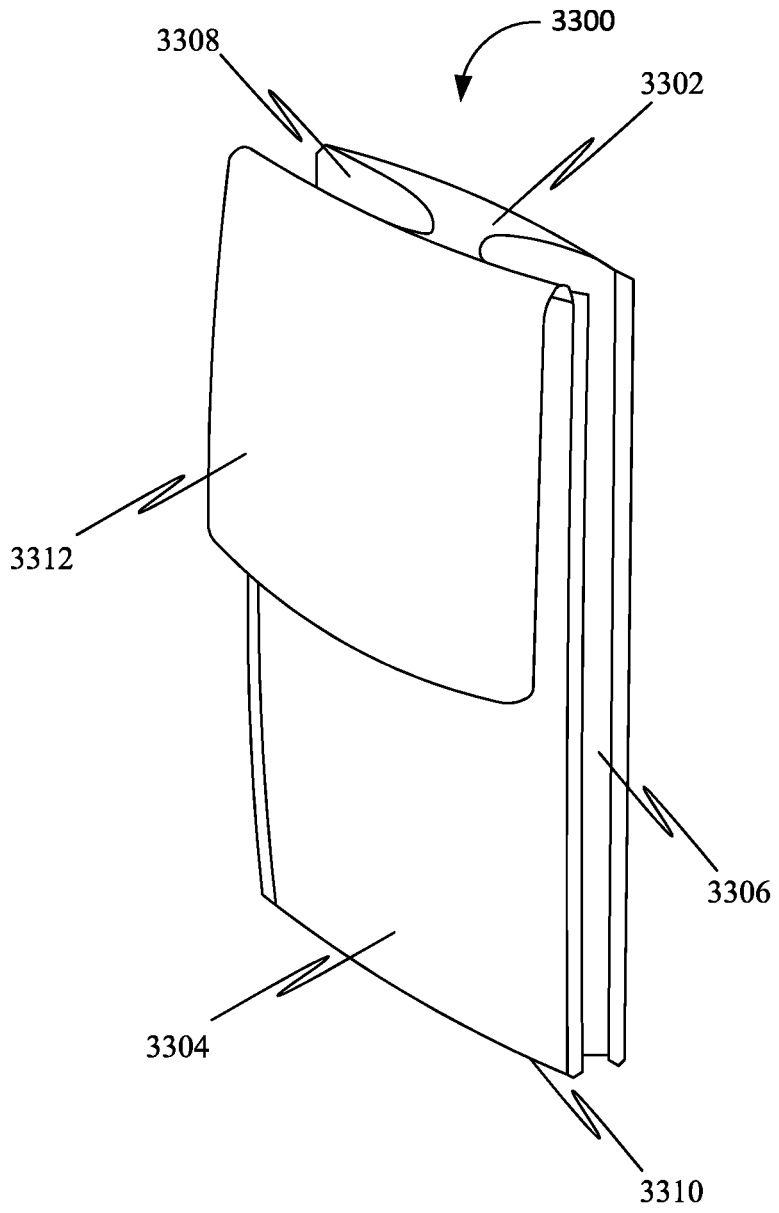
FIG. 34 is a perspective view of the thermal sports bag when closed with the top panel folded outside, in accordance with some embodiments.

FIG. 34 is a perspective view of the thermal sports bag 3300 when closed with the top panel 3312 folded outside, in accordance with some embodiments.

Figure 35:
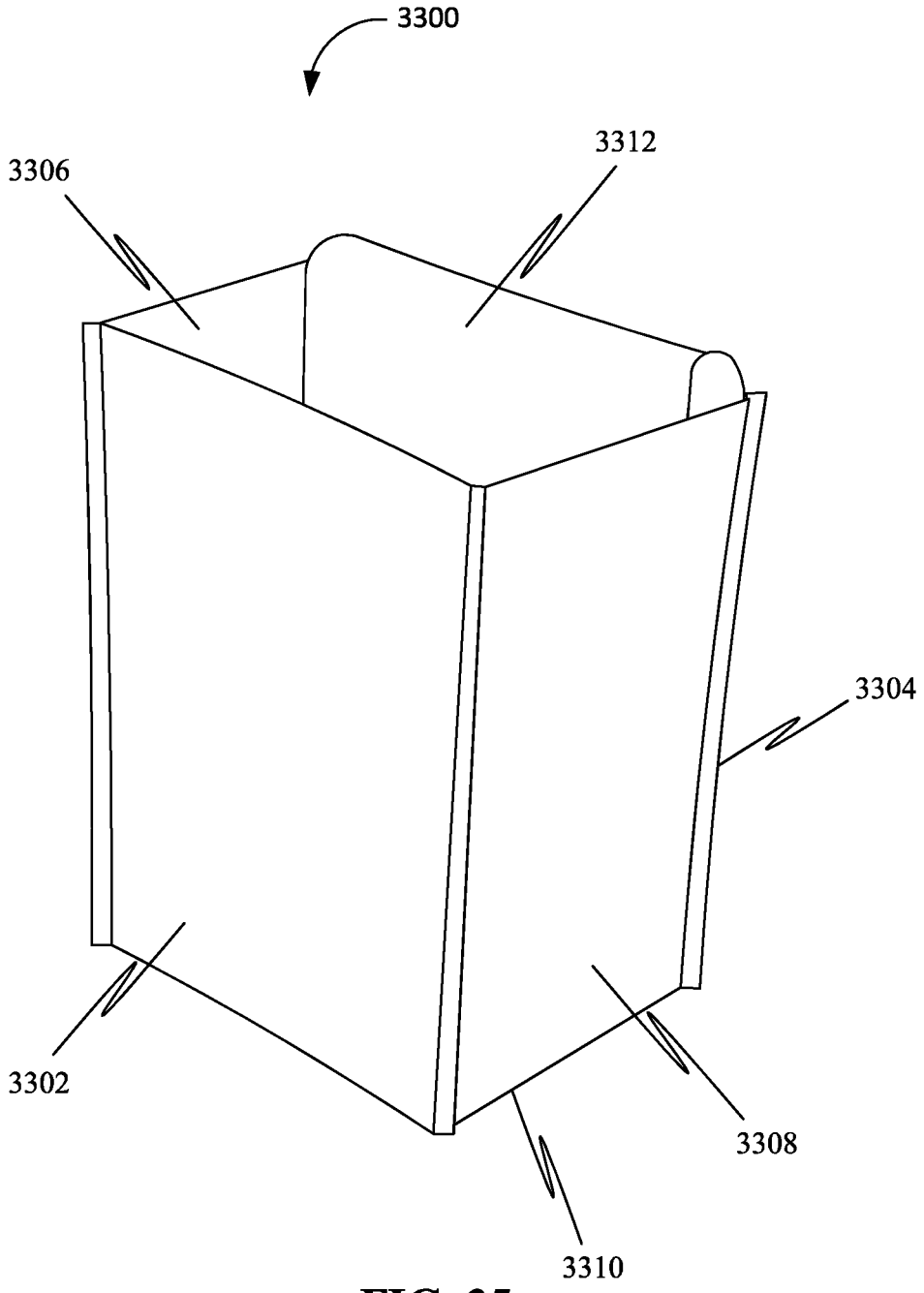
FIG. 35 is a perspective view of the thermal sports bag when opened with the top panel folded inside, in accordance with some embodiments.

FIG. 35 is a perspective view of the thermal sports bag 3300 when opened with the top panel 3312 folded inside, in accordance with some embodiments.

Figure 36:
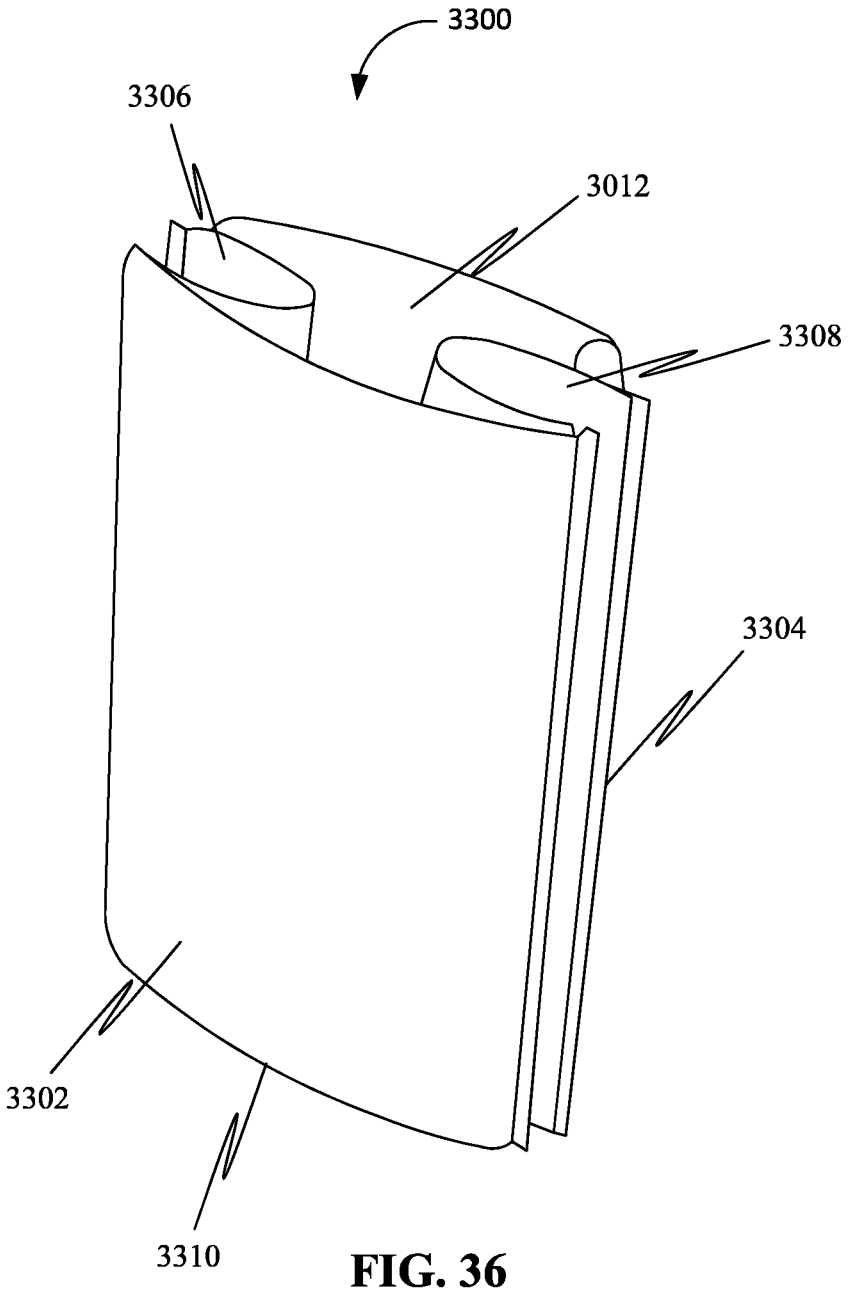
FIG. 36 is a perspective view of the thermal sports bag when closed with the top panel folded inside, in accordance with some embodiments.

FIG. 36 is a perspective view of the thermal sports bag 3300 when closed with the top panel 3312 folded inside, in accordance with some embodiments.

Figure 37:
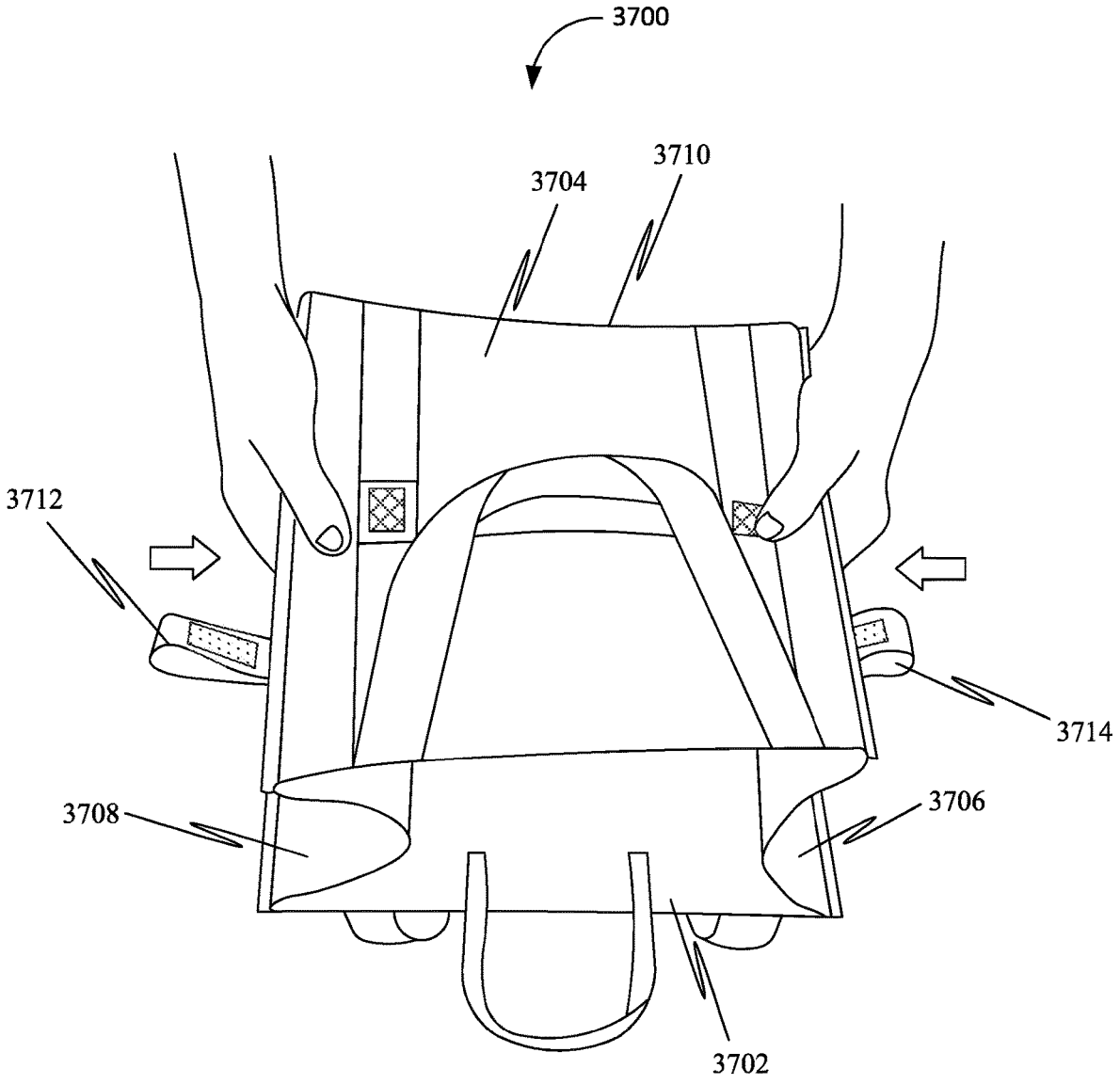
FIG. 37 is a front top perspective view of a collapsibly erectable bag showing closing of the collapsibly erectable bag, in accordance with some embodiments.

FIG. 37 is a front top perspective view of a collapsibly erectable bag 3700 showing closing of the collapsibly erectable bag 3700, in accordance with some embodiments. Further, the collapsibly erectable bag 3700 may include at least one panel and an elastic component pair. Further, the at least one panel may be configured for forming an interior space and an opening leading into the interior space. Further, the at least one panel may include a plurality of side panel pairs 3702-3708 and a bottom panel 3710. Further, a side panel pair of the plurality of side panel pairs 3702-3708 may include oppositely facing panels. Further, the elastic component pair may be coupled to a primary side panel pair of the plurality of side panel pairs 3702-3708. Further, applying of a force on an elastic component of the elastic component pair may be configured for moving the elastic component from an initial position to a final position collapsing a first primary side panel of the primary side panel pair. Further, the moving stores potential energy in the elastic component by deforming the elastic component. Further, withdrawing of the force converts the potential energy into kinetic energy by recovering the elastic member. Further, the recovering may be configured for moving the elastic component from the final position to the initial position erecting the first primary side panel.

To close the collapsibly erectable bag 3700, the collapsibly erectable bag 3700 may be laid down on the back with one hand on each small side of the collapsibly erectable bag 3700. Further, thumbs press down on the middle point while fingers push the middle of small sides towards each other. As sides are held down, fingers bring loops 3712-3714 over towards the center of the collapsibly erectable bag 3700 until fasteners on the loops 3712-3714 contact fasteners on the side of the collapsibly erectable bag 3700. Further, the fingers may go inside the loops 3712-3714. Further, the fingers may fold the loops 3712-3714 over so that the fasteners on the loops 3712-3714 and the sides make contact and hold the collapsibly erectable bag 3700 shut. As hands release the loops 3712-3714, fasteners keep the collapsibly erectable bag 3700 shut flat if using the elastic component, or nearly flat.

Figure 38:
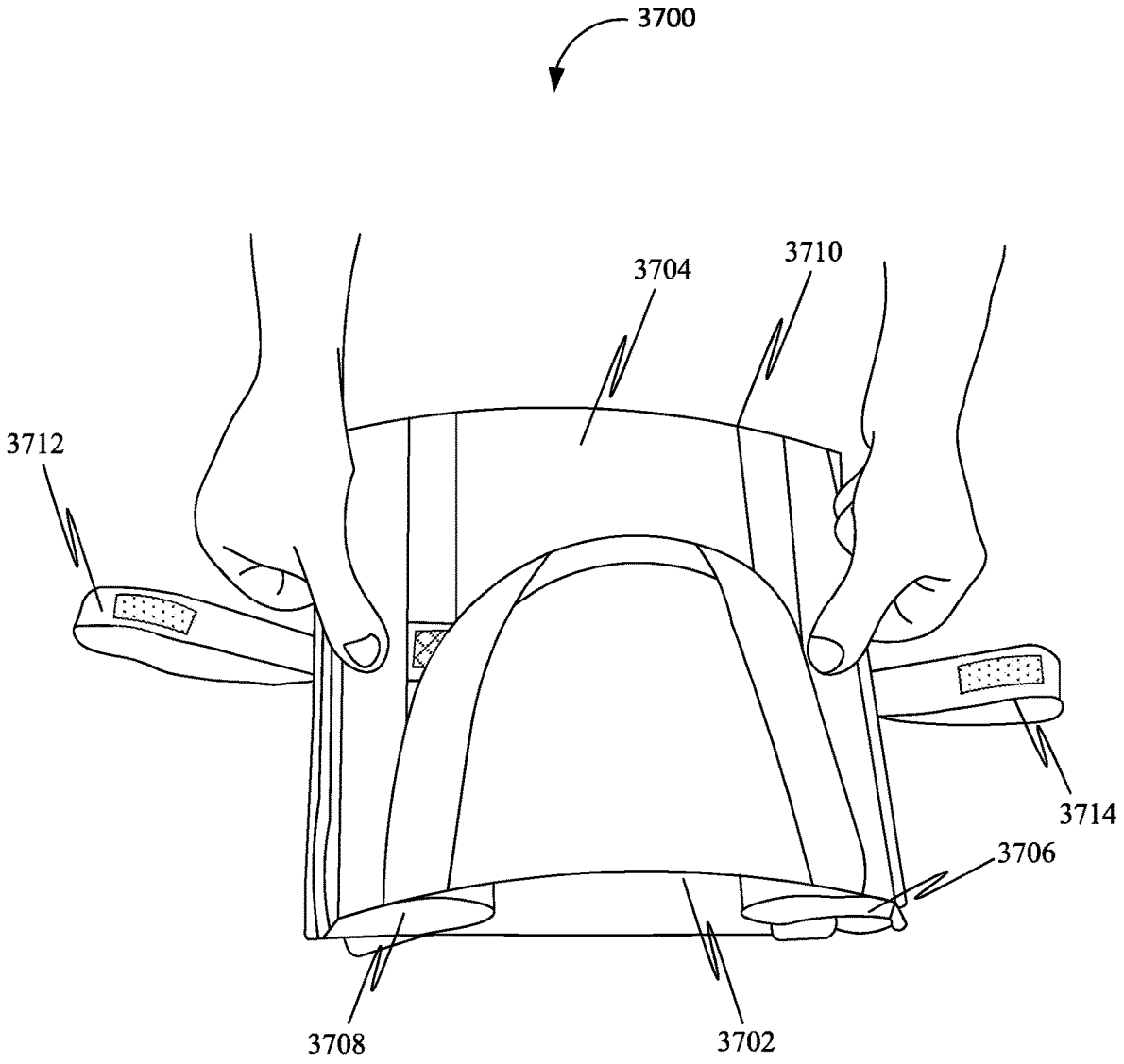
FIG. 38 is a front top perspective view of the collapsibly erectable bag showing closing of the collapsibly erectable bag, in accordance with some embodiments.

FIG. 38 is a front top perspective view of the collapsibly erectable bag 3700 showing closing of the collapsibly erectable bag 3700, in accordance with some embodiments.

Figure 39:
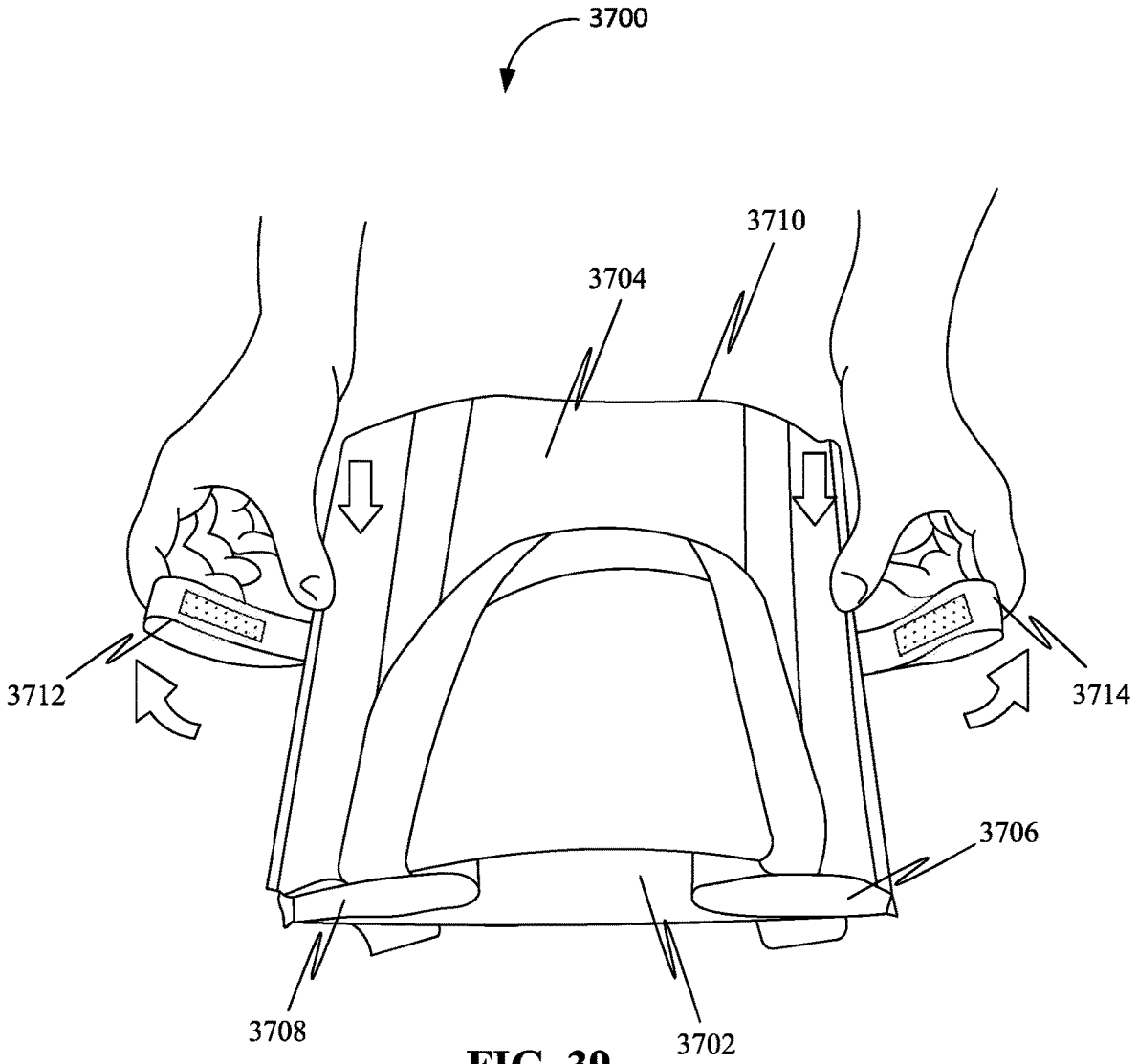
FIG. 39 is a front top perspective view of the collapsibly erectable bag showing closing of the collapsibly erectable bag, in accordance with some embodiments.

FIG. 39 is a front top perspective view of the collapsibly erectable bag 3700 showing closing of the collapsibly erectable bag 3700, in accordance with some embodiments.

Figure 40:
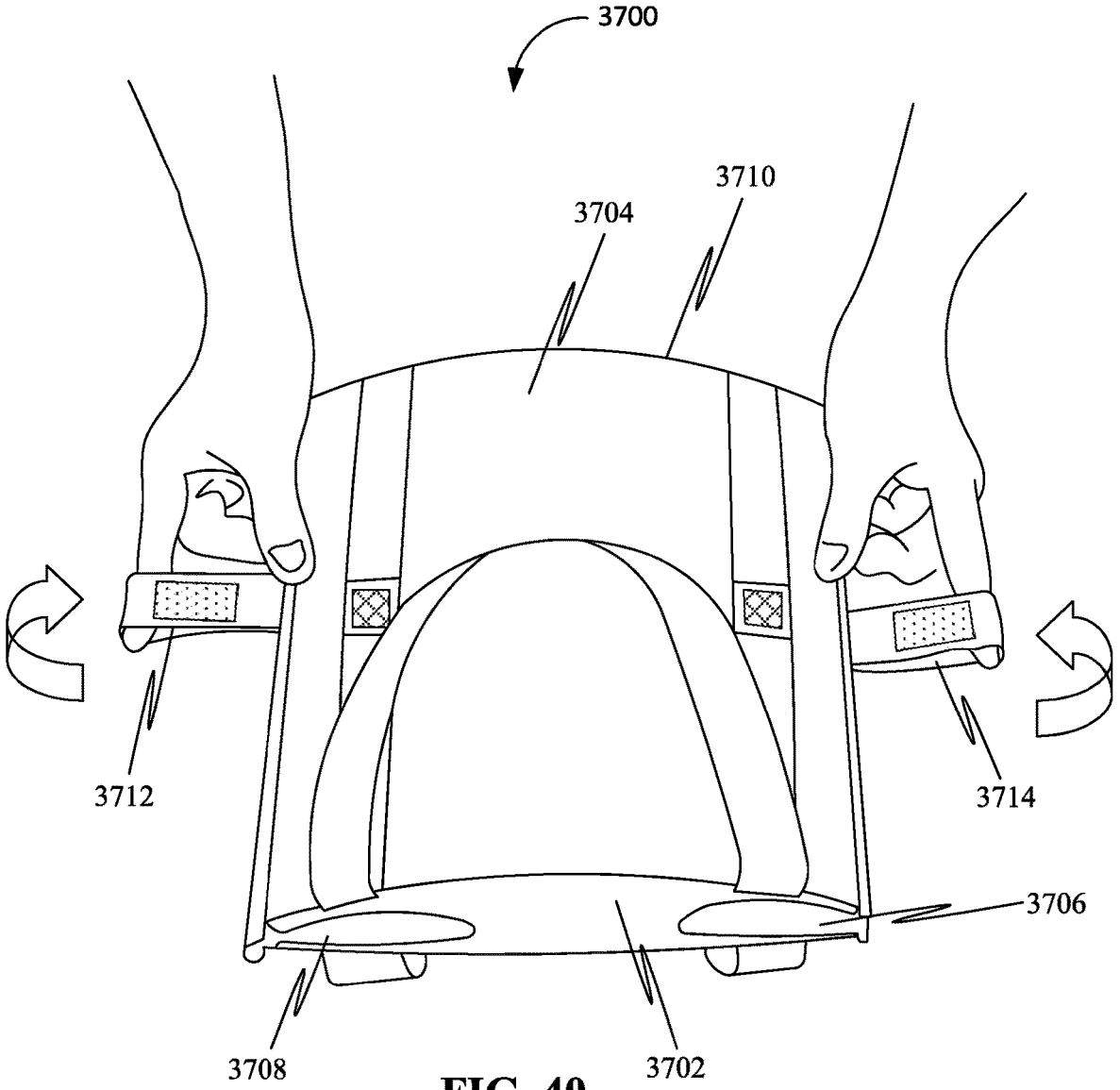
FIG. 40 is a front top perspective view of the collapsibly erectable bag showing closing of the collapsibly erectable bag, in accordance with some embodiments.

FIG. 40 is a front top perspective view of the collapsibly erectable bag 3700 showing closing of the collapsibly erectable bag 3700, in accordance with some embodiments.

Figure 41:
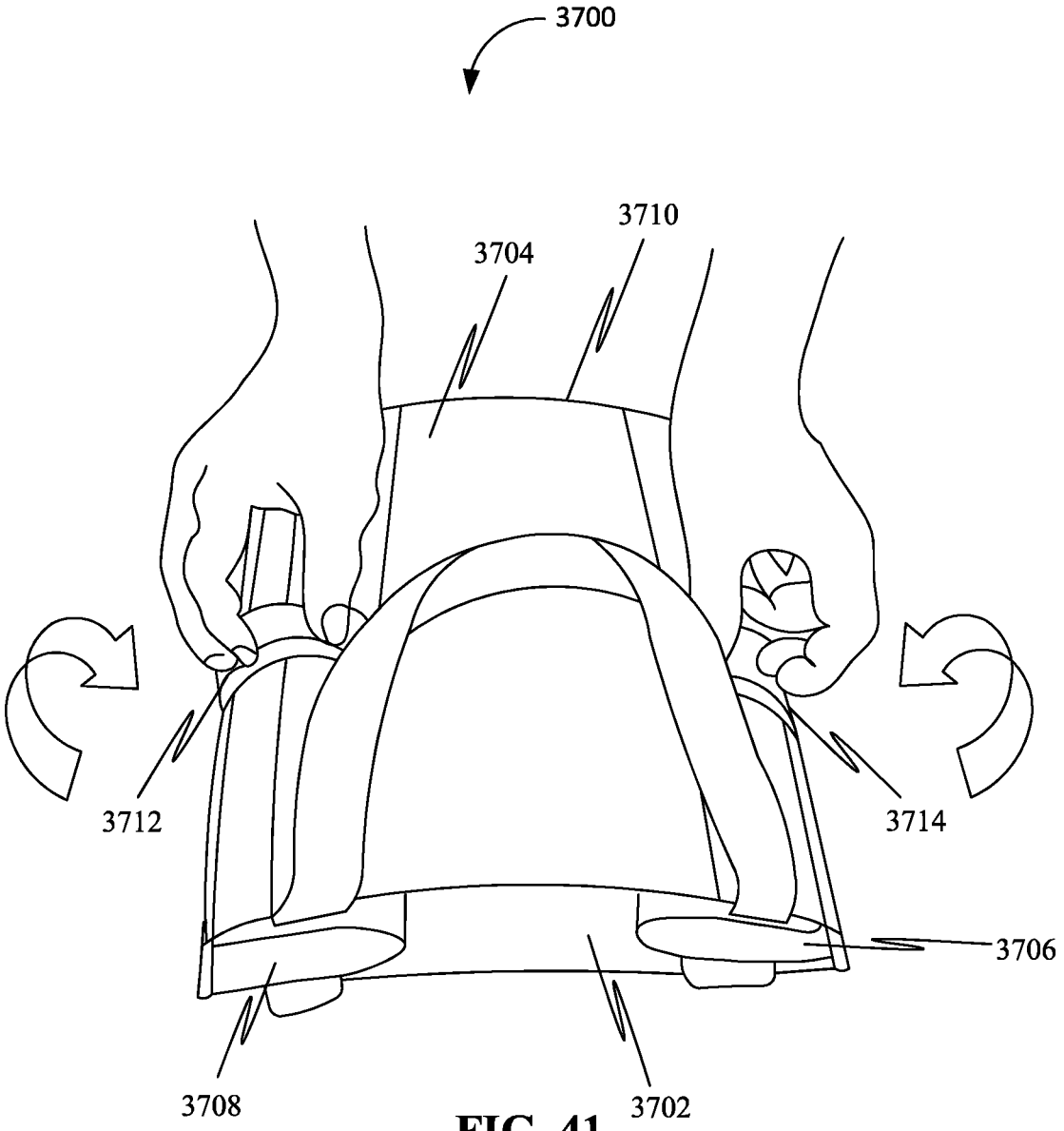
FIG. 41 is a front top perspective view of the collapsibly erectable bag showing closing of the collapsibly erectable bag, in accordance with some embodiments.

FIG. 41 is a front top perspective view of the collapsibly erectable bag 3700 showing closing of the collapsibly erectable bag 3700, in accordance with some embodiments.

Figure 42:
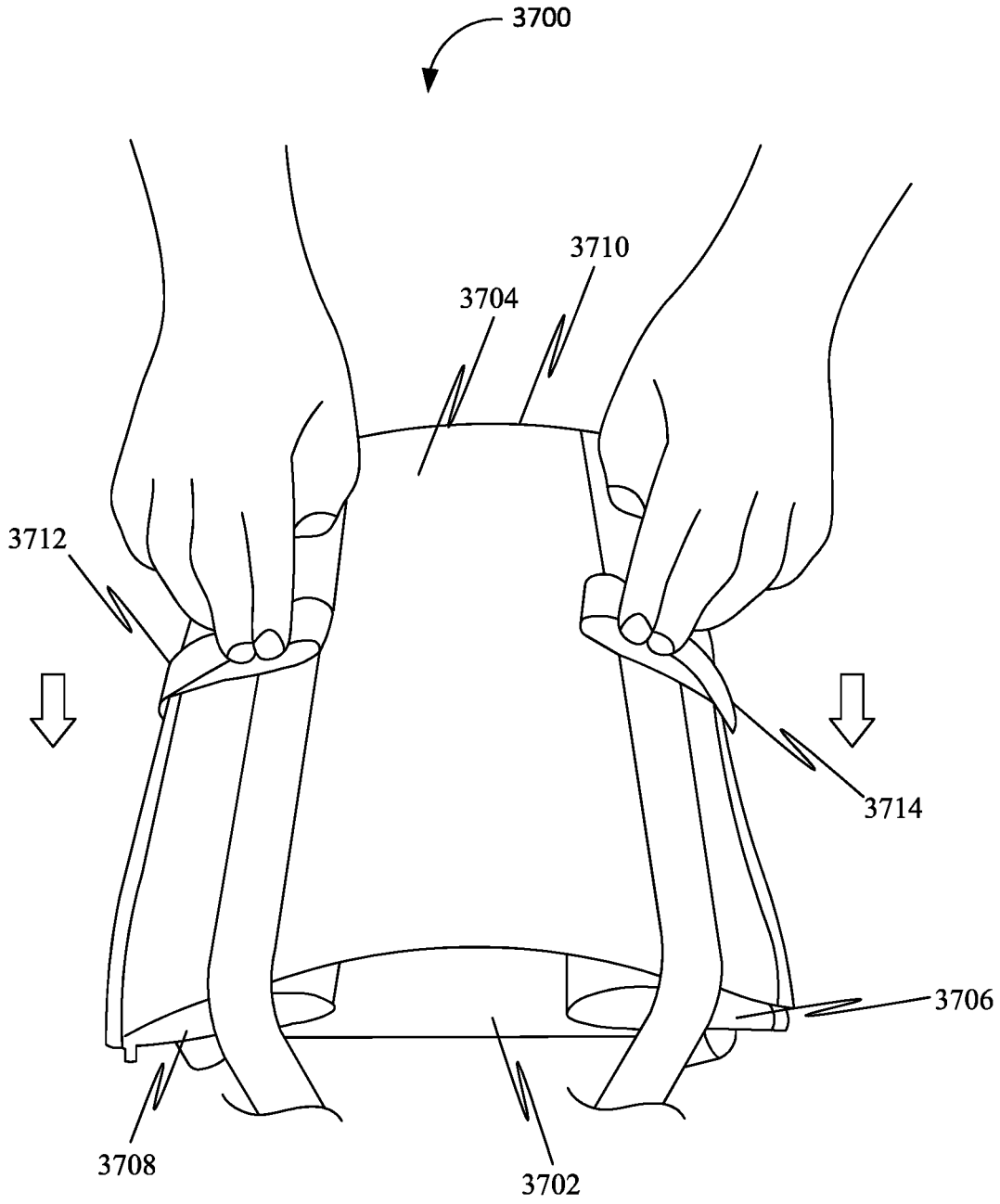
FIG. 42 is a front top perspective view of the collapsibly erectable bag showing closing of the collapsibly erectable bag, in accordance with some embodiments.

FIG. 42 is a front top perspective view of the collapsibly erectable bag 3700 showing closing of the collapsibly erectable bag 3700, in accordance with some embodiments.

Figure 43:
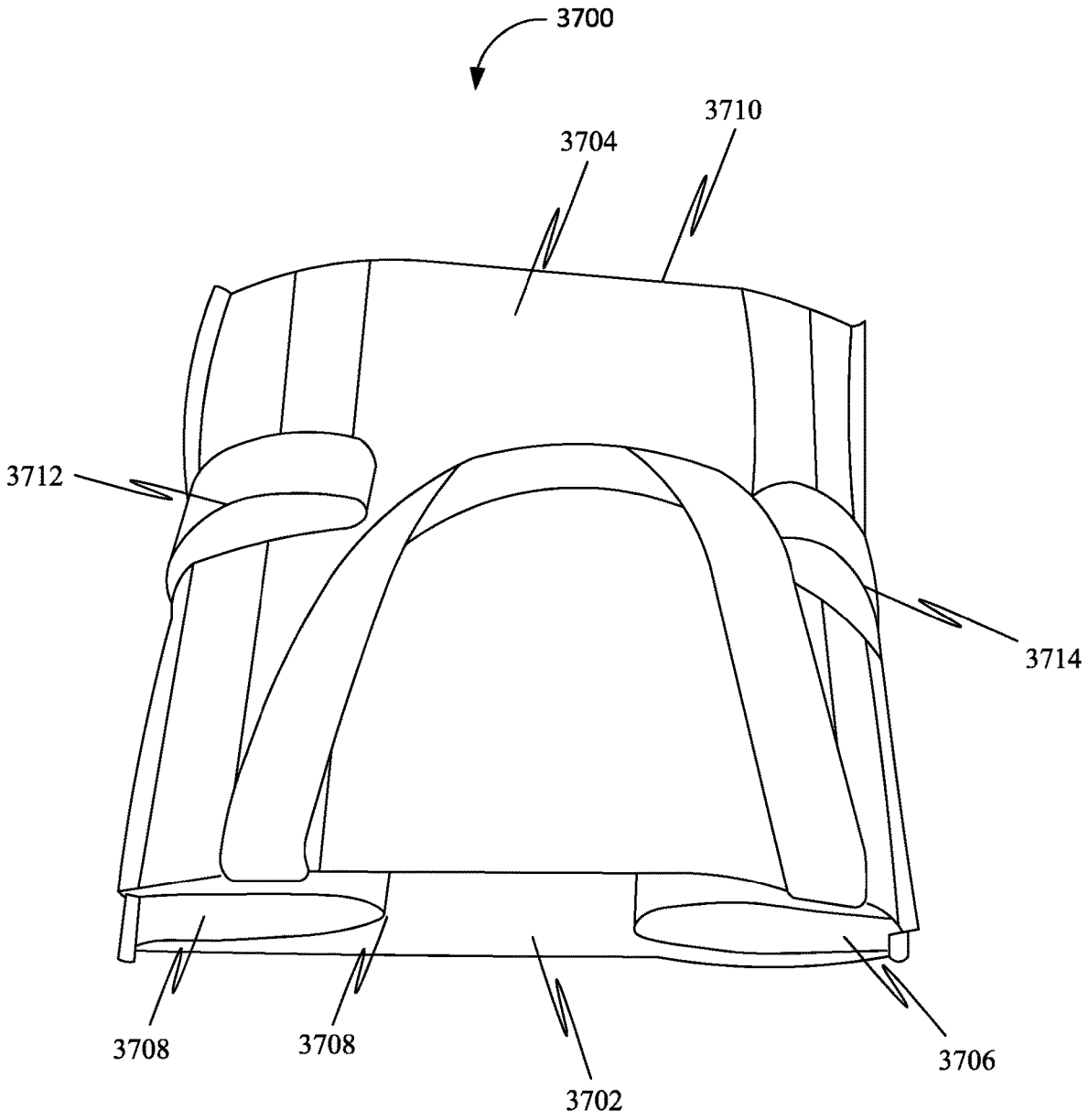
FIG. 43 is a front top perspective view of the collapsibly erectable bag being closed, in accordance with some embodiments.

FIG. 43 is a front top perspective view of the collapsibly erectable bag 3700 being closed, in accordance with some embodiments.

Figure 44:
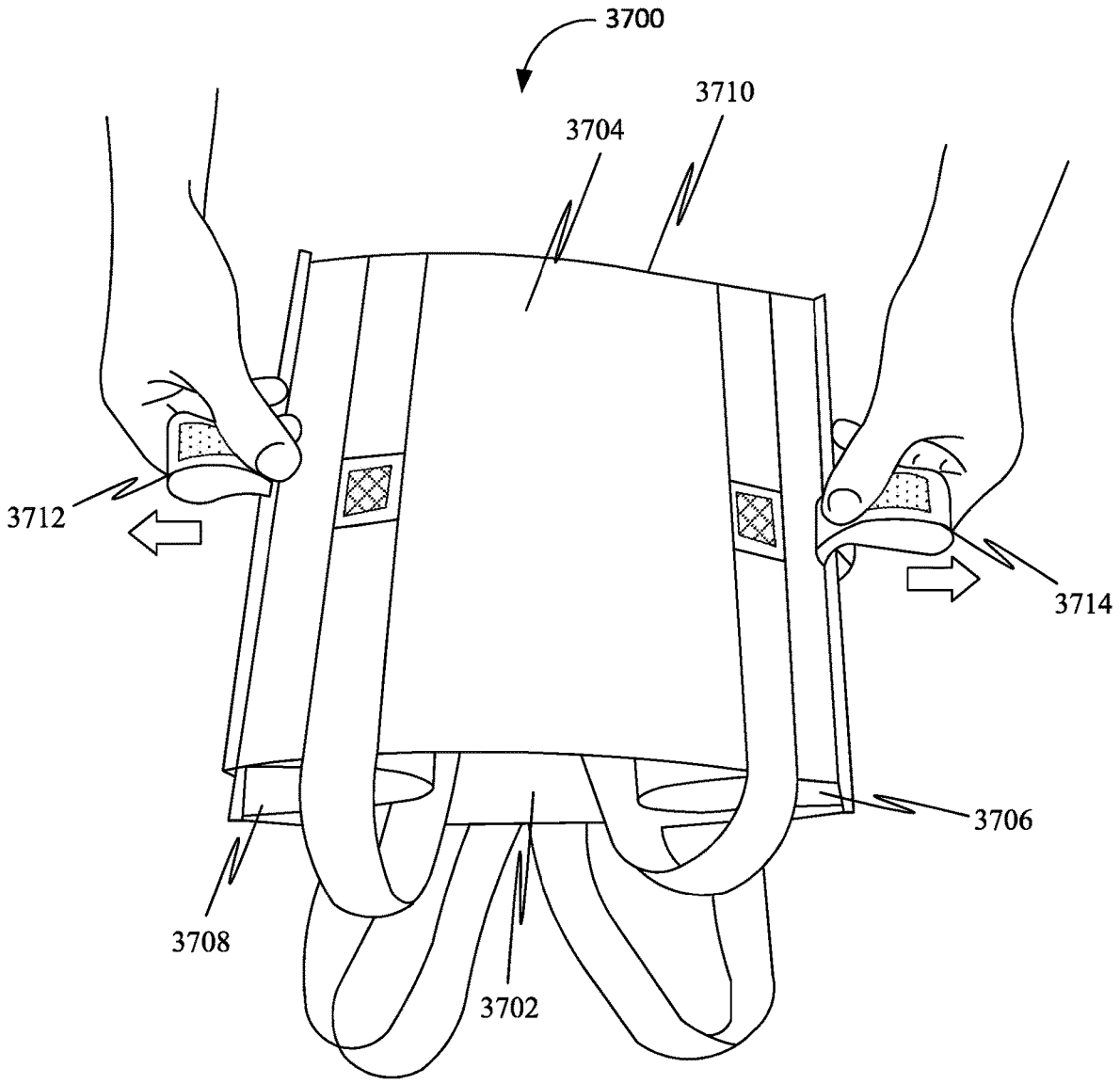
FIG. 44 is a front top perspective view of the collapsibly erectable bag showing opening of the collapsibly erectable bag, in accordance with some embodiments.

FIG. 44 is a front top perspective view of the collapsibly erectable bag 3700 showing opening of the collapsibly erectable bag 3700, in accordance with some embodiments. To open the collapsibly erectable bag 3700, one hand grabs each loop of the loops 3712-3714 and pulls sharply away from each other, thereby releasing the grip of the fasteners and allows the elastic component inside each end to flex out flat and the collapsibly erectable bag 3700 to open.

Figure 45:
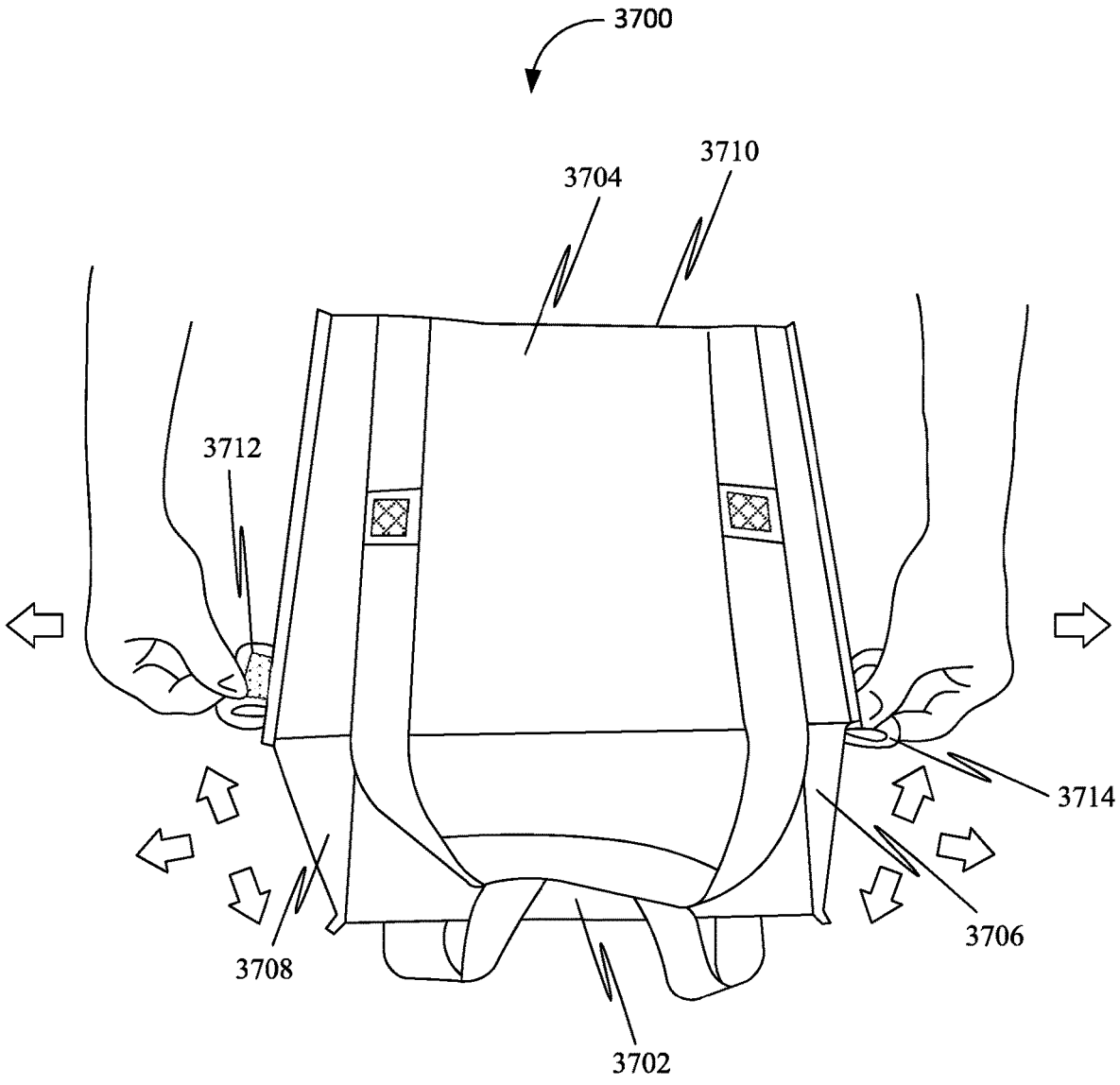
FIG. 45 is a front top perspective view of the collapsibly erectable bag being opened, in accordance with some embodiments.

FIG. 45 is a front top perspective view of the collapsibly erectable bag 3700 being opened, in accordance with some embodiments.

Figure 46:
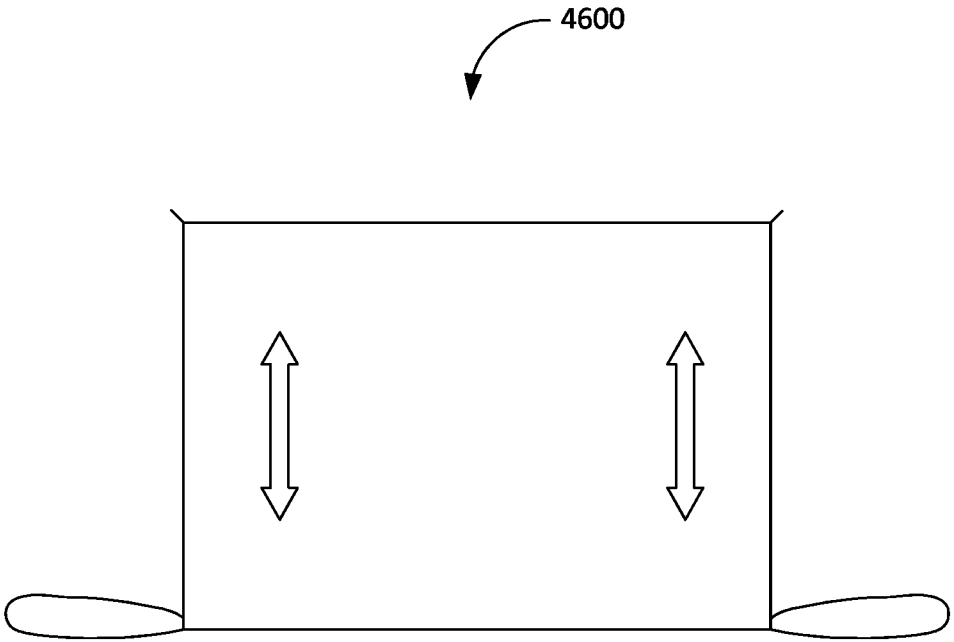
FIG. 46 is a top view of a collapsibly erectable bag showing mechanical spring operation, in accordance with some embodiments.

FIG. 46 is a top view of a collapsibly erectable bag 4600 showing mechanical spring operation, in accordance with some embodiments. Further, the collapsibly erectable bag 4600 may be opened. Further, sides of the collapsibly erectable bag 4600 may be pressed in as top may be pressed down. Further, opposing edges of the collapsibly erectable bag 4600 may come together close enough for fasteners along edges of the collapsibly erectable bag 4600 to grip to the fasteners on loops/tabs. Further, the loops/tabs may be pulled apart, thereby releasing fasteners from each other.

Figure 47:
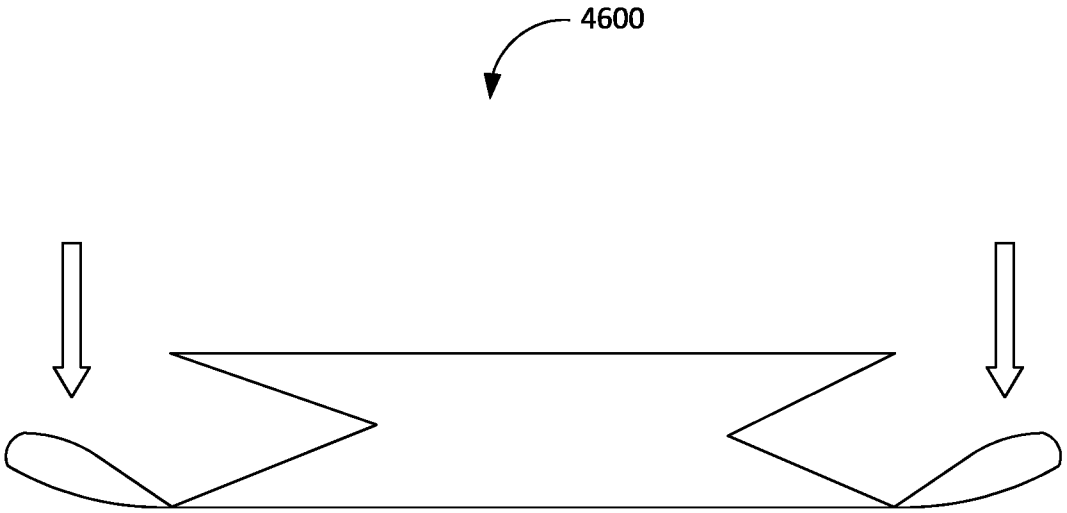
FIG. 47 is a top view of the collapsibly erectable bag showing mechanical spring operation, in accordance with some embodiments.

FIG. 47 is a top view of the collapsibly erectable bag 4600 showing mechanical spring operation, in accordance with some embodiments.

Figure 48:
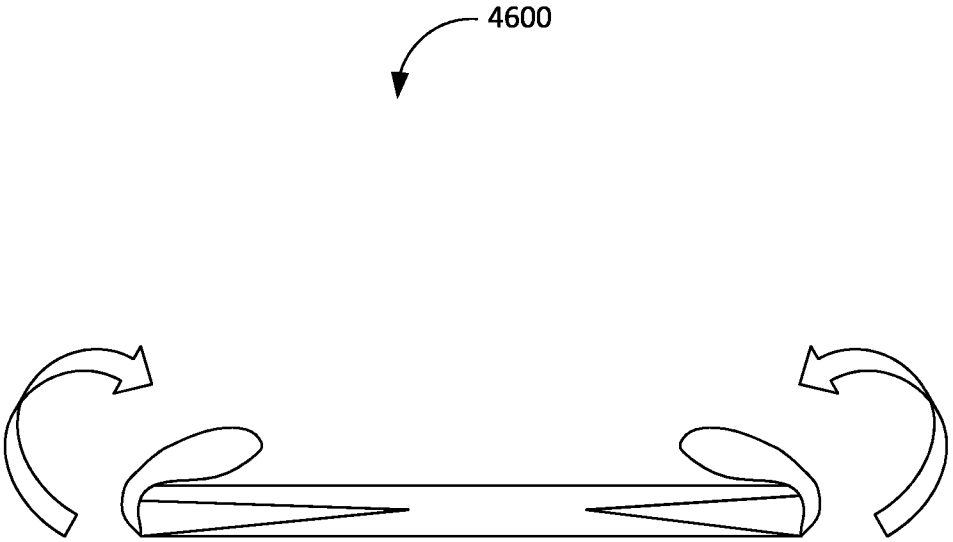
FIG. 48 is a top view of the collapsibly erectable bag showing mechanical spring operation, in accordance with some embodiments.

FIG. 48 is a top view of the collapsibly erectable bag 4600 showing mechanical spring operation, in accordance with some embodiments.

Figure 49:
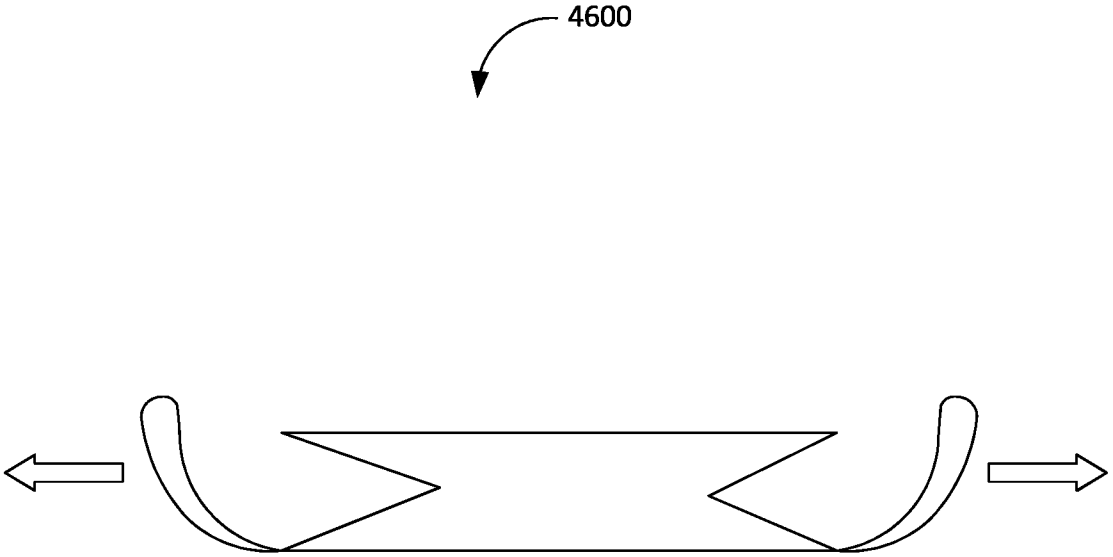
FIG. 49 is a top view of the collapsibly erectable bag showing mechanical spring operation, in accordance with some embodiments.

FIG. 49 is a top view of the collapsibly erectable bag 4600 showing mechanical spring operation, in accordance with some embodiments.

Figure 50:
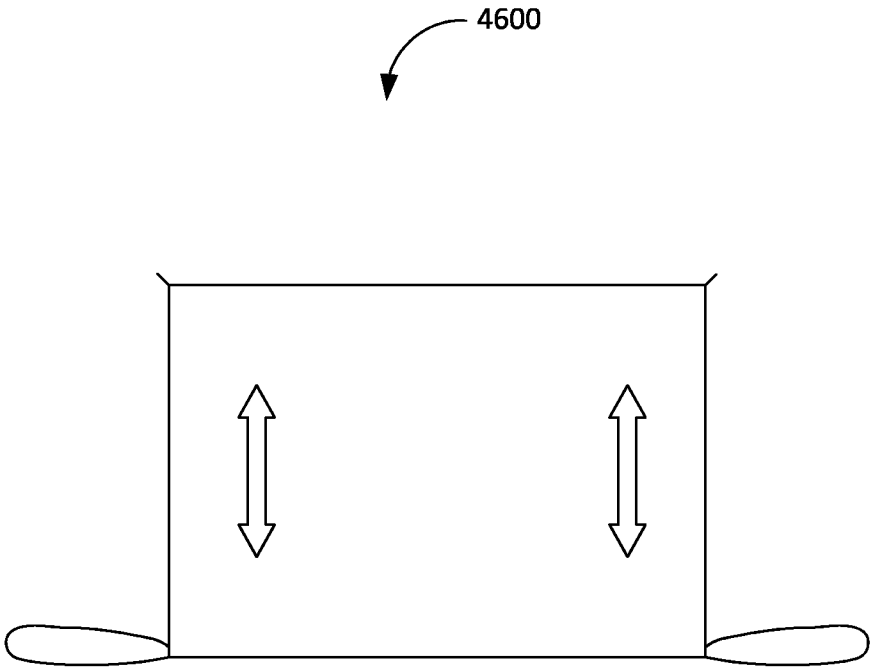
FIG. 50 is a top view of the collapsibly erectable bag showing mechanical spring operation, in accordance with some embodiments.

FIG. 50 is a top view of the collapsibly erectable bag 4600 showing mechanical spring operation, in accordance with some embodiments.

Figure 51:
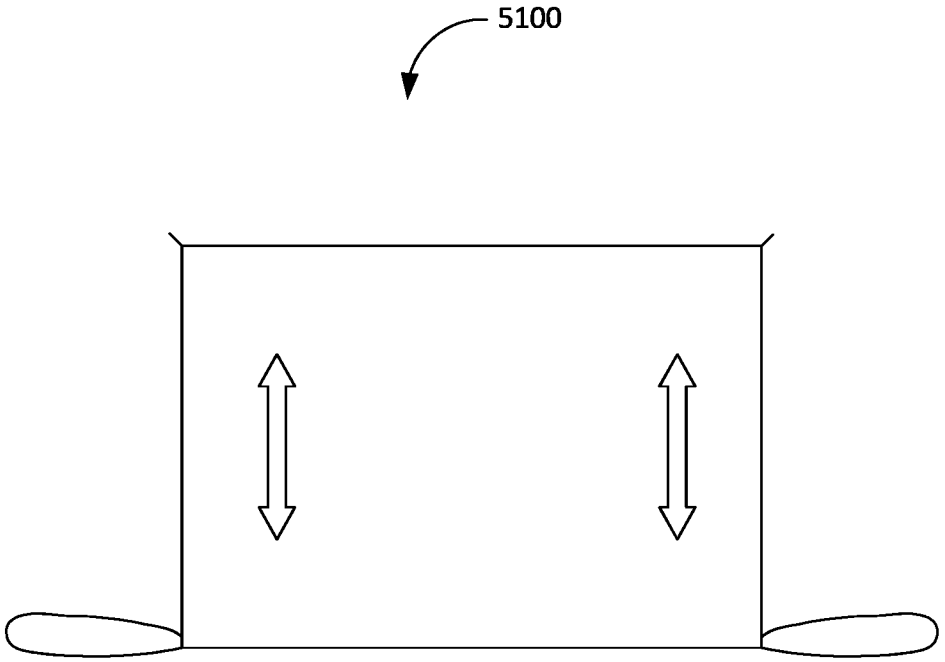
FIG. 51 is a top view of a collapsibly erectable bag showing mechanical plastic operation, in accordance with some embodiments.

FIG. 51 is a top view of a collapsibly erectable bag 5100 showing mechanical plastic operation, in accordance with some embodiments. Further, the collapsibly erectable bag 5100 may be opened. Further, sides of the collapsibly erectable bag 5100 may be pressed in as the top may be pressed down. Further, opposing edges of the collapsibly erectable bag 5100 may come together close enough for fasteners along edges of the collapsibly erectable bag 5100 to grip the fasteners on loops/tabs. Further, the loops/tabs may be pulled apart, thereby releasing the fasteners from each other. Further, springy plastic inside small sides of the collapsibly erectable bag 5100 may flex open and pop the collapsibly erectable bag 5100 open. Further, plastic and cardboard may give the collapsibly erectable bag 5100 a rigid and upright stance.

Figure 52:
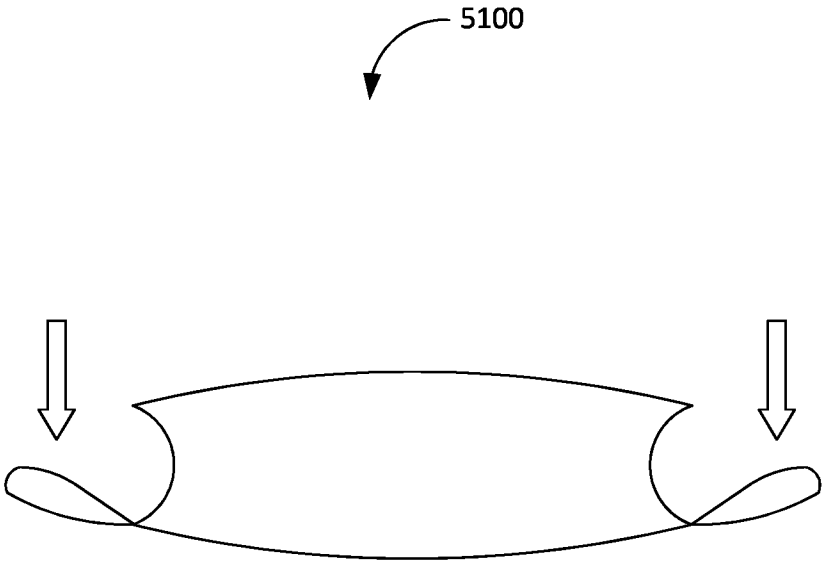
FIG. 52 is a top view of the collapsibly erectable bag showing mechanical plastic operation, in accordance with some embodiments.

FIG. 52 is a top view of the collapsibly erectable bag 5100 showing mechanical plastic operation, in accordance with some embodiments.

Figure 53:
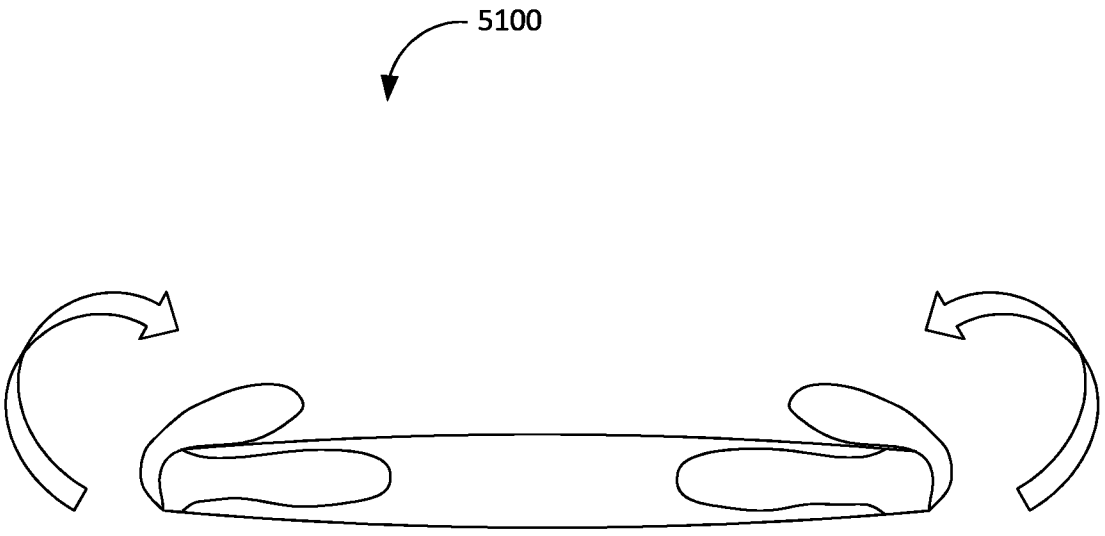
FIG. 53 is a top view of the collapsibly erectable bag showing mechanical plastic operation, in accordance with some embodiments.

FIG. 53 is a top view of the collapsibly erectable bag 5100 showing mechanical plastic operation, in accordance with some embodiments.

Figure 54:
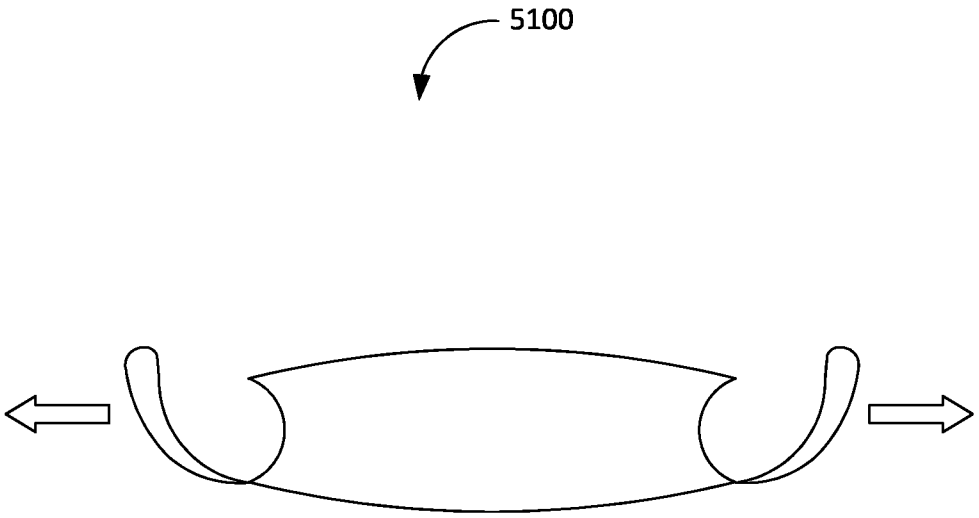
FIG. 54 is a top view of the collapsibly erectable bag showing mechanical plastic operation, in accordance with some embodiments.

FIG. 54 is a top view of the collapsibly erectable bag 5100 showing mechanical plastic operation, in accordance with some embodiments.

Figure 55:
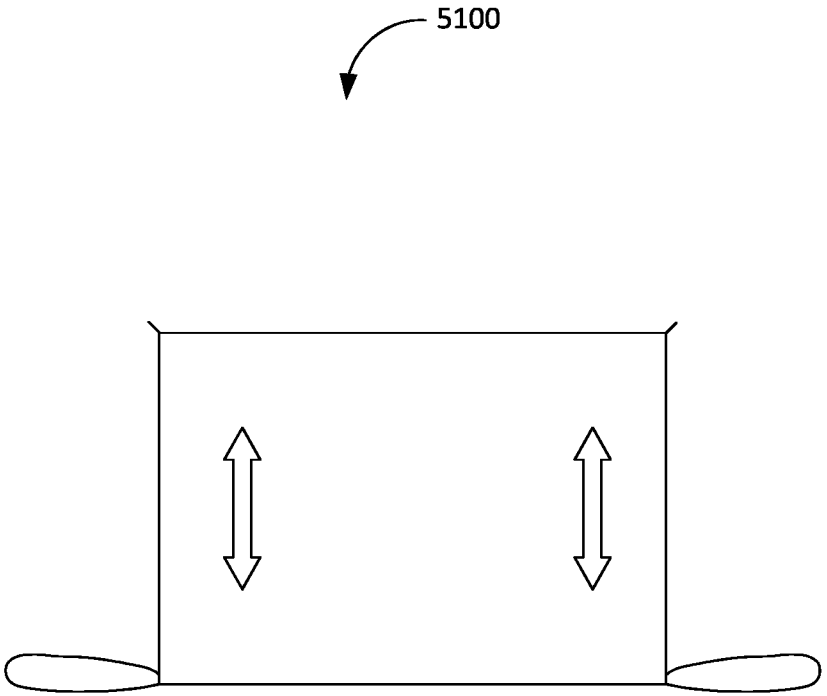
FIG. 55 is a top view of the collapsibly erectable bag showing mechanical plastic operation, in accordance with some embodiments.

FIG. 55 is a top view of the collapsibly erectable bag 5100 showing mechanical plastic operation, in accordance with some embodiments.

Figure 56:
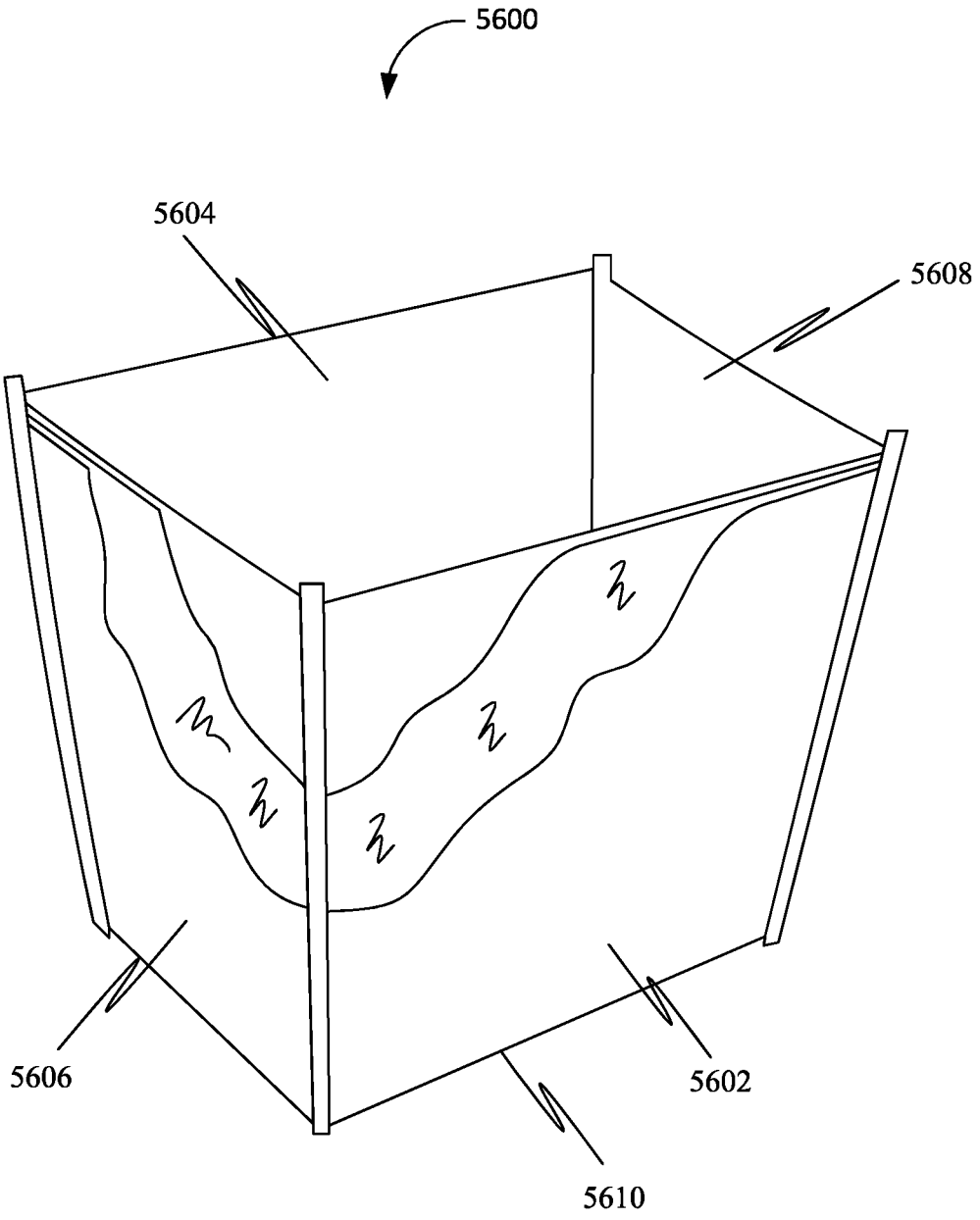
FIG. 56 is a cut-away view of a collapsibly erectable bag, in accordance with some embodiments.

FIG. 56 is a cut-away view of a collapsibly erectable bag 5600, in accordance with some embodiments. Further, the collapsibly erectable bag 5600 may include at least one panel and an elastic component pair. Further, the at least one panel may be configured for forming an interior space and an opening leading into the interior space. Further, the at least one panel may include a plurality of side panel pairs 5602-5608 and a bottom panel 5610. Further, a side panel pair of the plurality of side panel pairs 5602-5608 may include oppositely facing panels. Further, the elastic component pair may be coupled to a primary side panel pair of the plurality of side panel pairs 5602-5608. Further, the elastic component pair may include a spring pair or a springy plastic pair. Further, the collapsibly erectable bag 5600 may include a walled rectangular fabric, plastic, or other man-made or natural material.

Figure 57:
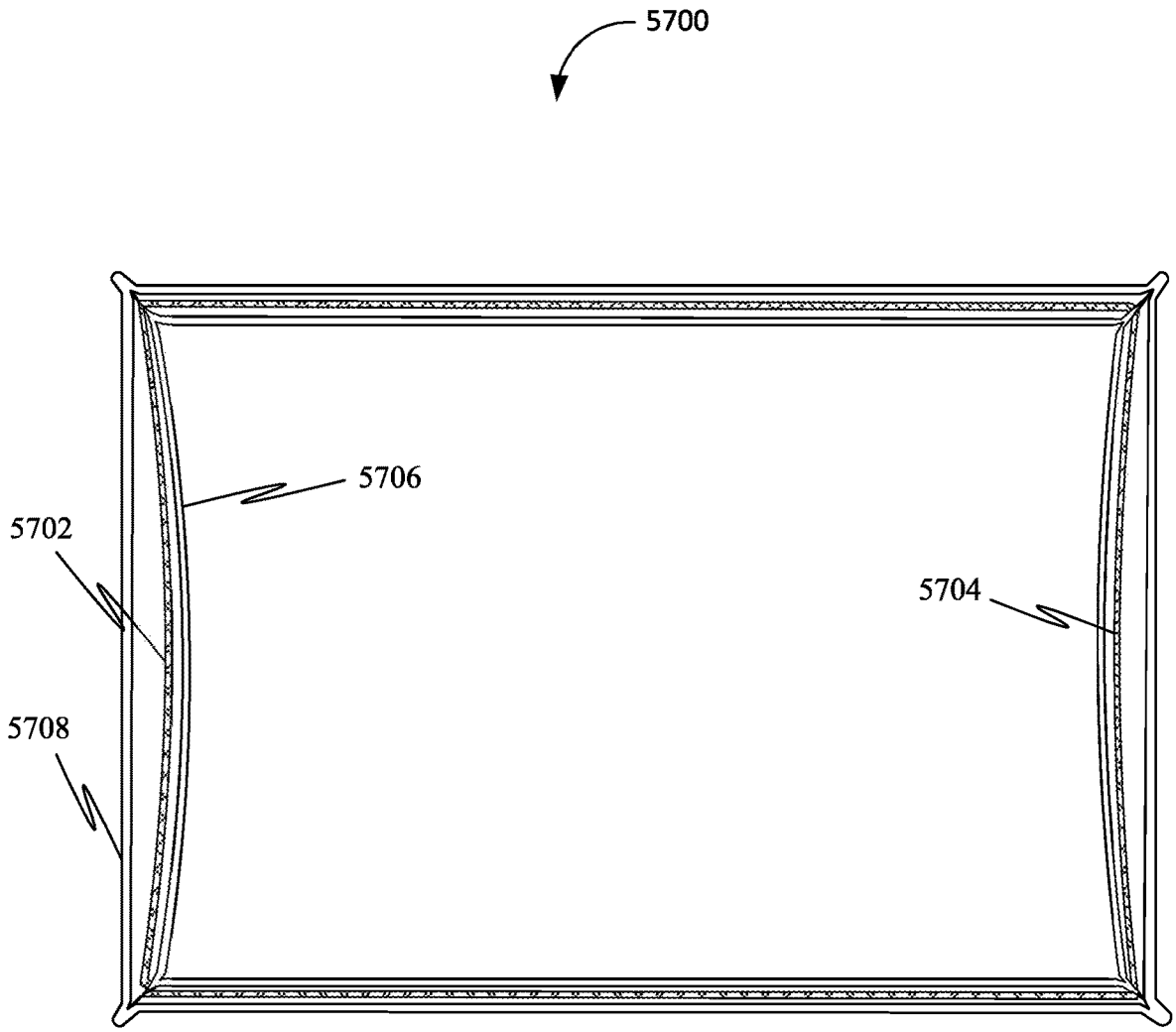
FIG. 57 is a top sectional view of a collapsibly erectable bag with a springy plastic pair, in accordance with some embodiments.

FIG. 57 is a top sectional view of a collapsibly erectable bag 5700 with a springy plastic pair 5702-5704, in accordance with some embodiments. Further, the springy plastic pair 5702-5704 may be associated with a springy plastic sheet. Further, the springy plastic sheet may be sandwiched between an inner bag layer 5706 and an outer bag layer 5708. Further, the springy plastic sheet may create a bow in the opening which may provide the collapsibly erectable bag 5700 extra spring to pop open. Further, the collapsibly erectable bag 5700 may include a 0.030 makralon plastic material.

Figure 58:
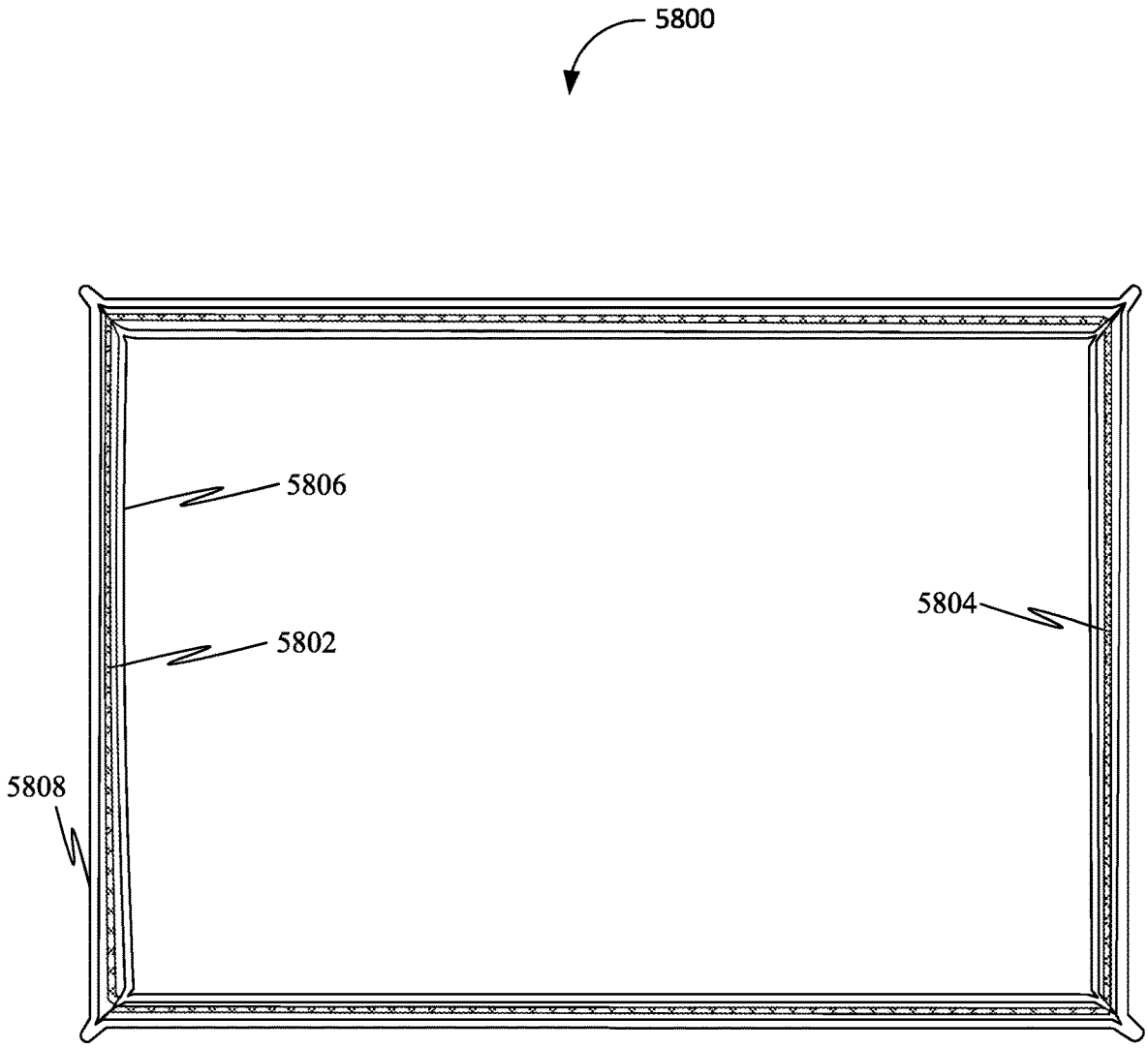
FIG. 58 is a top sectional view of a collapsibly erectable bag with a spring pair, in accordance with some embodiments.

FIG. 58 is a top sectional view of a collapsibly erectable bag 5800 with a spring pair 5802-5804, in accordance with some embodiments. Further, the spring pair 5802-5804 may provide better pop and stability to the collapsibly erectable bag 5800. Further, the spring pair 5802-5804 may be associated with a spring. Further, the spring may be sandwiched between an inner bag layer 5806 and an outer bag layer 5808.

Figure 59:
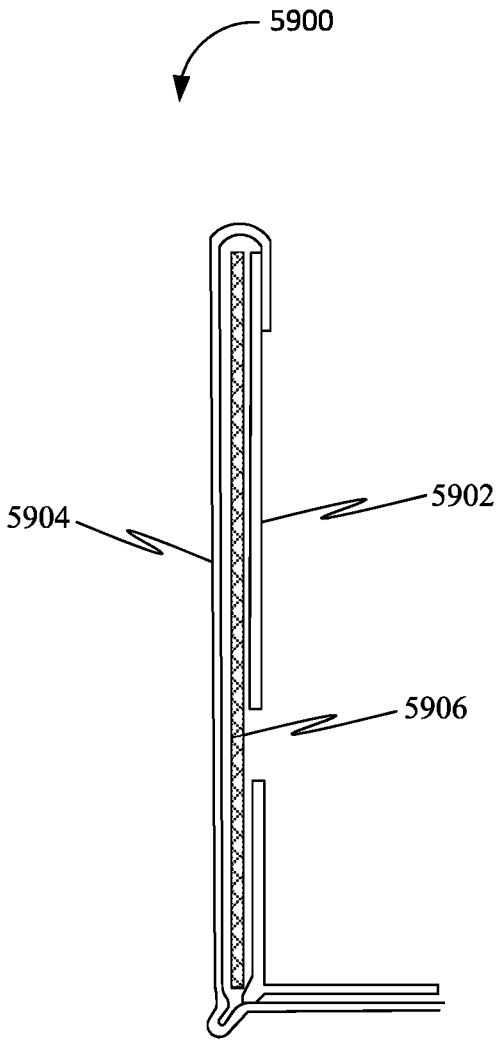
FIG. 59 is a left side sectional view of a collapsibly erectable bag, in accordance with some embodiments.

FIG. 59 is a left side sectional view of a collapsibly erectable bag 5900, in accordance with some embodiments. Further, the collapsibly erectable bag 5900 may include an elastic component pair. Further, the elastic component pair may include an elastic component 5906. Further, the elastic component 5906 may include a spring or a springy plastic. Further, the elastic component pair may be sandwiched between an inner bag layer and an outer bag layer. Further, the inner bag layer and the outer bag layer may correspond to an inner lining 5902 and an outer lining 5904 respectively.

Figure 60:
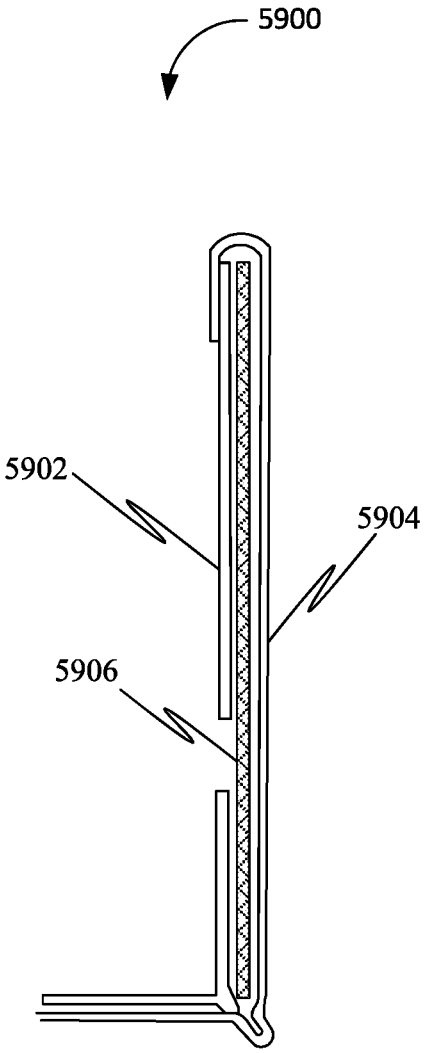
FIG. 60 is a right side sectional view of the collapsibly erectable bag, in accordance with some embodiments.

FIG. 60 is a right side sectional view of the collapsibly erectable bag 5900, in accordance with some embodiments.

Figure 61:
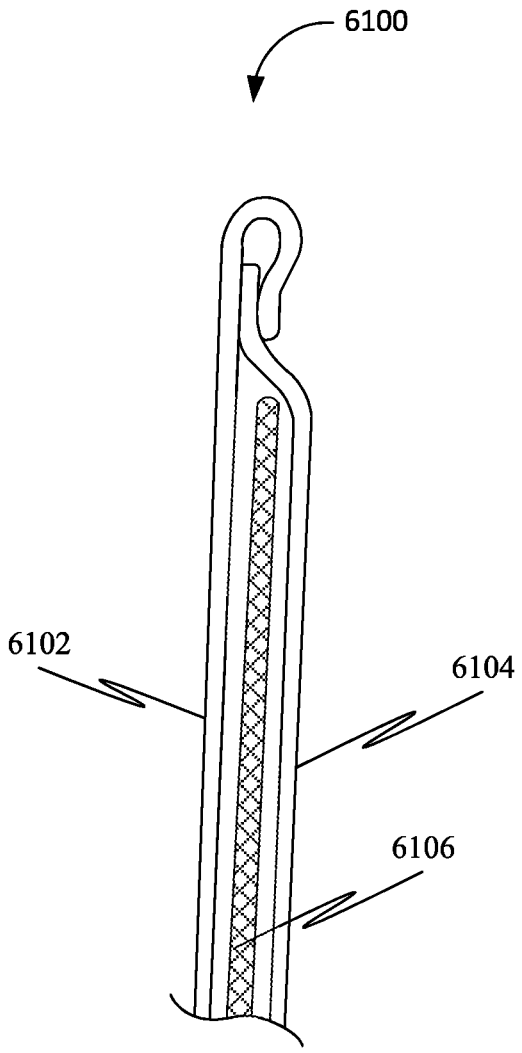
FIG. 61 is a partial side view of a collapsibly erectable bag showing top edge finishing, in accordance with some embodiments.

FIG. 61 is a partial side view of a collapsibly erectable bag 6100 showing top edge finishing, in accordance with some embodiments. Further, the collapsibly erectable bag 6100 may include an elastic component pair. Further, the elastic component pair may be sandwiched between an inner bag layer 6102 and an outer bag layer 6104. Further, the elastic component pair may include an elastic component 6106. Further, the elastic component 6106 may include a spring or a springy plastic.

Figure 62:
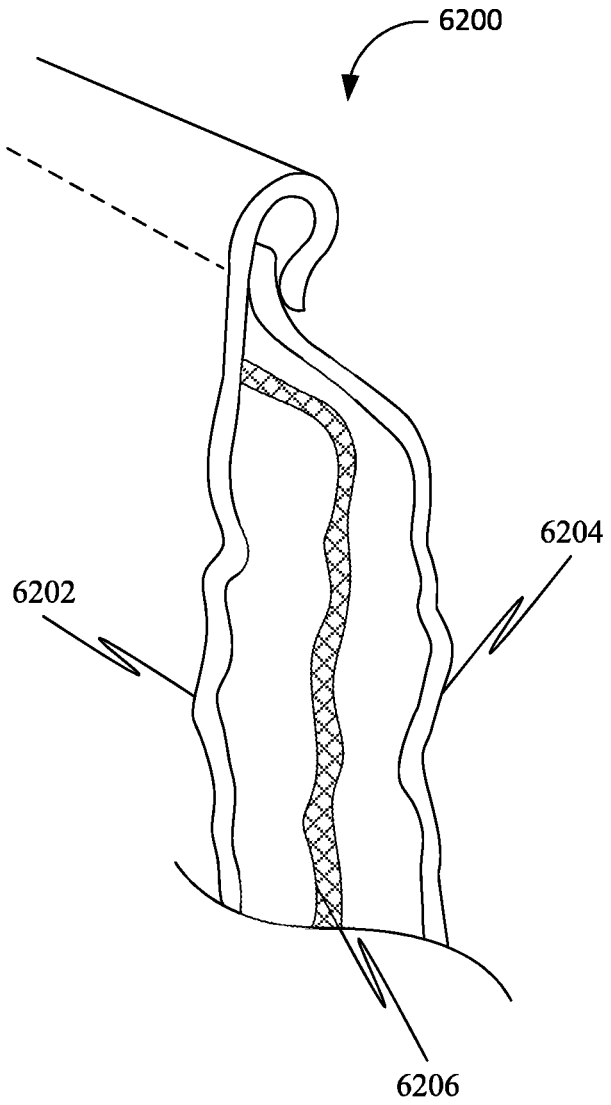
FIG. 62 is a partial close-up view of a collapsibly erectable bag showing top edge finishing, in accordance with some embodiments.

FIG. 62 is a partial close-up view of a collapsibly erectable bag 6200 showing top edge finishing, in accordance with some embodiments. Further, the collapsibly erectable bag 6200 may include an elastic component pair. Further, the elastic component pair may be sandwiched between an inner bag layer 6202 and an outer bag layer 6204. Further, the elastic component pair may include an elastic component 6206. Further, the elastic component 6206 may include a spring or a springy plastic. Further, the inner bag layer 6202 and the outer bag layer 6204 of the collapsibly erectable bag 6200 may be put together and stitched, thereby trapping springy plastic or spring in between.

Figure 63:
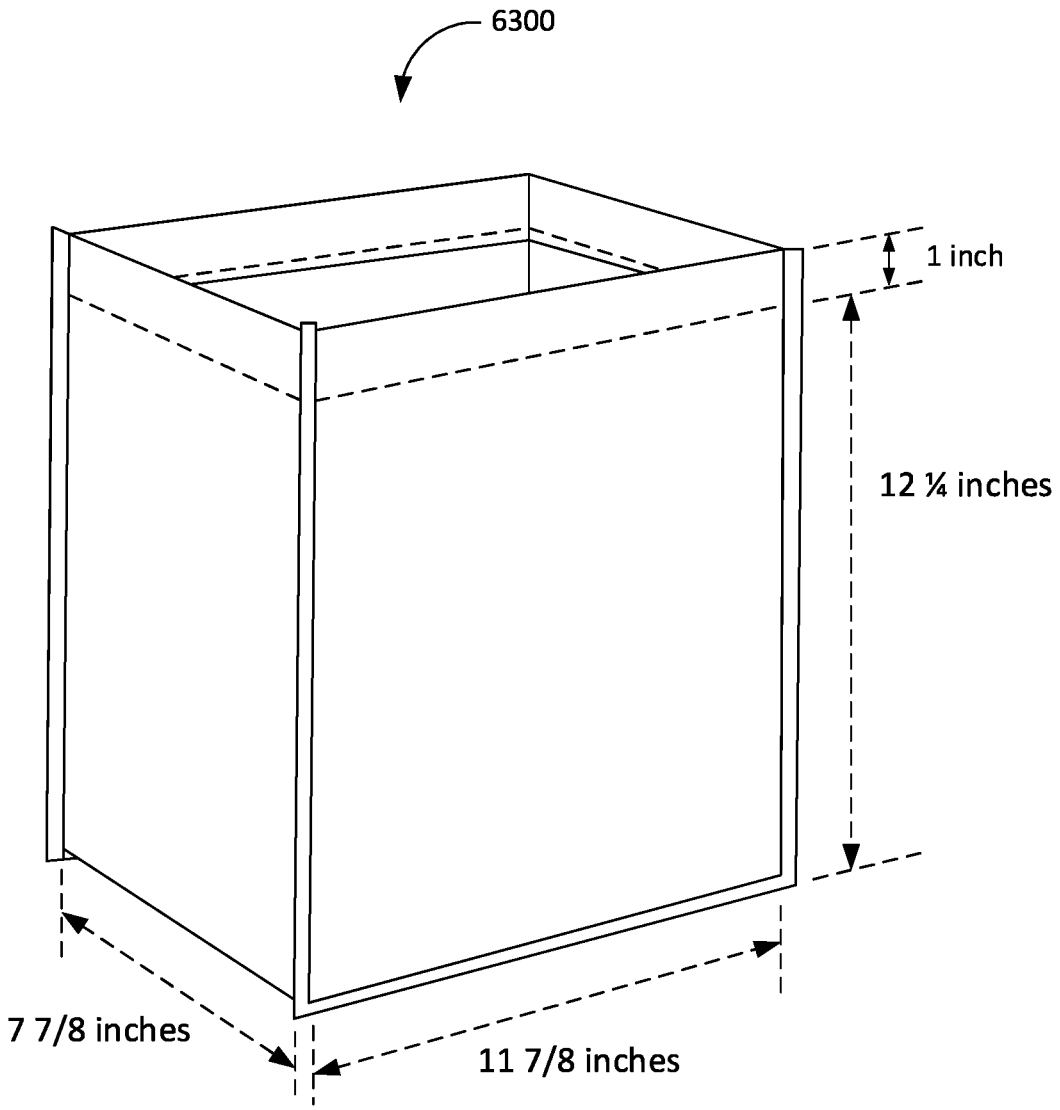
FIG. 63 is a side perspective view of a collapsibly erectable bag showing measurements of the outer bag, in accordance with some embodiments.

FIG. 63 is a side perspective view of a collapsibly erectable bag 6300 showing measurements of the outer bag, in accordance with some embodiments. Further, the collapsibly erectable bag 6300 may be associated with a length of 12¼ inches. Further, the collapsibly erectable bag 6300 may be associated with a breadth of 11⅞ inches. Further, the collapsibly erectable bag 6300 may be associated with a depth of 7⅞ inches. Further, the collapsibly erectable bag 6300 may be associated with a seam length of 1 inch. Further, the seam length of 1 inch may allow for ease of sewing pockets shut.

Figure 64:
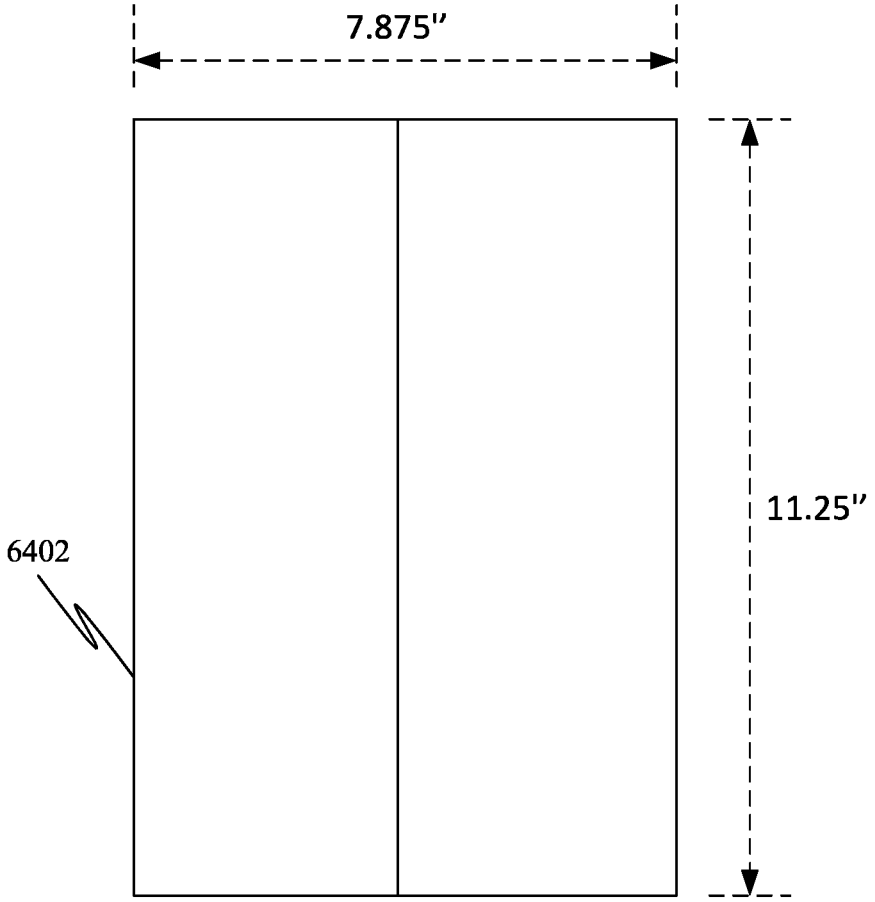
FIG. 64 is a schematic of an elastic component showing measurements, in accordance with some embodiments.

FIG. 64 is a schematic of an elastic component 6402 showing measurements, in accordance with some embodiments. Further, the elastic component 6402 may be associated with a length of 11.25 inches. Further, the elastic component 6402 may be associated with a breadth of 7.875 inches.

Figure 65:
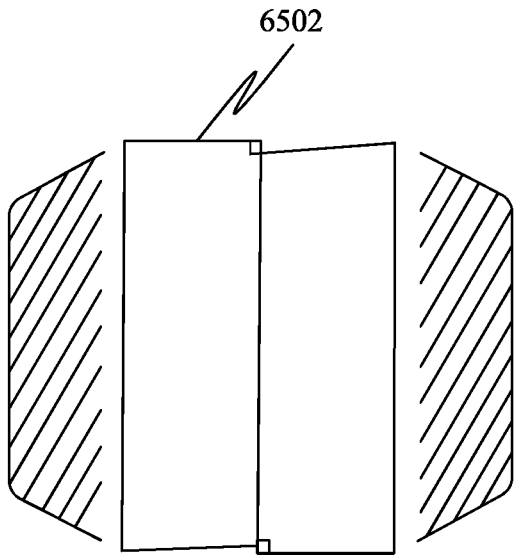
FIG. 65 is a schematic showing an elastic component, in accordance with some embodiments.

FIG. 65 is a schematic showing an elastic component 6502, in accordance with some embodiments.

Figure 66:
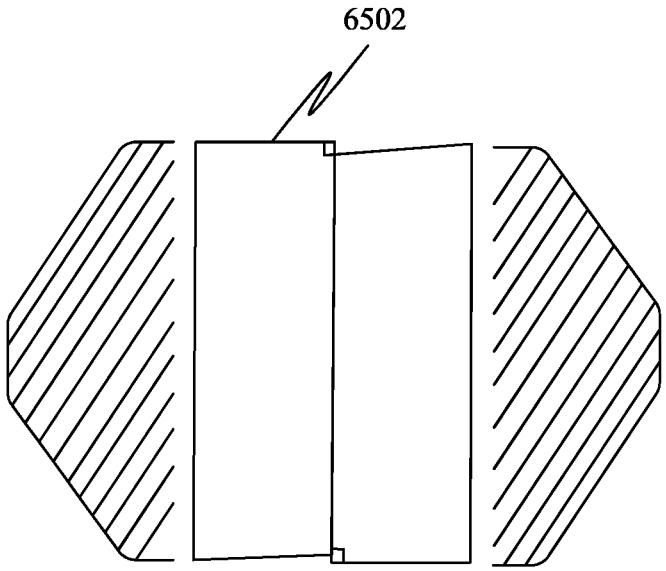
FIG. 66 is a schematic showing the elastic component, in accordance with some embodiments.

FIG. 66 is a schematic showing the elastic component 6502, in accordance with some embodiments.

Figure 67:
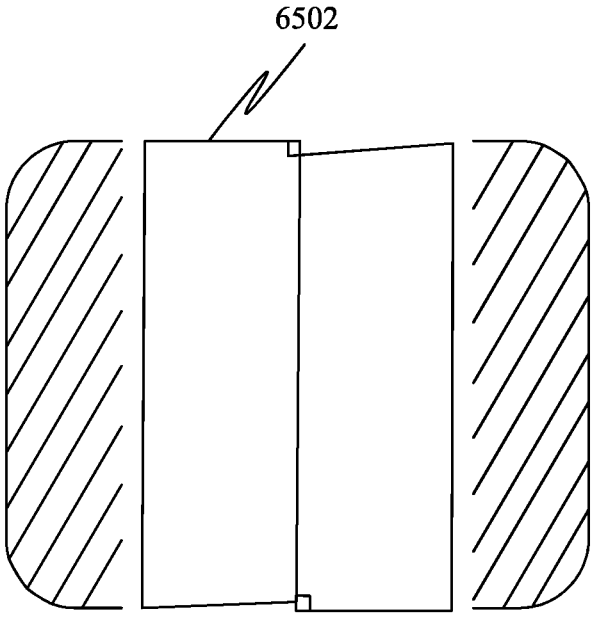
FIG. 67 is a schematic showing the elastic component, in accordance with some embodiments.

FIG. 67 is a schematic showing the elastic component 6502, in accordance with some embodiments.

Figure 68:
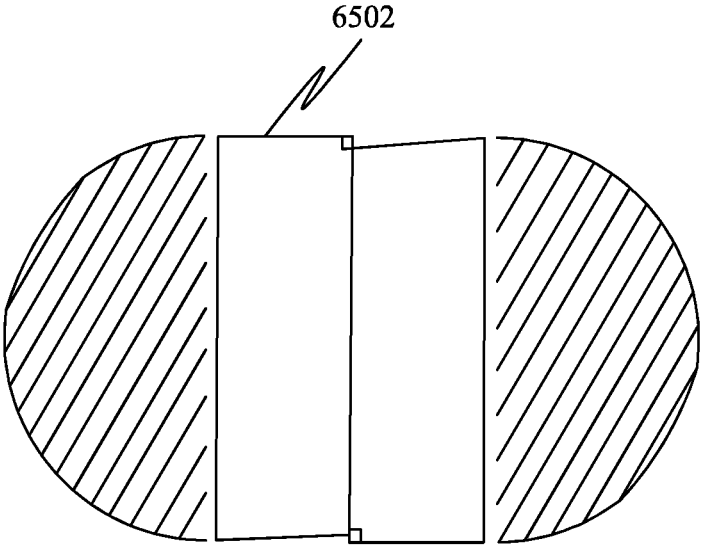
FIG. 68 is a schematic showing the elastic component, in accordance with some embodiments.

FIG. 68 is a schematic showing the elastic component 6502, in accordance with some embodiments.

Figure 69:
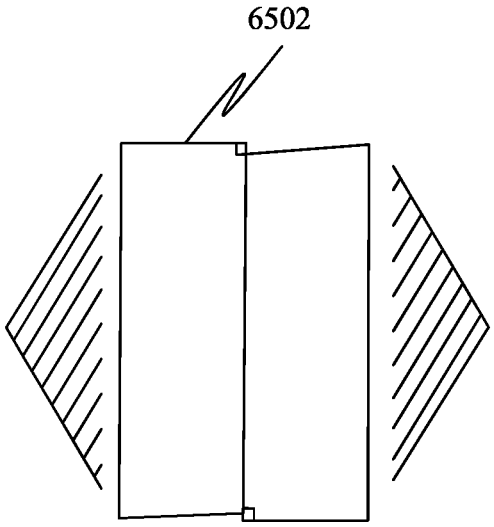
FIG. 69 is a schematic showing the elastic component, in accordance with some embodiments.

FIG. 69 is a schematic showing the elastic component 6502, in accordance with some embodiments.

Figure 70:
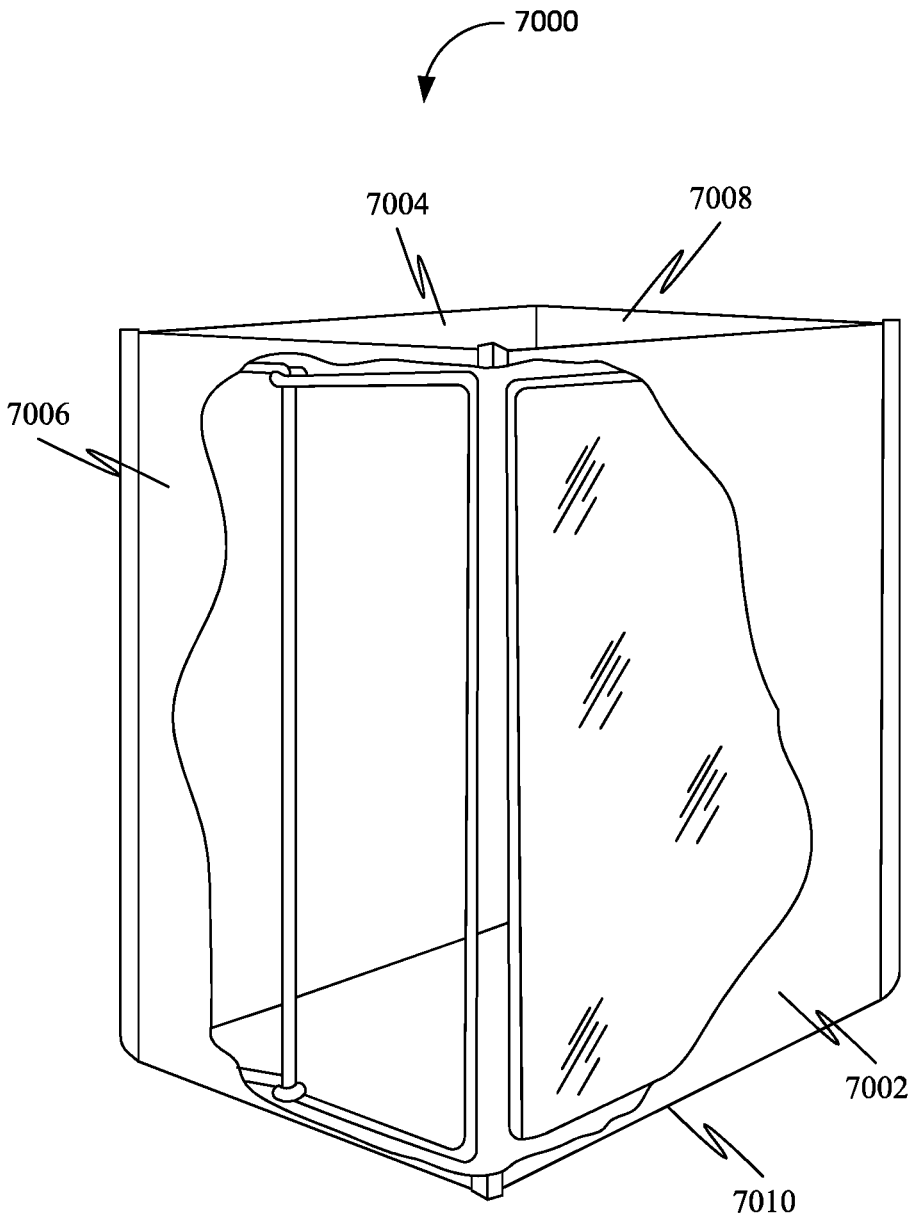
FIG. 70 is a sectional view of a collapsibly erectable bag, in accordance with some embodiments.

FIG. 70 is a sectional view of a collapsibly erectable bag 7000, in accordance with some embodiments. Further, the collapsibly erectable bag 7000 may include at least one panel and an elastic component pair. Further, the at least one panel may be configured for forming an interior space and an opening leading into the interior space. Further, the at least one panel may include a plurality of side panel pairs 7002-7008 and a bottom panel 7010. Further, a side panel pair of the plurality of side panel pairs 7002-7008 may include oppositely facing panels. Further, the elastic component pair may be coupled to a primary side panel pair of the plurality of side panel pairs 7002-7008. Further, the elastic component pair may include a spring pair. Further, the collapsibly erectable bag 7000 may include a walled rectangular rigid material pair.

Although the present disclosure has been explained in relation to its preferred embodiment, it is to be understood that many other possible modifications and variations can be made without departing from the spirit and scope of the disclosure.

The following is claimed:

1. A collapsibly erectable bag comprising:

at least one panel configured for forming an interior space and an opening leading into the interior space, wherein the at least one panel comprises a plurality of side panel pairs and a bottom panel, wherein a side panel pair of the plurality of side panel pairs comprises oppositely facing panels;

an elastic component pair coupled to a primary side panel pair of the plurality of side panel pairs, wherein applying of a force on an elastic component of the elastic component pair is configured for moving the elastic component from an initial position to a final position collapsing a first primary side panel of the primary side panel pair, wherein the moving stores potential energy in the elastic component by deforming the elastic component, wherein withdrawing of the force converts the potential energy into kinetic energy by recovering the elastic member, wherein the recovering is configured for moving the elastic component from the final position to the initial position erecting the first primary side panel;

wherein the elastic component comprises a support member pair and an elastic member, wherein the support member pair comprises a first support member and a second support member, wherein the elastic member comprises a top elastic end and a bottom elastic end and each of the first support member and the second support member comprises a top support end and a bottom support end, wherein a top support end of the first support member and a top support end of the second support member are rigidly coupled to the top elastic end and the bottom elastic end respectively, wherein the applying of the force on the first support member and the second support member is configured for rotating the first support member and the second support around a longitudinal axis of the elastic member from the initial position to the final position collapsing the first primary side panel, wherein the rotation stores the potential energy in the elastic member by deforming the elastic member, wherein the withdrawing of the force converts the potential energy into the kinetic energy by recovering the elastic member, wherein the recovering is configured for rotating the first support member and the second support around the longitudinal axis from the final position to the initial position erecting the first primary side panel;

wherein a bottom support end of the first support member and a bottom support end of the second support member are disposed off proximal to the bottom elastic end and the top elastic end respectively forming at least one member shape, wherein the at least one member shape is configured for defining the interior space;

wherein a bottom support end of the first support member and a bottom support end of the second support member is rotatably coupled with the bottom elastic end and the top elastic end respectively using a rotatable coupling mechanism, wherein the rotatable coupling mechanism is configured for facilitating the rotation of the first support member and the second support member in relation to the elastic member; and wherein the rotatable coupling mechanism comprises a circular loop-over, wherein the circular loop-over is comprised in the bottom support end of at least one of the first support member and the second support member, wherein the circular loop-over comprises a loop-over interior space of a circular profile, wherein the loop-over interior space rotatably receives at least one of the bottom elastic end and the top elastic end for facilitating the rotation of the first support member and the second support member in relation to the elastic member.

2. The collapsibly erectable bag of claim 1, wherein at least one side panel pair of the plurality of side panel pairs is comprised in the elastic component pair.

3. The collapsibly erectable bag of claim 1 further comprising a holding mechanism pair disposed on a secondary side panel pair of the plurality of side panel pairs, wherein a holding mechanism of the holding mechanism pair is configured for holding the first primary side panel in the final position post the collapsing of the first primary side panel.

4. The collapsibly erectable bag of claim 3, wherein the holding mechanism comprises a first holding mechanism part and a second holding mechanism part, wherein the secondary side panel pair is adjacent to the primary side panel pair, wherein the first holding mechanism part is attached to a first secondary panel of the secondary panel pair and the second holding mechanism part is attached to a second secondary panel of the secondary panel pair, wherein the first holding mechanism part is detachably attachable to the second holding mechanism part facilitating the holding of the first primary side panel in the final position post the collapsing of the first primary side panel.

5. The collapsibly erectable bag of claim 1, wherein the first support member is comprised in the top elastic end and the second support member is comprised in the bottom elastic end.

6. The collapsibly erectable bag of claim 1, wherein the rotatable coupling mechanism comprises a teardrop loop-over, wherein the teardrop loop-over is comprised in the bottom support end of at least one of the first support member and the second support member, wherein the teardrop loop-over comprises a loop-over interior space of a teardrop profile, wherein the loop-over interior space rotatably receives at least one of the bottom elastic end and the top elastic end for facilitating the rotation of the first support member and the second support member in relation to the elastic member.

7. The collapsibly erectable bag of claim 1, wherein the rotatable coupling mechanism comprises at least one clamp disposed on the elastic member proximal to at least one of the bottom elastic end and the top elastic end, wherein a clamp of the at least one clamp comprises a clamp interior space, wherein the clamp is configured for rotatably receiving the bottom support end of at least one of the first support member and the second support member for facilitating the rotation of the first support member and the second support member in relation to the elastic member.

8. The collapsibly erectable bag of claim 1, wherein at least one side panel pair of the plurality of side panel pairs and the bottom panel pair comprises at least one rigid material, wherein the at least one rigid material is configured for providing structural integrity to the collapsibly erectable bag.

9. The collapsibly erectable bag of claim 1, wherein the at least one panel comprises a top panel, wherein the top panel is detachably couplable with the opening, wherein the top panel is associated with at least one open state and a closed state, wherein the top panel provide access to the interior space in the at least one open state, wherein the top panel does not provide access to the interior space in the closed state.

10. The collapsibly erectable bag of claim 1, wherein the at least one panel comprises at least one strap, wherein at least one strap comprises a first strap end and a second strap end, wherein the first strap end and the second strap end are attached to the primary panel pair forming at least one strap loop.

11. The collapsibly erectable bag of claim 1 further comprising a plurality of side insulating panel pairs corresponding to the plurality of side panel pairs, a bottom insulating panel corresponding to the bottom panel, and a top insulating panel, wherein the plurality of side insulating panel pairs are disposed alongside the plurality of side panel pairs, the bottom insulating panel is disposed alongside the bottom panel forming an insulated interior space, wherein the interior space comprises the insulating interior space, wherein the top insulating panel is configured for covering the opening.

12. The collapsibly erectable bag of claim 11, wherein the plurality of side insulating panel pairs is detachably coupled to the bottom insulating panel and the top insulating panel.

13. The collapsibly erectable bag of claim 1, wherein the at least one panel comprises at least one compartment panel attached to at least one interior surface of at least one side panel pair of the plurality of side panel pairs forming at least one compartment interior space and at least one compartment opening leading into the at least one compartment interior space, wherein the interior space comprises the at least one compartment interior space.

14. The collapsibly erectable bag of claim 1, wherein the at least one panel comprises at least one compartment panel attached to at least one exterior surface of at least one side panel pair of the plurality of side panel pairs forming at least one compartment exterior space and at least one compartment opening leading into the at least one compartment exterior space, wherein the interior space does not comprise the at least one compartment exterior space.

* * * * *